US009677279B2

(12) United States Patent
Pendley et al.

(10) Patent No.: US 9,677,279 B2
(45) Date of Patent: Jun. 13, 2017

(54) CONDENSATION CONTROL IN A ROOF MOUNTED LOAD SUPPORT STRUCTURE

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 14/316,762

(22) Filed: Jun. 26, 2014

(65) Prior Publication Data

US 2015/0013248 A1 Jan. 15, 2015

Related U.S. Application Data

(63) Continuation-in-part of application No. 13/894,158, filed on May 14, 2013, now Pat. No. 9,027,291,
(Continued)

(51) Int. Cl.
*E04D 13/03* (2006.01)
*E04D 3/35* (2006.01)
(Continued)

(52) U.S. Cl.
CPC ..... *E04D 3/352* (2013.01); *E04D 3/30* (2013.01); *E04D 3/363* (2013.01); *E04D 13/03* (2013.01);
(Continued)

(58) Field of Classification Search
CPC ... E04D 13/0315; E04D 13/03; E04D 13/031; E04D 13/0305; E04D 13/032; E04D 3/28; E04D 3/30; E04D 3/352; F24F 13/32
See application file for complete search history.

(56) References Cited

U.S. PATENT DOCUMENTS 853,897 A 5/1907 Porter
3,521,414 A 7/1970 Malissa
(Continued)

FOREIGN PATENT DOCUMENTS

GB 981948 2/1965
JP 2000336859 5/2000
(Continued)

OTHER PUBLICATIONS

FAA Facility, photos of skylight installation, 3 pages, Sacramento, CA, prior to 2007.
(Continued)

*Primary Examiner* — Andrew J Triggs
(74) *Attorney, Agent, or Firm* — Thomas D. Wilhelm; Northwind IP Law, S.C.

(57) ABSTRACT

A load support structure supports a load on a metal panel roof. Such load support structure includes multiple closure members including opposing side rails, and optionally end closures. The rails are mounted on roof panel ribs. Cavities can be disposed inwardly of the outer perimeter of the support structure as defined by the closure members, in upper portions of the closure members. Rods may be inserted through slot-shaped openings, into the cavities. Cross-section dimensions of the rods are less than the widths of the cavity openings. Either the rods are compressed, or the cavity openings are expanded, or both, so as to enable manually inserting the rods into the cavities. Elongate thermal breaks may be installed at and adjacent the cavities, to assist in controlling thermal conduction through the closure members, between the outside environment and the enclosed space above the roof opening.

20 Claims, 37 Drawing Sheets

Related U.S. Application Data which is a continuation of application No. 13/066,487, filed on Apr. 14, 2011, now Pat. No. 8,438,801.

(60) Provisional application No. 61/860,122, filed on Jul. 30, 2013, provisional application No. 61/842,775, filed on Jul. 3, 2013.

(51) Int. Cl.
*E04D 3/30* (2006.01)
*E04D 3/363* (2006.01)

(52) U.S. Cl.
CPC ..... *E04D 13/031* (2013.01); *E04D 13/0305* (2013.01); *E04D 13/0315* (2013.01)

(56) References Cited

U.S. PATENT DOCUMENTS

| | | | | |
|---|---|---|---|---|
| 3,791,088 | A | 2/1974 | Sandow et al. | |
| 3,802,131 | A | 4/1974 | Resech | |
| 3,828,494 | A | 8/1974 | Uhrhane et al. | |
| 3,967,423 | A | 7/1976 | Hammond | |
| 4,073,097 | A | 2/1978 | Jentoft et al. | |
| 4,117,638 | A | 10/1978 | Kidd, Jr. et al. | |
| 4,123,883 | A | 11/1978 | Barber, Jr. et al. | |
| 4,155,206 | A | 5/1979 | Player | |
| 4,296,581 | A | 10/1981 | Heckelsberg | |
| 4,470,230 | A | 9/1984 | Weisner | |
| 4,520,604 | A | 6/1985 | Halsey et al. | |
| 4,543,753 | A | 10/1985 | Sonneborn et al. | |
| 4,559,753 | A | 12/1985 | Brueske | |
| 4,621,466 | A | 11/1986 | Sonneborn et al. | |
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A * | 8/1989 | Weisner et al. | 52/200 |
| 4,941,300 | A * | 7/1990 | Lyons, Jr. | 52/58 |
| 4,972,638 | A * | 11/1990 | Minter | 52/200 |
| 4,986,039 | A | 1/1991 | Weisner | |
| 5,027,576 | A | 7/1991 | Gustavsson | |
| 5,077,943 | A | 1/1992 | McGady | |
| 5,323,576 | A | 6/1994 | Gumpert et al. | |
| 5,511,354 | A | 4/1996 | Eidson | |
| 5,522,189 | A | 6/1996 | Mortensen et al. | |
| 5,553,425 | A * | 9/1996 | Sampson et al. | 52/58 |
| 5,561,953 | A | 10/1996 | Rotter | |
| 5,673,520 | A | 10/1997 | Yannucci, III | |
| 5,896,711 | A * | 4/1999 | McClure | 52/200 |
| 5,960,596 | A | 10/1999 | Lyons, Sr. | |
| 6,079,167 | A * | 6/2000 | Voegele, Jr. | 52/200 |
| D431,174 | S | 9/2000 | Merideth | |
| 6,151,838 | A | 11/2000 | Husein | |
| D448,095 | S | 9/2001 | Merideth | |
| 6,640,508 | B2 | 11/2003 | Lindgren et al. | |
| 6,775,951 | B2 | 8/2004 | Gumpert et al. | |
| 6,966,157 | B1 | 11/2005 | Sandow | |
| 7,043,882 | B2 | 5/2006 | Gumpert et al. | |
| 7,263,807 | B2 | 9/2007 | Gumpert | |
| 7,296,388 | B2 | 11/2007 | Valentz et al. | |
| 7,308,777 | B2 | 12/2007 | Sandow | |
| 7,395,636 | B2 | 7/2008 | Blomberg | |
| 7,712,279 | B2 | 5/2010 | McClure | |
| 7,721,493 | B2 | 5/2010 | Skov et al. | |
| 7,736,014 | B2 | 6/2010 | Blomberg | |
| 8,028,478 | B2 | 10/2011 | Valentz et al. | |
| 8,438,798 | B2 | 5/2013 | McLain et al. | |
| 8,438,799 | B2 | 5/2013 | McLain et al. | |
| 8,438,800 | B2 | 5/2013 | McLain et al. | |
| 8,438,801 | B2 | 5/2013 | McLain et al. | |
| 8,448,393 | B2 | 5/2013 | Voegele et al. | |
| 8,561,364 | B2 | 10/2013 | Pendley et al. | |
| 8,567,136 | B2 | 10/2013 | Pendley et al. | |
| 8,763,324 | B2 | 7/2014 | Pendley et al. | |
| 8,833,009 | B2 * | 9/2014 | Pendley et al. | 52/200 |
| 8,844,216 | B2 | 9/2014 | Pendley et al. | |
| 2002/0026756 | A1 | 3/2002 | Gumpert et al. | |
| 2004/0049996 | A1 | 3/2004 | Blomberg | |
| 2005/0016090 | A1 | 1/2005 | Gumpert et al. | |
| 2005/0204674 | A1 | 9/2005 | Marshall | |
| 2006/0191230 | A1 | 8/2006 | Gumpert | |
| 2007/0094984 | A1 | 5/2007 | McClure | |
| 2007/0101665 | A1 | 5/2007 | Sandow | |
| 2008/0040993 | A1 | 2/2008 | Valentz et al. | |
| 2008/0190050 | A1 | 8/2008 | McClure | |
| 2010/0162643 | A1 | 7/2010 | Blomberg et al. | |
| 2010/0269426 | A1 | 10/2010 | Richter et al. | |
| 2011/0154751 | A1 | 6/2011 | Gumpert | |
| 2011/0252726 | A1 | 10/2011 | McLain et al. | |
| 2011/0252727 | A1 | 10/2011 | McLain et al. | |
| 2012/0233941 | A1 | 9/2012 | McLain et al. | |
| 2012/0233942 | A1 | 9/2012 | McLain et al. | |
| 2013/0031855 | A1 | 2/2013 | Blomberg et al. | |
| 2013/0167459 | A1 | 7/2013 | Pendley et al. | |
| 2013/0219825 | A1 | 8/2013 | Pendley et al. | |
| 2013/0239489 | A1 | 9/2013 | Pendley et al. | |
| 2013/0239500 | A1 | 9/2013 | Pendley et al. | |
| 2013/0239513 | A1 | 9/2013 | Pendley et al. | |
| 2014/0020314 | A1 | 1/2014 | Pendley et al. | |
| 2014/0109497 | A1 | 4/2014 | Pendley et al. | |
| 2015/0013248 | A1 * | 1/2015 | Pendley et al. | 52/200 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, 1 sheet.
Cross-section of VP TUF-LITE Panel—attached to the side of SSR rib, 1 sheet.
Cross-section of Butler Lite Panel—attached to the side of MR24 rib, 1 sheet.
Siemens Building, photos of skylight installation, 6 pages, prior to 2007.
Daljcon, LLC., Butler Manufacturing, www.daljcon.com, Example of 6 Layer Standing Seam, printed Dec. 11, 2012.
ABL, Side Rails, used with thermal break, some showing thermal breaks,Technical Drawings, 15 pages.
ABL, Front Diverter and Diverter Assemblies, Technical Drawings, 10 pages.
ABL, Front and Rear Closures, Technical Drawings, 5 pages.
ABL, PVC Thermal Break (for Extruded Side Rail), 2 pages.
R & S Manufacturing and Sales Company, Inc., Standing Seam 24 Light, Quick Installation Instructions, Under/Over Seam Clip, 12 pages, Newbury Park, CA, Aug. 2012.
R & S Manufacturing and Sales Company, Inc., SS 24 Light, The First Truely Thermally Broken Metal Building Skylight, informational sheet, 1 page, Newbury Park, CA, Aug. 2012.
R & S Manufacturing and Sales Company, Inc., Enlarged sketch of metal roof showing the down slope, 1 page, Newbury Park, CA, Aug. 2012.

* cited by examiner

CONDENSATION CONTROL IN A ROOF MOUNTED LOAD SUPPORT STRUCTURE

CROSS-REFERENCE TO RELATED APPLICATIONS

This application claims priority under 35 U.S.C. 120, as a non-provisional patent application, to Provisional Application 61/860,122 filed Jul. 30, 2013, and also to Provisional Application 61/842,775 filed Jul. 3, 2013. This application also claims priority under 35 U.S.C. 120, as a Continuation-In-Part patent application to non-Provisional application Ser. No. 13/894,158 filed May 14, 2013, which is a Continuation application of non-Provisional application Ser. No. 13/066,487 filed Apr. 14, 2011, all of which are incorporated by reference in their entireties.

BACKGROUND OF THE INVENTION

Various systems are known for supporting loads on roofs, and for installing skylights and/or smoke vents onto, into roofs.

A significant motivation for use of skylights is that the daylighting which enters the building through the skylight lenses can reduce or eliminate the need for use of electrical light fixtures during the daylight hours. Further, conventionally-known control systems can monitor the light intensity at desired, selected locations inside the building and automatically turn on selected ones of the electrical light fixtures as needed in order to maintain a desired level of light intensity at the selected locations inside the building, or selectively dim, or turn off, such light fixtures when a desired level of light intensity is being delivered through the skylights.

The benefits of using skylights to obtain daylighting include lower energy costs, less use of fossil fuels for generating electricity, and potentially less worker stress or fatigue. A significant problem associated with use of conventionally-available skylight lens assemblies is that conventionally-available skylight lens assemblies are known to have high probability of leaking during rain events.

Commonly used skylighting systems have translucent or transparent covers, also known as lenses, mounted on a support structure, commonly known as a "curb", which is mounted to building support members inside the building and wherein such support structure extends through an opening in the roof. Ambient daylight passes through the lens and thence through the roof opening and into the building.

Thus, conventional skylight and smoke vent installations use a curb structure beneath the exterior roofing panels and inside the building enclosure, and extending through the roof structure, in order to provide a support which extends through the roof, past the roof panels, and which supports the skylight lens assembly. Conventional skylight curbs, thus, are generally in the form of a preassembled box-like structure. Such box-like structure is mounted to building framing members inside the building enclosure, and extends through a respective opening in the roof, and past the respective elongate metal roof panels. The skylight assembly thus mounts inside the building enclosure, and extends through an opening in a corresponding roof structure. Fitting skylight assemblies into such roof opening presents problems, both for the installer and for the user. A primary problem is that mentioned above, namely that all known types of installations of conventional skylight support structures have a tendency to leak water when subjected to rain.

In light of the leakage issues, there is a need for a more effective way to support skylights and smoke vents, thus to bring daylighting into buildings, as well as a more effective way to support a variety of other loads, on roofs.

To achieve desired levels of daylighting, conventional skylight installations use multiple roof openings spaced regularly about the length and width of a given roof surface through which daylighting is to be received. Each skylight lens is installed over a separate such opening.

Skylight assemblies of the invention are mounted on the ribs defined by metal roof panels of standing seam metal roofs. The skylight assemblies are raised above elongate centralized panel flats which extend the lengths of the panels, whereby rib elements at the sides of adjacent such roof panels are joined to each other in elongate joinders, referred to herein as the ribs.

The opening for a conventional skylight cuts across multiple such ribs in order to provide a wide enough opening to receive conventionally-available commercial-grade skylight assemblies. The conventional skylight assembly, itself, includes a curb which is mounted inside the building and extends, from inside the building, through the roof opening and about the perimeter of the opening, thus to support the skylight lens above the flats of the roof panels, as well as above the ribs. Flashing, and conventional pliable tube construction sealants are applied about the perimeter of the roof opening, between the roof panels and the flashing, including at the cut ribs. Typically, substantially all of such sealant is applied in the panel flats, which means that such sealant is a primary barrier to water leakage about substantially the entire perimeter of the skylight curb.

One of the causes of roof leaks around the perimeter of conventional roof curbs which attach primarily through the panel flat at the water line is due to foot traffic, such as heel loads or other dynamic loads imposed by workers wheeling gas cylinders or other heavy equipment on the roof panel e.g. with dollies. This type of dynamic loading can cause high levels of stress and/or flexing of the adjacent roof panels, adjacent the edges of the curb. Such joints between the roof panels and the curb typically rely solely on flashing and tube sealant to provide seals between the curb and the roof panels, most notably in the panel flats. Leaks are also commonly attributed to areas around fastener locations, as the panels flex under load, causing stress between the sealant and the respective curb and/or roof panels; whereby the sealant deforms such that, with repeated flexing of the sealant over time, passages develop through the sealant, which allows for the flow of water through such passages and into the building.

Such curbs, each extending through a separate roof opening, each sealed largely in the panel flats, create multiple opportunities for water to enter the interior of the building. Such opportunities include, without limitation, (i) the number of individual openings in the roof,
(ii) the tendency of water to collect and stay at the upper end of the curb,
(iii) the disparate expansion and contraction of the roof panels relative to the skylight-supporting curb;
(iv) the lengths of sealed seams in the panel flats; and
(v) flexing of tube sealant pursuant to localized loads being exerted on roof panels adjacent a such skylight or other opening.

The traditional curb constructions and methods of attachment in most cases thus require that a complex support structure be installed below the metal roof panels and supported from building framing structure, such as purlins, located inside the building enclosure, which allows disparate/discordant movement of the metal roof panels and the skylight assembly relative to each other, as associated with thermal expansion and contraction of the metal roof e.g. in response to differences in temperature changes outside the building relative to contemporaneous temperatures inside the building.

In addition, conventional curb-mounted skylight structures tend to collect condensation on inside surfaces of the heated space in the building.

In some known structures, water is diverted to only one side of the structure. In the case of heavy rains, it may, in some instances, be desirable to provide a support structure to divert water to both sides of the structure in order to effect faster water run-off.

In some instances, it would be desirable to provide a thermal break and/or a vapor barrier up alongside the rib and upstanding elements of the support structure in order to attenuate water vapor condensation on inside surfaces of the support structure.

In some instances, it would be desirable to provide a support structure having a combination of a thermal barrier and a vapor barrier up alongside the rib, and alongside upstanding elements of the support structure, in order to attenuate water vapor condensation on inside surfaces of the support structure, as well as to attenuate thermal conduction through the support structure.

Thus, it would be desirable to provide a skylight system which provides a desired level of daylighting in a commercial and/or industrial building while substantially reducing the incidence/frequency of leaks occurring about such skylights, as well as reducing or eliminating the incidence/frequency of condensate accumulation inside the building in the areas of such skylights.

It would also be desirable to provide a smoke vent system while substantially reducing the incidence/frequency of leaks occurring about such smoke vents, as well as reducing or eliminating the incidence/frequency of condensate accumulation inside the building in the areas of such smoke vents.

It would further be desirable to provide a support system, suitable for supporting any of a variety of roof loads, up to the load-bearing capacity of the metal panel roof while substantially controlling the tendency of the roof to leak about such support systems, as well as reducing or eliminating the incidence/frequency of condensate accumulation in the areas of such support systems.

It would be further desirable to provide thermal break structure which interrupts the path of travel of thermal energy otherwise entering the building through the skylight or smoke vent structure.

SUMMARY OF THE INVENTION

This invention provides a construction system for installing loads, such as skylight assemblies and/or smoke vent assemblies, or other loads, on the major rib elevations of a metal panel roof system of a building such that substantially all of the load is conveyed through a load support structure, thence through side rails mounted on roof panel ribs, thence through the ribs and to underlying building support structure, thereby utilizing the beam strengths of the standing seams of the rib elements of the roof panels as the primary support structure supporting such loads, such that all, or nearly all, of the overlying load is conveyed, through the ribs, to the underlying building support structure.

As used herein "beam strength" refers to the capability of a structural element to resist a bending force, as "beam strength" is defined at www.wikipedia.org. Within this context, the standing seams on the ribs, in a standing seam metal panel roof, acting in a capacity as beam web structure, provide beam-like strength in supporting/resisting the weight of overlying vertical loads imposed on the roof.

In addition, the invention can provide improved control of thermal losses, and corresponding condensation on inside surfaces of the load support structure inside the climate-controlled building envelope, by providing thermal insulation and thermal break structures, about the opening in the roof.

Some embodiments of the invention provide structure diverting up-slope water to both left and right opposing sides of the load support structure.

In a first family of embodiments, the invention comprehends, in combination, an elongate rail and an elongate rod, for collective use in a rail mounting system on a sloping metal panel roof, to support a cover which closes off access to an opening through such roof, the rail comprising a lower shoulder adapted and configured to be mounted to the roof, an upstanding web extending up from the lower shoulder, to a top of the upstanding web at an upper portion of the upstanding web, an upper flange extending laterally from the upper portion of the upstanding web to a distal end thereof, and an inner panel extending down from the upper flange to a lower reach of the inner panel, the upstanding web, the upper flange, and the inner panel collectively comprising cavity walls, and defining a cavity above the lower reach of the inner panel, and a cavity opening between the inner panel and the upstanding web, the elongate rod having a cross-section greater than a distance between the lower reach of the inner panel and the upstanding web at the cavity opening, the rod and the cavity walls defining a combination of manual resilient compressibility of the rod and manual resilient deflectability of the cavity walls such that a worker can manually deform one or both of the cross-section of the rod or a shortest distance across the cavity opening so as to insert the rod through the cavity opening and into the cavity.

In some embodiments, a dominant dimensional change which enables inserting the rod through the opening is resilient deformation of the cross-section of the rod.

In some embodiments, a dominant dimensional change which enables inserting the rod through the opening is resilient deformation of at least one of the cavity walls so as to provide a dominant dimensional change at the cavity opening.

In some embodiments, the cavity walls are not substantially deformed, and resilient deformation of the cross-section of the rod is responsible for substantially all dimensional change which enables manual inserting the rod through the cavity opening.

In some embodiments, the cross-section of the rod is not substantially deformed, and resilient deformation of one or more of the cavity walls is responsible for substantially all dimensional change which enables manual insertion of the rod into the cavity opening.

In some embodiments, the inner panel extends down from the upper flange at an included acute angle of about less than 90 degrees to greater than 60 degrees, optionally about 70 degrees to about 80 degrees.

In a second family of embodiments, the invention comprehends a rail mounting system configured to be installed about an opening through a metal panel roof, to support a load, the rail mounting system comprising a plurality of lateral closure members, having lengths, and being adapted to be mounted on such roof and about such opening, the lateral closure members, when assembled to each other on such roof, collectively providing an enclosing wall, and defining an outer perimeter of the enclosing wall which, with the cover, separates a surrounded space, over the opening, from an ambient environment outside the enclosing wall, the enclosing wall comprising an upstanding web, an upper flange extending laterally from the upstanding web, and an inside panel extending down from the upper flange to a lower reach of the inner flange, the upstanding web, the upper flange, and the inside panel collectively comprising cavity walls which define an elongate cavity above the lower reach of the inner panel, and a cavity opening between the inner panel and the upstanding web; and an elongate rod having a cross-section dimension greater than a distance between the lower reach of the inner panel and the upstanding web, and sufficiently great to, when in the cavity, resist any resilient return of the inside panel toward the upstanding web, the cavity walls being sufficiently resiliently deflectable that a worker can move a distal edge of the inside panel a sufficient distance away from the upstanding web so as to enable the worker to push the rod into the cavity through the slot, the cross-section dimension, and compressibility characteristics, of the rod, and the resilient deflectability of the cavity walls collectively generating sufficient ongoing force between the rod and the cavity walls to retain the rod in the cavity thereby to hold the rod in the cavity.

In some embodiments, the force between the rod and the cavity walls is sufficiently great to hold an element of a layer of insulation in the cavity between the rod and the cavity walls.

In some embodiments, such rail mounting system is installed about an opening in a metal panel roof, the metal panel roof comprising a plurality of metal roof panels, each having a length and a width, and being arranged side by side, edges of adjacent ones of the metal roof panels meeting at elevated rib structure portions thereof and defining elevated roof panel ribs, panel flats being disposed between the roof panel ribs, cross-section dimension and compressibility characteristics of the rod and resilient deflectability of the cavity walls collectively generating sufficient ongoing force between the rod and the cavity walls to retain the rod in the cavity by means of friction engagement and thereby to hold an upwardly-extending element of a layer of roof insulation in the cavity between the rod and the cavity walls.

In a third family of embodiments, the invention comprehends in combination, an elongate rail and an elongate thermal break element, for use in a rail mounting system on a sloping metal panel roof to support a load which closes off access to an opening through the roof, the rail having a length and comprising a lower shoulder adapted and configured to be mounted to the roof, an upstanding web extending up from the lower shoulder, to a top of the upstanding web at an upper portion of the upstanding web, an upper flange extending laterally from the upper portion of the upstanding web to a distal end thereof, an inner panel extending down from the upper flange to a lower reach of the inner panel, the upstanding web, the upper flange, and the inner panel collectively comprising cavity walls, and defining a cavity above the lower reach of the inner panel, and a cavity opening between the inner panel and the upstanding web, the elongate thermal break element being mounted to the elongate rail and in proximal contact with the rail, and extending along substantially the entirety of the length of the rail, the thermal break, in combination with the rail, providing an enhanced thermal barrier proximate the respective portion of the rail to which the thermal break is proximate.

In some embodiments, the rail has a first thermal conductivity per unit thickness, and the thermal break has a second thermal conductivity per unit thickness, less than the thermal conductivity of the rail such that the combination of the rail and the thermal break, having a given thickness, provides the enhanced thermal barrier compared to an equal thickness of only the rail.

In some embodiments, the thermal break is mounted to the rail such that, where the thermal break is mounted to the rail, more than half of the thermal break is between the rail and the opening.

In some embodiments, the thermal break is mounted to the rail such that, where the thermal break is mounted to the rail, more than half of the rail is between the thermal break and the opening.

In some embodiments, the rail has an upstanding web, an upper flange extending laterally from the upstanding web, and an inside panel extending down from the upper flange to a lower reach of the inside panel, the upstanding web, the upper flange, and the inside panel comprising cavity walls and collectively defining a cavity above the lower reach of the inside panel, the cavity walls further defining an inside surface of the cavity, facing into the cavity, the upstanding web, the upper flange, and the inside panel each further having an outside surface, and collectively further defining an outside surface of the cavity, facing away from the cavity, the thermal break being disposed primarily on the outside surface of the cavity.

In some embodiments, each rail has an upstanding web, an upper flange extending laterally from the upstanding web, and an inside panel extending down from the upper flange to a lower reach of the inside panel, the upstanding web, the upper flange, and the inside panel comprising cavity walls and collectively defining a cavity above the lower reach of the inside panel, the cavity walls further defining an inside surface of the cavity, facing into the cavity, the upstanding web, the upper flange, and the inside panel each further having an outside surface, and collectively further defining an outside surface of the cavity, facing away from the cavity, the thermal break being disposed primarily on the inside surface of the cavity.

As used herein, the lower reach of the inside panel refers to the lowest elevation to which the inside panel reaches, which may or may not be the lower distal edge of the inside panel.

In some embodiments, the thermal break comprises an elongate thermoplastic extrusion.

In some embodiments, the thermal break overlies the outside surface of the inside panel and no more than a minor portion of the upper flange.

In some embodiments, the thermal break overlies the outside surfaces of the inside panel and the upper flange, and no more than a minor portion of the upstanding web.

In some embodiments, the thermal break overlies the outside surfaces of the upstanding web, the upper flange, and the inside panel.

In some embodiments, the thermal break overlies the outside surface of the upstanding web, the upper flange, and a minor portion, if any, of the inside panel.

In some embodiments, the thermal break comprises surface irregularities on an inside surface of the thermal break, facing the rail, so as to create thermally effective dead air spaces between the rail and the thermal break.

In some embodiments, at least 50 percent of the inside surface of the thermal break is spaced from the respective surface of the rail at the surface irregularities.

In some embodiments, the invention comprehends a rail mounting system comprising a plurality of lateral closure members configured to be mounted about such opening and thereby to close off such opening, the closure members comprising first and second rails, and end elements, including a rail as described herein, each of the lateral closure members having an upstanding web, an upper flange extending laterally from the upstanding web, and an inside panel extending down from the upper flange to a lower reach of the inside panel, the upstanding web, the upper flange, and the inside panel comprising cavity walls and collectively defining the cavity above the lower reach of the inside panel, the cavity walls each having an inside surface, facing inwardly into the cavity, and an outside surface facing away from the cavity, the thermal break being disposed primarily on one of the inside surfaces or the outside surfaces of the cavity walls.

In some embodiments, the thermal break is disposed primarily on inside surfaces of the cavity walls.

In some embodiments, the thermal break extends, from the inside surface of the inside panel, about a bottom distal edge of the inside panel and upwardly on an outside surface of the inside panel to an upper edge of the inside panel at a corner defined by the inside panel and the upper flange.

In some embodiments, the rail mounting system is mounted on a roof of a building, about the opening in the roof of the building, the end elements having upstanding webs, each lateral closure member having a mounting flange extending from a top of the respective upstanding web, a layer of insulation extending upwardly from inside the building, alongside the lateral closure members and being held in the cavities in the lateral closure members, the thermal breaks being effective to prevent condensation at surfaces of the upper flanges which are exposed to an interior environment inside the building.

In some embodiments, the layer of insulation, in combination with the thermal breaks on each of the lateral closure members, provides effective thermal break properties from below the roof of the building, up through the opening, and up to a top of the rail mounting system, and about a full outer perimeter of the rail mounting system on the roof.

BRIEF DESCRIPTION OF THE DRAWINGS

A more complete understanding of the present invention and the attendant features and advantages thereof may be had by reference to the following detailed description when considered in combination with the accompanying drawings wherein the FIGURES depict various components and compositions of support structures of the invention.

Figure 1:
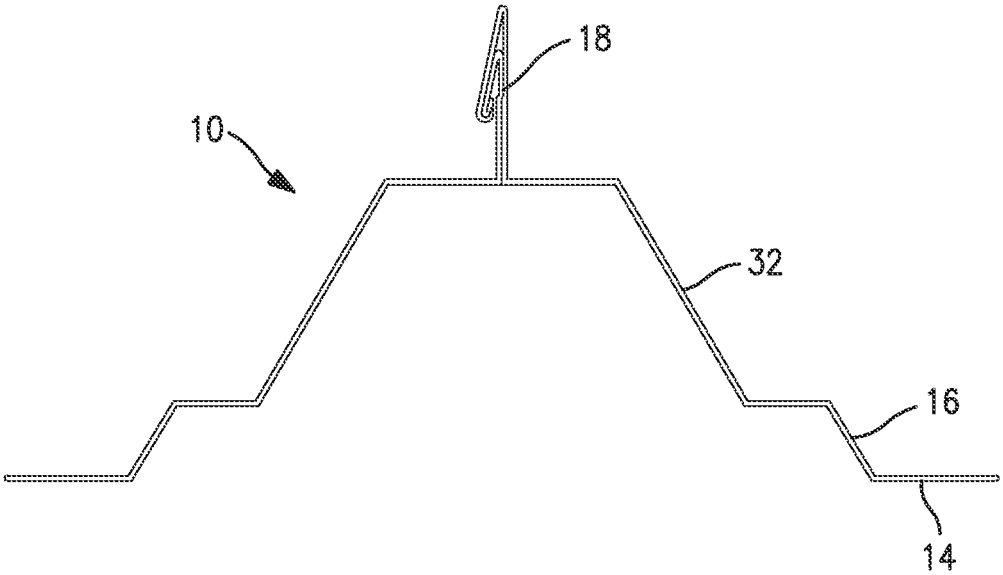
FIG. 1 is a profile of a metal roof of the type known as a standing seam roof.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a load support structure, for use in installing and supporting various exterior roof loads, including structures which close off openings in metal panel roofs. For purposes of simplicity, "support structure" is used interchangeably herein to refer to various types of structures which are mounted on ribs of raised-elevation metal panel roof structures, such that substantially all of the load passes through the support structure and through the ribs on which the support structure is mounted, to the underlying building framing inside the building. The support structure typically surrounds an opening in the roof, including extending across the flat of a roof panel. Skylight assemblies and smoke vents are non-limiting examples of covers which are mounted on such support structures and which extend over, and which close off, such roof openings. Air handling operations such as vents, air intakes, and air or other gaseous exchanges to and/or from the interior of the building are non-limiting examples of operations where conduits extend through the roof opening. In the case of roof ventilation, examples include simple ventilation openings, such as, for example and without limitation, roof fans and smoke vents, which are used to allow the escape of smoke through the roof during a fire. The only limitation regarding the loads to be supported is that the magnitude of a load must be within the load-bearing capacity of the roof panel or panels to which the load is mounted.

The number of skylights or other roof loads can vary from one load, to as many loads as the building roof can support, limited only by the amount of support which the respective roof panels, namely the ribs to which the load is attached, can provide.

The invention provides structures and installation processes, as closure systems which utilize the beam-like bending resistance of the standing seams, in the roof panel ribs, as a primary support, supporting e.g. a downwardly-directed load on the roof.

Support structures of the invention do not need to be mounted directly to the building framing inside the climate-controlled building enclosure for the purpose of being themselves supported, and thereby supporting, an installed skylight system or other load. Neither does the skylight system of the invention require a separate curb construction surrounding each skylight lens assembly to separately support or mount or attach each skylight lens assembly to the roof. Rather, a support structure of the invention, which supports such skylights, is overlaid onto, and mounted to, the roof panels, thus exposing the support structure to the same ambient weather conditions as the weather conditions which the surrounding roof panels experience. Accordingly, the support structure experiences approximately the same, or a similar, rate of thermal expansion and contraction as is experienced by the respective roof panel or panels to which the support structure is mounted. This is accomplished through direct attachment of the support structure of the invention, which supports e.g. a skylight assembly or other load, to the underlying metal roof panels. According to such roof mounting, and such ambient weather exposure, expansion and contraction of the support structure of the invention generally coincides, at least in direction, with concurrent expansion and contraction of the metal roof panels.

Referring now to the drawings, a given metal roof panel generally extends from the peak of the roof to the respective eave. Skylight systems of the invention contemplate the installation of two or more adjacent skylight assemblies in an end to end relationship along the major rib structure of a given such metal roof panel on the building, over a single aperture in the roof, whereby the individual skylight assemblies are installed in strips over a continuous, uninterrupted opening in the metal roof, the opening extending along a line which extends from at or near the roof ridge to a location at or near a corresponding eave.

In the alternative, a single skylight assembly can be installed over each, or any, such roof opening.

Skylight systems of the invention can be applied to various types of ribbed roof profiles. FIG. 1 is an end view showing a roof profile of a metal roof of the type known as a standing seam roof. These include the "standing seam" roof, which has trapezoidal elevated elongate major ribs 32 typically 24 inches to 30 inches on center. Each roof panel 10 also includes a panel flat 14, and may include a rib shoulder 16 as part of a rib 32, next to the panel flat. The elevated rib structures on a given panel cooperate with corresponding elevated elongate rib structures on next-adjacent panels, thus forming standing seams 18. Seams 18 represent the edges of adjacent such roof panels, folded one over the other, to form elongate joinders at the side edges of the respective roof panels. In the process of forming the standing seams, the edge regions of the rib elevations on respective adjacent panels are, together, folded over such that the standing seam functions as a folded-over raised joinder between the respective panels, thus to inhibit water penetration of the roof at the standing seam/joint.

Figure 2:
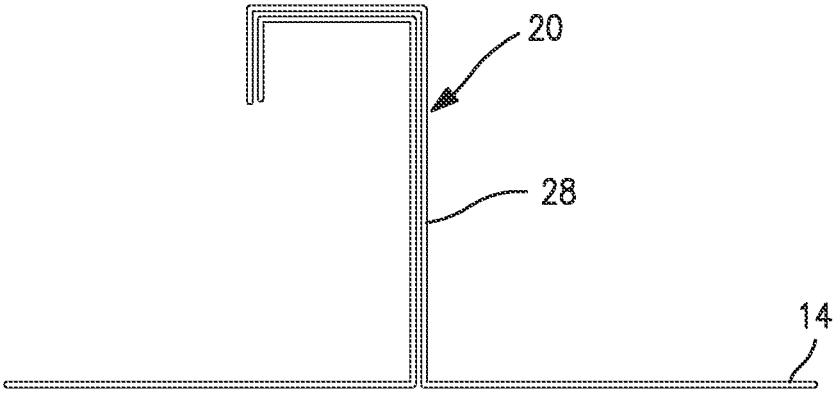
FIG. 2 is a profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 14, and a rib element of an architectural standing seam 28 on each side of the panel.

Figure 3:
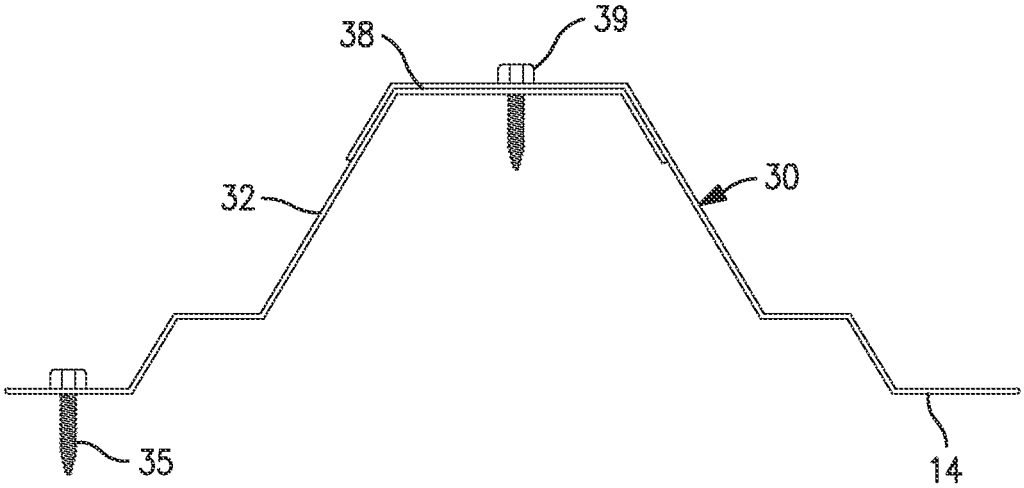
FIG. 3 is a roof profile of a metal roof of the type commonly referred to as an exposed fastener roof.

FIG. 3 is an end view showing the roof profile of a metal roof of the type commonly referred to as an "R panel" or exposed fastener panel 30. Each panel has raised shoulder elements on opposing sides of a panel flat 14 which, with the rib elements of adjacent panels, form ribs 32. Adjacent R panels are secured to the roof by fasteners 35. At side lap 38, overlapping regions of adjacent panels are secured to each other by stitch fasteners 39. Trapezoidal major ribs of the R panel roof are most typically formed at 8 inches to 12 inches on center.

Figure 4:
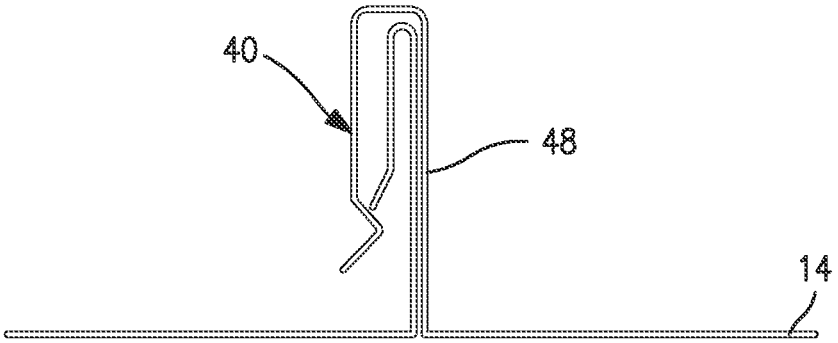
FIG. 4 is a roof profile of a metal roof of the type commonly referred to as a snap seam roof.

FIG. 4 is an end view showing the roof profile of a metal roof of the type commonly referred to as a snap rib seam panel 40. Snap rib seam panels 40 have a panel flat 14 and a standing seam, also known as a snap seam 48, where the adjacent panels meet.

Figure 5:
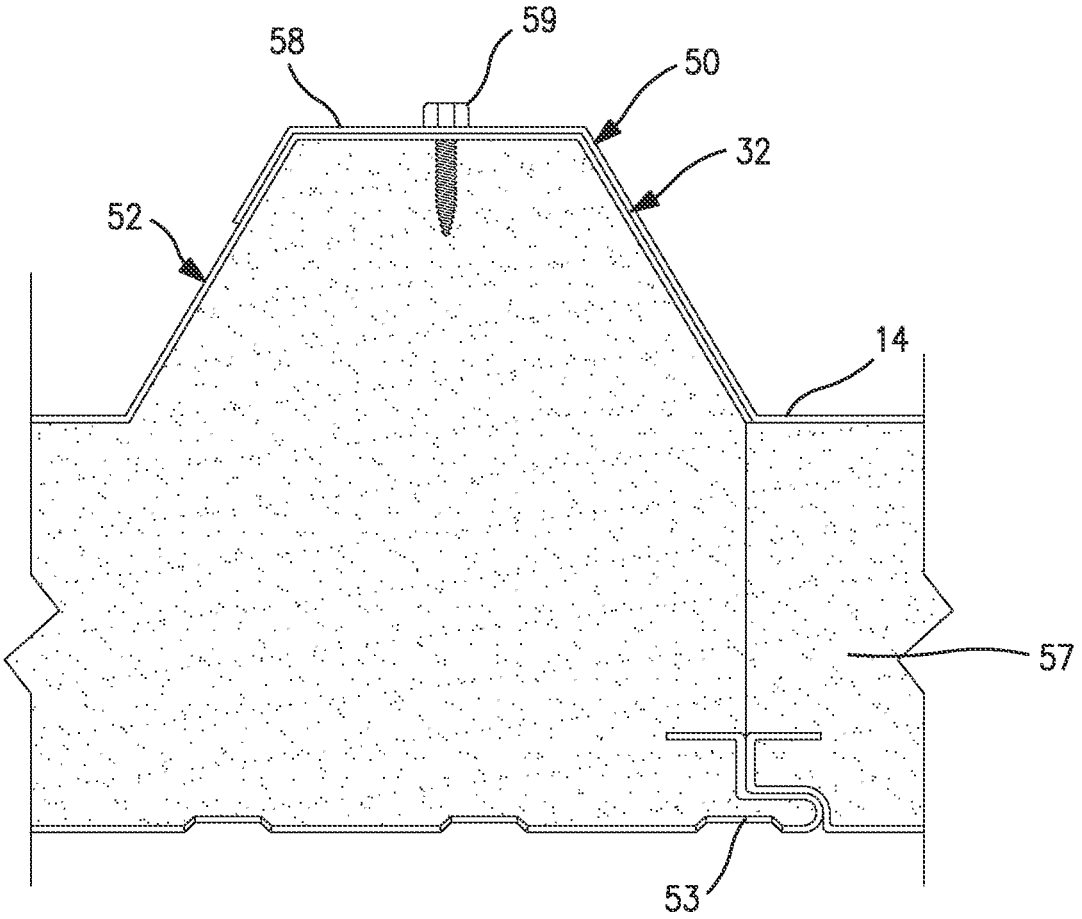
FIG. 5 is a roof profile of a metal roof of the type commonly known as a foam core roof.

FIG. 5 is an end view showing a roof profile of a metal roof of the type commonly referred to as a foam core panel 50. Such roof has a rib 32, a liner panel 53, a panel flat 14 and a foam core 57. Overlapping regions 58 of adjacent panels are secured to each other by a series of fasteners 59 spaced along the lengths of the overlapped panels.

A skylight/ventilation support structure is illustrative of support structures of the invention which close off roof-penetrating openings. Such support structure can comprise a rail and closure structure which surrounds an opening in the roof, and which is adapted to be mounted on, and supported by, the prominent standing elevations, standing rib structures, or other upstanding elements of conventional such roof panels, where the standing structures of the roof panels provide the support for the so-mounted support structures. Namely, structure which is mounted to the roof panels above the panel flats, e.g. at seams/joints/ribs where adjoining metal roof panels are joined to each other, provides the support for supporting respective loads. A such rail and closure support structure may be secured to the conventional metal roof panels across a single panel flat, by fasteners located above the respective panel flat, and surrounds a roof opening formed largely in the intervening flat region of one or more metal roof panels.

Figure 6:
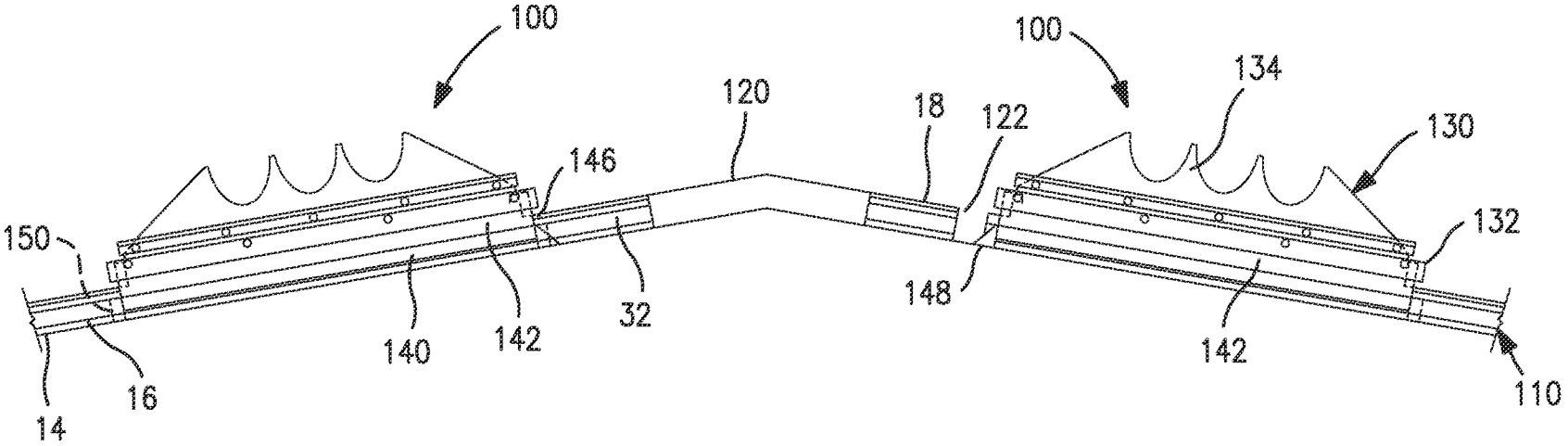
FIG. 6 is a side view showing major components of a skylight system of the invention, installed on a metal roof.

FIG. 6 shows first and second exemplary support structures 100, mounted to a standing seam panel roof 110, and overlain by covers defined by first and second skylight lens assemblies 130.

Figure 7:
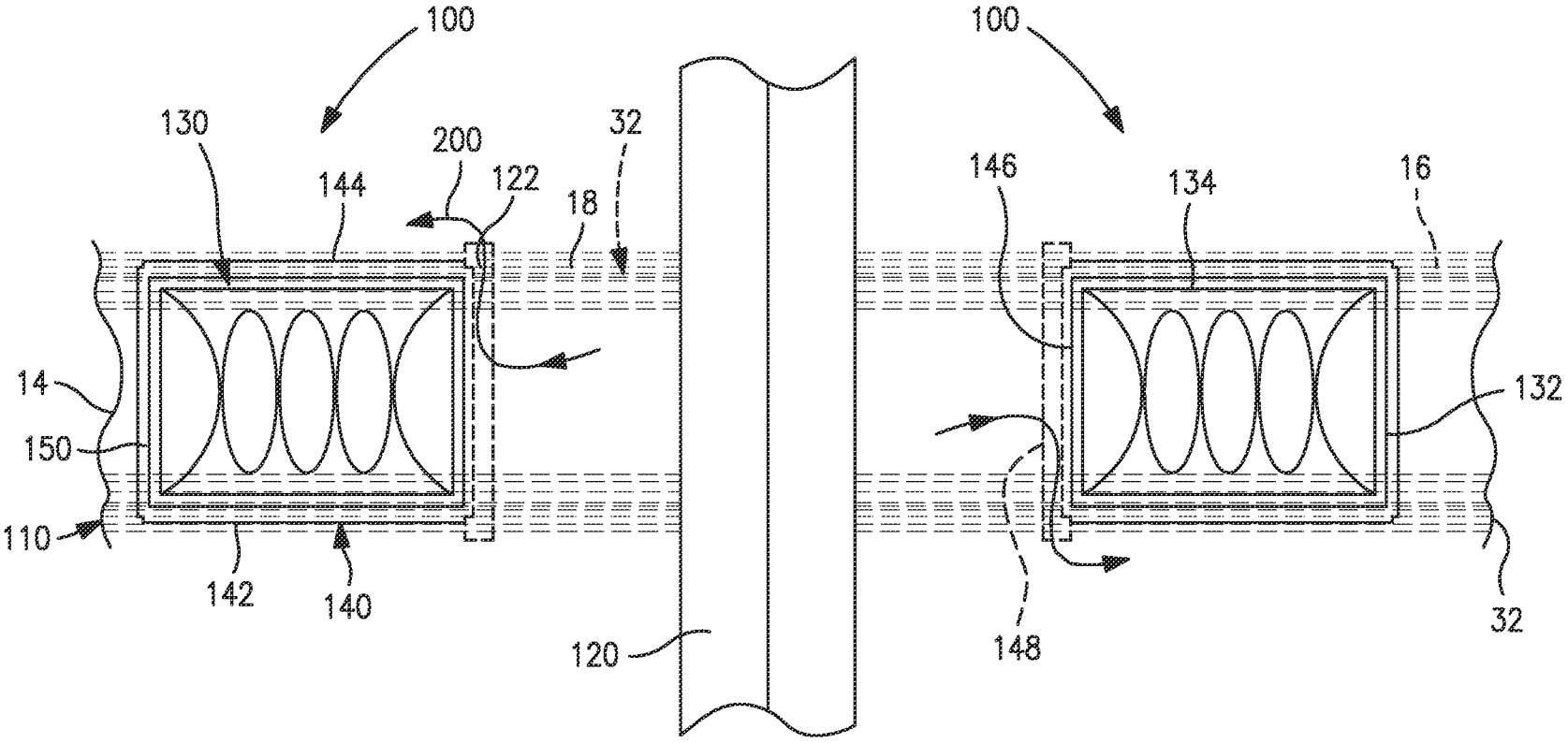
FIG. 7 is a top/plan view of the installed skylight system of FIG. 6, showing placement of the skylights and the direction of water flow around the skylights.

FIG. 7 shows a portion of the roof 110 of FIG. 6, in dashed outline. The roof has raised ribs 32, panel flats 14, shoulders 16 and standing seams 18. Given that water seeks the lowest level available at any given location, any water on a given roof panel tends to congregate/gather on the upper surface of the panel flat whereby, except for any dams across the panel flat, the water line is generally limited to the panel flat and slightly above the panel flat, depending on the quantity of water on the panel flat and the rate at which rain is falling or water is otherwise accumulating on the roof. Thus, at any given time, most of shoulder 16, and all of rib 32 above shoulder 16, and all of standing seam 18, are all typically above the top surface of the water, colloquially known as the water line. Also depicted in FIGS. 6 and 7 are ridge cap 120 of the roof structure, and cutaway regions, or gaps 122 extending through the respective raised ribs 32.

Skylight lens assembly 130, which is part of the closure system for closing off the aperture, generally comprises a skylight lens frame 132 mounted to the load support structure and extending about the perimeter of a given load support structure, in combination with a light-transmitting skylight lens 134 mounted to frame 132. An exemplary such skylight lens is that taught in U.S. Pat. No. 7,395,636 Blomberg and available from Sunoptics Prismatic Skylights, Sacramento, Calif.

Figure 8:
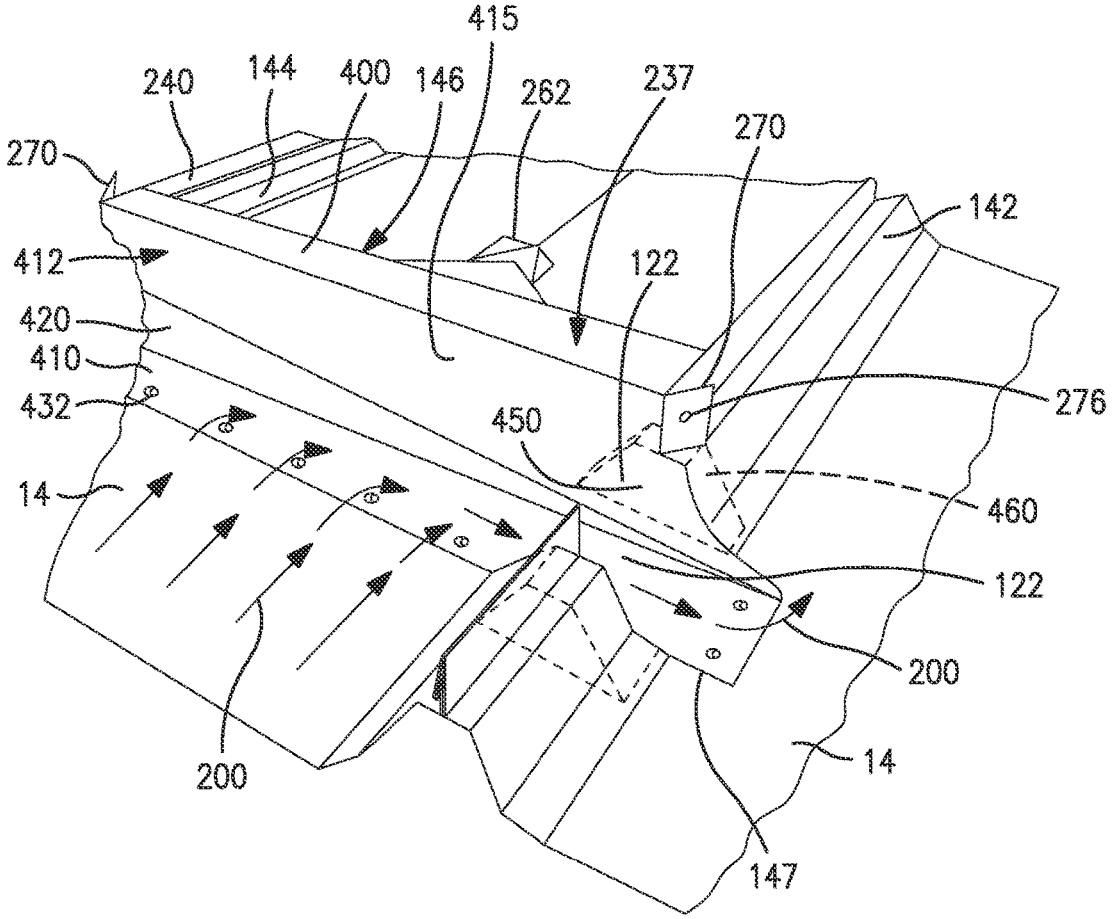
FIG. 8 is a cut-away pictorial view showing an upper diverter mounted in a rib gap.

Still referring to FIGS. 6 and 7, and now adding FIG. 8, support structure 100 of the invention, as applied to a skylight installation, includes a rail and closure structure 140. Such rail and closure structure includes one or more first side rails 142 and one or more second side rails 144 (FIGS. 9, 10), an upper diverter 146 disposed adjacent rib gap 122, and a lower closure 150. As shown in FIG. 8, a lateral leg 147 of the upper diverter extends through gap 122, providing a water-conveying bottom surface of the roof across the gap. Lateral leg 147 includes those portions of the lower flange 410, diversion surface 420, and upstanding web 415 (as rib sealing plate 450), which extend through gap 122 in the respective rib. The diverter thus carries water laterally through the gap, across the width of the respective rib, to the panel flat 14 of the adjacent roof panel, thus to convey the water away from the upper end of the skylight and to prevent the water from leaking through the roof aperture. Rail and closure structure 140 also includes panel stiffeners, connectors, bridging members, and rubber or plastic plugs to make various connections to the rail and closure structure elements as well as to close gaps/spaces between the various rail and closure structure elements, and between the roof panels and the rail and closure structure elements, thus to complete the seals which prevent water leakage about the skylight and its associated aperture in the roof.

FIGS. 7 and 8 show how gap 122 in rib 32, in combination with upper diverter 146, provides for water flow, as illustrated by arrows 200, causing the water to move laterally along the roof surface, over lateral leg 147 of the upper diverter, and down and away from the roof ridge cap 120 in panel flat 14 of the roof panel which is next adjacent the rib structures which support the respective e.g. skylight.

Figure 9:
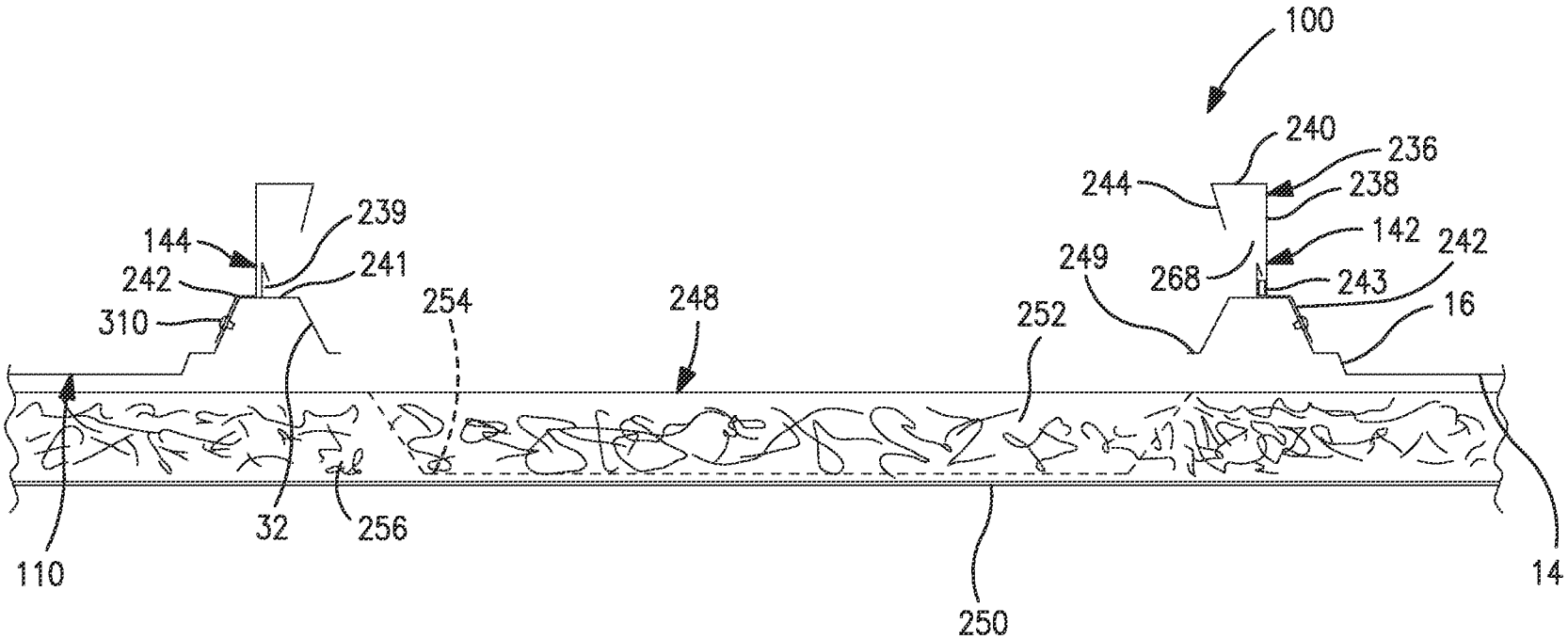
FIG. 9 is a cross sectional view showing the relationships of the rails to the rib elevations of a metal panel roof where the panel flat has been removed, including showing underlying building insulation.
Figure 10:
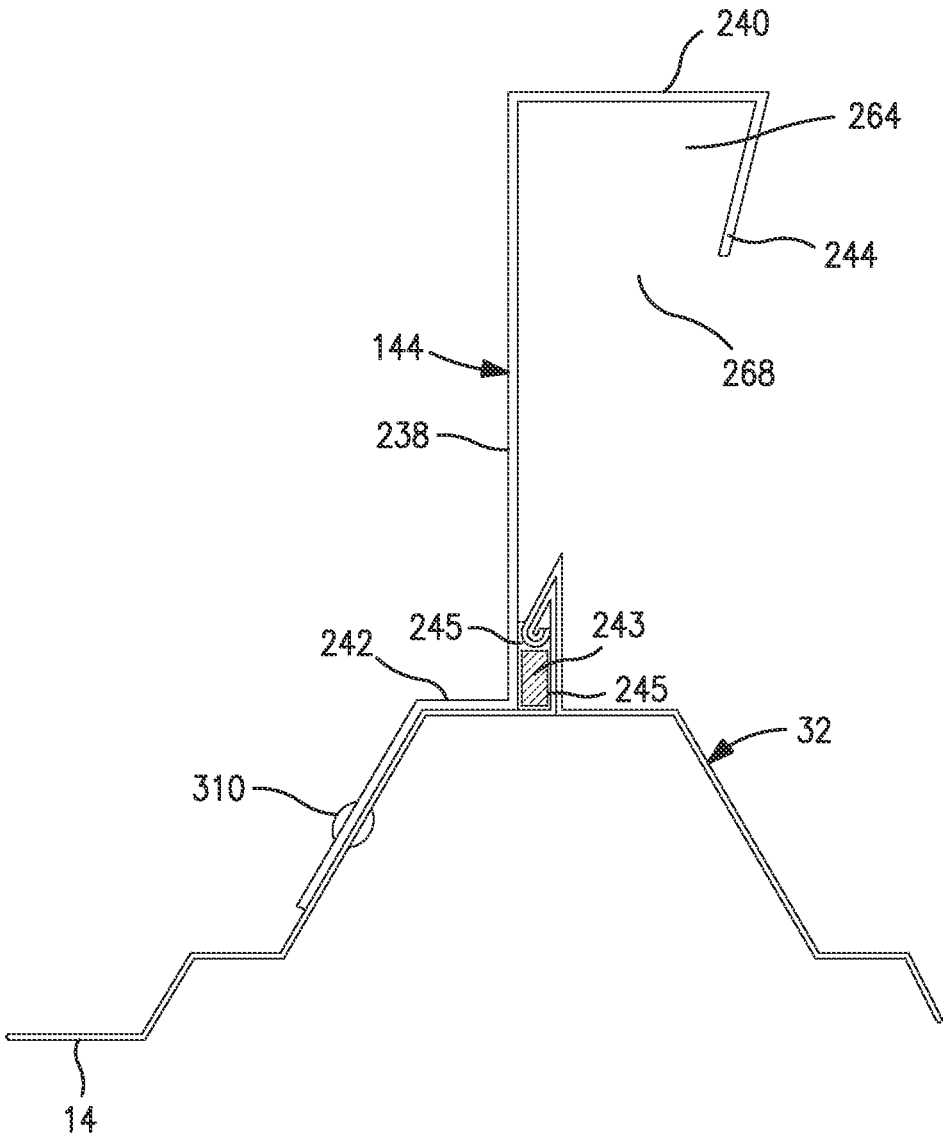
FIG. 10 is an enlarged end view of a rail mounted on a rib, illustrating a gap plug in the space between the upstanding web of the rail and the metal roof standing seam, under the turned-over edges of the standing seam.

Referring now to FIGS. 9 and 10, a cross section through rib 32, and associated support structures 100 shows securement of support structures 100 to standing rib portions of the standing seam panel roof 110. FIG. 9 depicts the use of ribs 32 to support side rails 142 and 144 on opposing sides of the panel flat 14. Each rail 142 or 144 has a lower rail shoulder 242 and a rail upper support structure 236. Rail upper support structure 236 has a generally vertically upstanding web 238, a generally horizontal rail upper flange or bearing panel 240, and a rail inside panel 244. Inside panel 244 extends toward outer web 238 at an included angle, more or less, of about 75 degrees between upper flange 240 and panel 244. From web 238, shoulder 242 extends laterally at a perpendicular angle over rib 32 as a shoulder top, and turns at an obtuse included angle down, tracking the sloped angle of the side of rib 32. The rail is secured to the side of rib 32 by fasteners 310 spaced along the length of the rib and above the adjacent panel flat, thus transferring the weight of the overlying load to the side of the rib.

As illustrated in FIGS. 9 and 10, in the joinder of each pair of adjacent panels, the edges of the two roof panels are folded together, one over the other, leaving a space 239 between the bottom edges of the folded over panel edges and the underlying top flat surface 241 of the rib. Where the space 239 faces web 238 of the rail, as at the right side of FIG. 9, and as shown in FIG. 10, a gap plug 243 is disposed in space 239 between the standing seam and under the turned-over edge, and upstanding web 238 of the rail. Gap plugs 243 are used both where the upper diverter meets the side rails and where the lower closure meets the side rails.

Where space 239 faces away from upstanding web 238 of the side rail, as at the left side of FIG. 9, the flat surface of upstanding web 238 can be brought into a close enough relationship with the standing seam that any space between the standing seam and the upstanding web can be closed by pliable tube sealants. Thus, no gap plug is typically used between upstanding web 238 and the standing seam where the distal edge of the seam is turned away from the upstanding web.

Gap plug 243 is relatively short, for example about 1.5 inches to about 2.5 inches long, and has a width/height cross-section, shown in FIG. 10, which loosely fills space 239. The remainder of the space 239, about plug 243, namely between plug 243 and upstanding web 238, and between plug 243 and the standing seam, is filled with e.g. a pliable construction sealant 245. Such sealant is shown in FIG. 10 as white space about plug 243. Plug 243 thus provides a solid fill piece at spaces 239 where there is, otherwise, some risk of water entry into the roof opening, and where the space 239 is too large for assurance that a more pliable sealant can prevent such water entry.

Gap plug 243 is made of a relatively solid, yet resilient, e.g. EPDM (ethylene propylene diene monomer) rubber, which provides relatively solid e.g. relatively non-pliable mass in space 239 between the folded-over standing seam and upstanding web 238 of the rail, and relatively pliable, putty-like, tape mastic and tube caulk or the like are used to fill the relatively smaller spaces which remain after the gap plug has been inserted in the respective gap/space. Upper flange 240, at the top of the rail, is adapted to support skylight frame 132, seen in FIG. 13. Inside panel 244 of the rail extends down from the inner edge of upper flange 240 at an acute included angle, illustrated at about 75 degrees.

Referring back to FIG. 9, insulation 248 is shown below the opening 249 in the metal roof panel. Insulation 248 has a facing sheet/vapor barrier layer 250 underlying a layer of thermally-insulating, e.g. fiberglass, batt material 252. Dashed line 254 outlines the approximate portion of the fiberglass batt material which is to be removed. An edge portion 256 of batt material is left extending into opening 249 for use described hereinafter.

Rail and closure structure 140 is representative of the perimeter portion of support structure 100. Rails 142, 144 fit closely along the contours of ribs 32. Upper diverter 146 and lower closure 150 have contours which match the cross-panel contours of the respective ribs 32 as well as matching the respective panel flats 14, 114. The various mating surfaces of structure 140 and roof 110 can be sealed in various ways known to the roofing art, including caulk or tape mastic. Plastic or rubber fittings or inserts such as plugs 243, and plugs 460, discussed hereinafter, can be used to fill larger openings at the rails and ribs.

Figure 11:
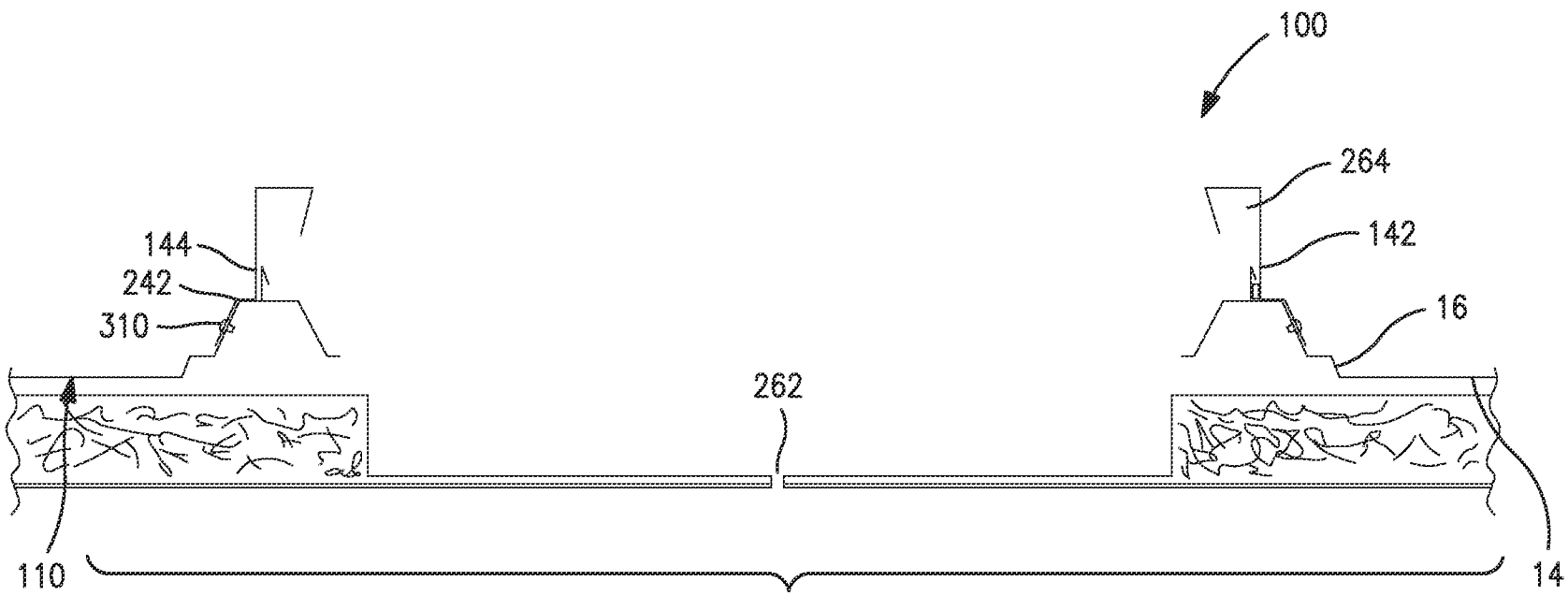
FIG. 11 shows a cross-section as in FIG. 9, after removal of that portion of the insulation batt material which was to be removed, and the insulation vapor barrier layer has been cut along the length of the aperture in the metal roof.

FIG. 11 shows the insulation batt material, marked with a dashed outline in FIG. 9, removed from its position under the central portion of the opening in the metal roof panel, removing almost all of the batt material from that portion of the facing sheet/vapor barrier layer. The vapor barrier layer is then cut along the length of the roof-penetrating opening 249 over which the one or more skylight lenses are to be installed. At the ends of opening 249, the cut is spread to the corners of the opening. A such "Y"-shaped cut 262 is illustrated at the upper end of the opening in FIG. 8, wherein the ends of the "Y" extend to approximately the upper corners of the opening.

Figure 12:
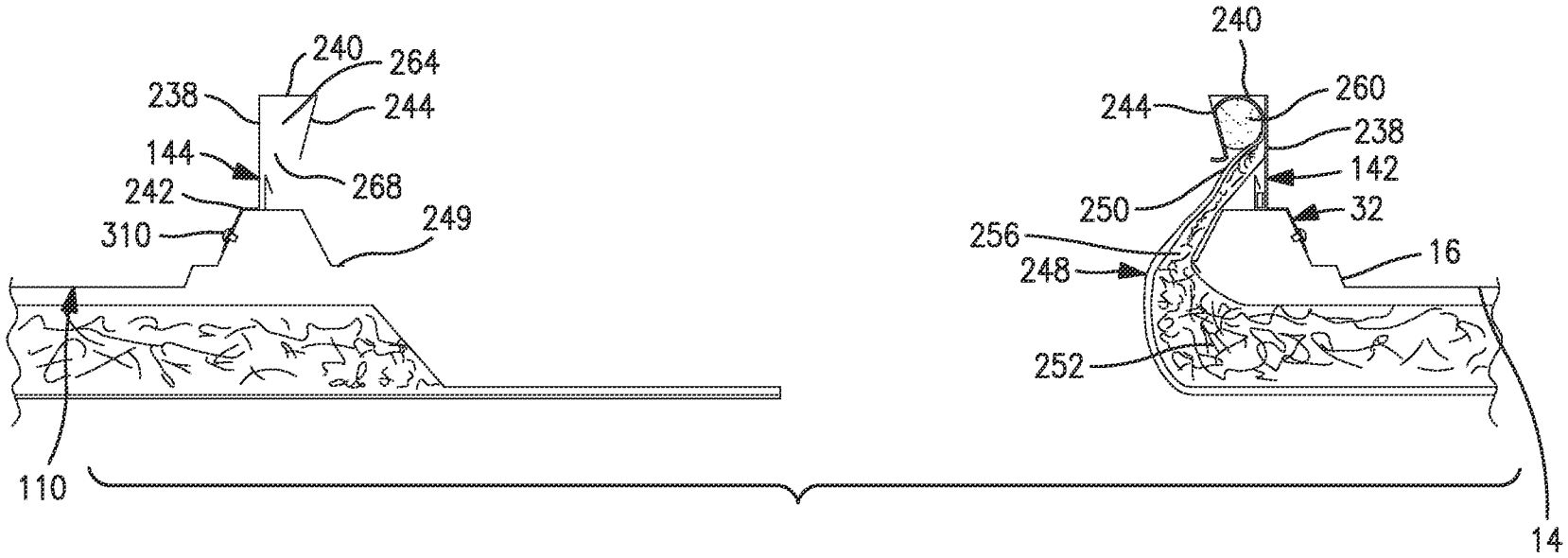
FIG. 12 shows a cross-section as in FIGS. 9 and 11 where the insulation vapor barrier layer on one side of the opening has been raised and tucked into the cavity in the rail, and is being held in the cavity by a retainer rod.

FIG. 12 shows one side of insulation 248 lifted up into the opening 249. The vapor barrier layer and edge portion 256 of the insulation batting have been lifted into the opening. A resilient foam retaining rod 260 has been forced into cavity 264 in the rail, with the vapor barrier layer captured between the retaining rod and the rail surfaces which define cavity 264, which draws the insulation batting of edge portion 256 toward, and against, and into contact with, the respective rib 32. Vapor barrier layer 250 enters cavity 264 against upstanding web 238 of the rail, extends up and over/about rod 260 in the cavity, and thence extends back out of cavity 264 to a terminal end of the facing sheet outside cavity 264. Thus, rod 260 holds edge portion 256, as thermal insulation, against rib 32, and also positions the vapor barrier layer between the climate-controlled space 266 inside the building and the perimeter of the support structure.

As illustrated, the uncompressed, rest cross-section of rod 260 in cavity 264 is somewhat greater than the slot-shaped opening 268 between inside panel 244 and upstanding web 238. Thus retainer rod 260 is deformable, and the cross-section of the rod is compressed as the rod is being forced through opening 268. After passing through opening 268, rod 260 expands against web 238, upper flange 240, and panel 244 of the cavity while remaining sufficiently compressed to urge vapor barrier layer 250 against web 238, upper flange 240, and panel 244 of the cavity whereby vapor barrier layer 250 is assuredly retained in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis. Such backer rod can be manually compressed sufficiently to effect the insertion of the foam through opening 268 and into cavity 264.

In alternative embodiments, rod 260 can comprise a less compressible material, whereupon any or all of the cavity structure elements, namely upstanding web 238, upper flange 240 and inside panel 244 are specified to be sufficiently resiliently deflectable that a worker can deflect inside panel 244 away from upstanding web 238, thus increasing the dimension of slot-shaped opening 268 enough to allow the rod to be manually pushed through the slot.

Such rod for the alternative embodiments can be any material which can effectively engage and hold the vapor barrier sheet when force is applied to the surface of the rod. Non-limiting examples of such materials are various non-foamed, or slightly-foamed, relatively higher density rubber-like materials, such as EPDM rubbers, styrene butadiene styrene rubbers, and the like. Various plastics such as PVC and various ones of the polyolefins, such as polyethylene, polypropylene, or the like, can also be used, either unfoamed or modestly foamed having densities greater than about 10 pounds per cubic foot, optionally greater than 12 pounds per cubic foot, optionally greater than 20 pounds per cubic foot, up to the unfoamed densities of the respective materials. In some instances, a wood rod/dowel is acceptable for rod 260.

In any embodiment, the installer deflects panel 244 progressively along the length of slot opening 268 while correspondingly inserting respective progressive portions of the length of rod 260 into the cavity or compresses the rod while correspondingly inserting the progressive portion of the length of the rod into the cavity, or both compresses the rod and deflects panel 244 while inserting the progressive length of the rod into the cavity. As the installer releases a respective portion of inside panel 244 or rod 260, in the process of inserting a respective portion of the rod 260 into the cavity, the respective cavity structure or rod resiliently returns toward its rest position, closing slot 268 and/or expanding the rod to its rest position, which brings inside panel 244 into a holding engagement with the rod whereby the force being exerted between rod 260 and panel 244 in attempting to return to respective unstressed configurations applies an effective frictional holding force against vapor barrier 250.

Thus, the function of capturing the vapor barrier layer can be achieved either by temporarily compressing the rod enough that the rod can be inserted through slot 268 or by temporarily enlarging slot 268 enough that the rod can be pushed through the enlarged slot, or both compressing the rod and enlarging slot 268. Accordingly, the vapor barrier can be captured by rod 260 by any of the following exemplary methods:

(i) selecting/using a rod which is sufficiently compressible that a worker can manually compress the rod while pushing the rod through slot 268, or (ii) making one or more of the cavity walls 238, 240, or 244 of material and structure whereby the respective cavity wall is sufficiently resiliently deflectable that a worker can manually enlarge slot 268 enough that the worker can push a portion of rod 260, a length at a time, through the slot, or (iii) a combination of rod compressibility and resilient deflectability of one or more of the cavity walls enables a worker to temporarily enlarge slot 268 and compress rod 260, enough that the worker can push a portion of rod 260, a length at a time progressively through the slot.

In each instance, whether compressing rod or the resiliently deflecting inside panel 244, or both, the diameter/cross-section of the rod must be ultimately sufficiently small that the rod can be inserted through slot 268 into cavity 264, while being sufficiently large that a latent force exists between the rod and inside panel 244 after installation of the rod is completed/finished.

Thus, in the first instance, the resilient rod applies a constant outwardly-directed force against the vapor barrier layer, which is transmitted through the vapor barrier layer, to inner flange 244. And in the second instance, the resiliency of inside panel 244, once released, applies a constant inwardly-directed force against the vapor barrier layer, which is transmitted through the vapor barrier layer, to rod 260. Or a combination of outwardly-directed force and inwardly-directed force cooperate with each other as the rod holds the vapor barrier layer against the inner surfaces of the cavity.

Upper diverter 146 and lower closure 150 extend across the flat of the metal roof panel adjacent the upper and lower ends of roof opening 249 (FIG. 12) to complete the closure of support structure 100 about the perimeter of the skylight opening. The upper diverter and the lower closure have upper support structures 237 having cross-sections corresponding to the cross-sections of upper support structures 236 of rails 142, 144. Those upper support structures thus have corresponding flange cavities which are used to capture vapor barrier layer 250 at the upper diverter and the lower closure. Thus, the vapor barrier layer is trapped by frictional engagement in a cavity at the upper reaches of the rail and closure structure about the entire perimeter of the rail and closure structure.

Bridging tape or the like is used to bridge between the side portions and end portions of insulation vapor barrier layer 250 at the "Y" cuts at the ends of support structure 100, such that the vapor barrier layer and tape, collectively, completely separate the interior of skylight cavity 274 from the respective elements of support structure 100 other than inside panel 244.

Figure 13:
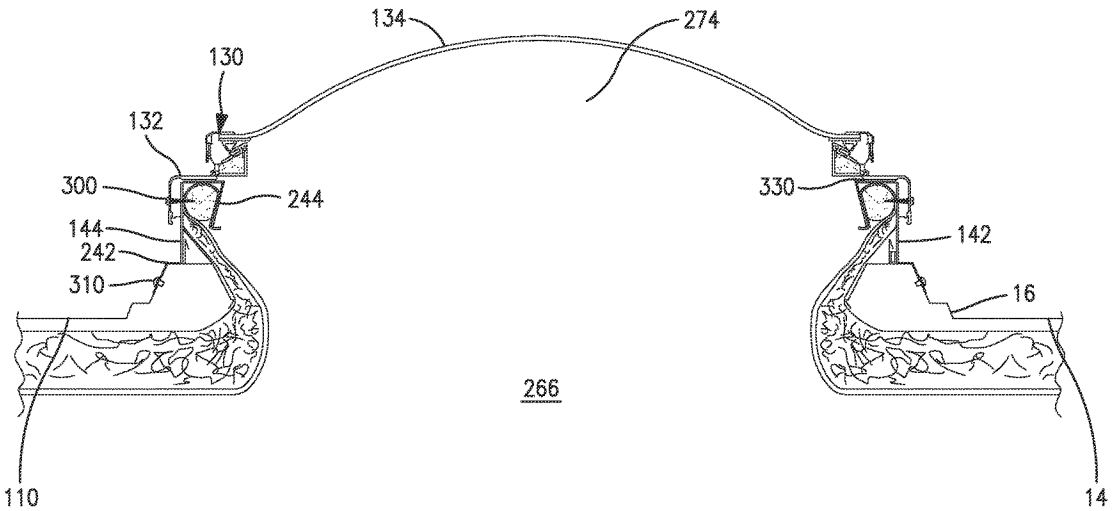
FIG. 13 shows a cross-section as in FIGS. 9 and 11-12 where the insulation underlying the roof has been extended up through the aperture in the roof, where the vapor barrier layer on both sides of the opening has been tucked into the rail cavity and is being held in the cavity by retainer rods such as that shown in FIG. 12, and where the skylight lens assembly has been mounted to the rails, and serves as a cover/closure over the aperture in the metal roof.

FIG. 13 shows vapor barrier layer 250 trapped/held in the rail cavities on both sides of the roof opening. FIG. 13 further shows the skylight subassembly, including frame 132 and lens 134, mounted to rails 142, 144, covering opening 249, and completing the closure of support structure 100 over and about opening 249. A sealant 330 is disposed between upper flange 240 and skylight frame 132, to seal against the passage of water or air across the respective interface. A series of fasteners 300 extend through skylight frame 132, through upstanding web 238 of the rail, and terminate in rod 260, whereby rod 260 insulates the inside of the roof opening from the temperature differential, especially cold, transmitted by fasteners 300, thereby to avoid fasteners 300 being a source of condensation inside the skylight cavity 274, namely below the skylight lens.

Figure 14:
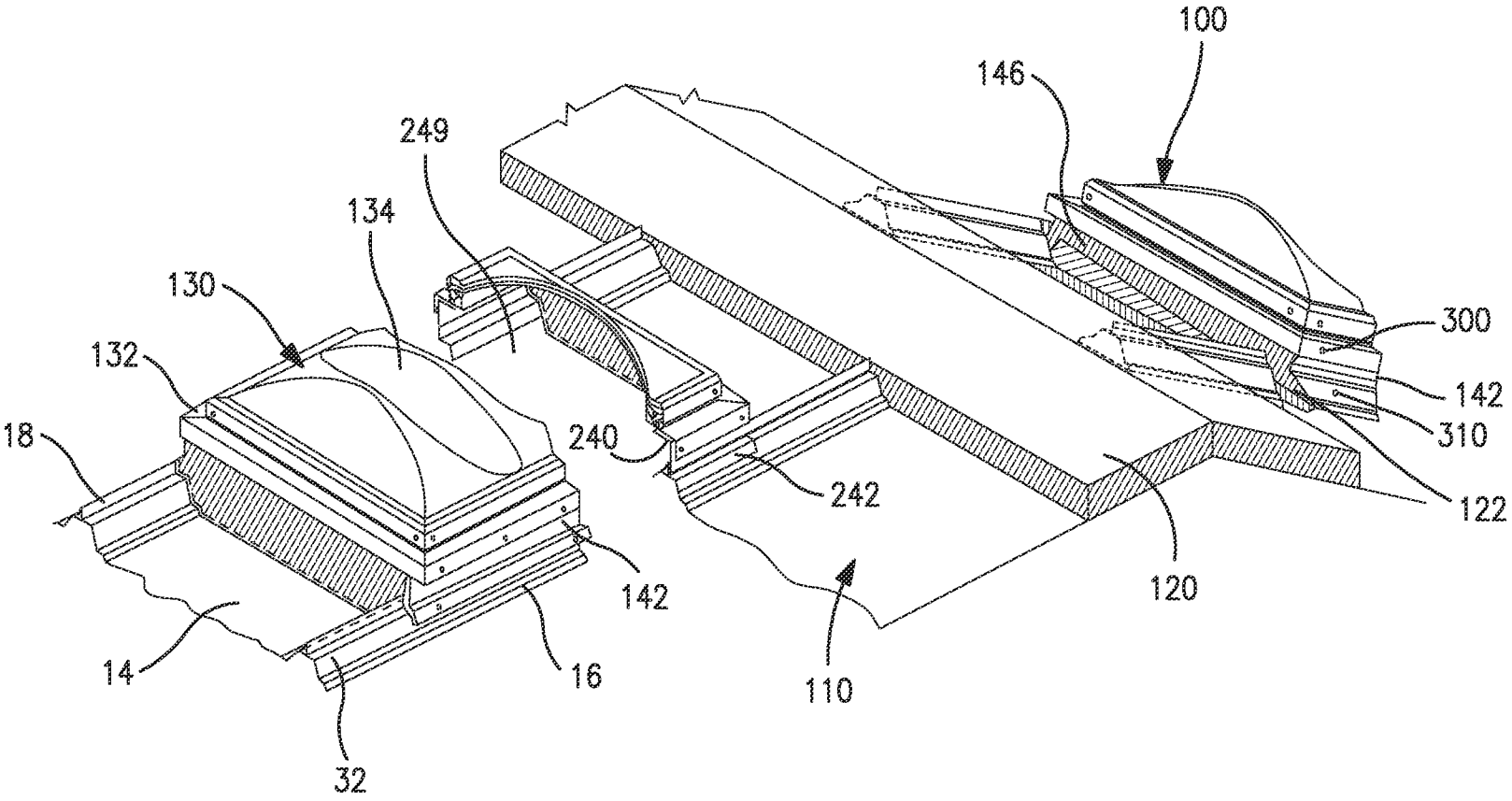
FIG. 14 is a perspective view, partially cut away, showing structure of part of a daylighting system as installed on the rib elevations of a standing seam metal panel roof.

In FIG. 14 a partially cut away perspective view of rail and closure structures 140 shows support of the rail and closure structure by standing seam panel roof 110, particularly the elevated rib 32 providing the structural support at the standing seams. FIG. 14 illustrates how the rail and closure structures cooperate with the structural profiles of the roof panels of the metal roof structure above and below the skylights, including paralleling the rib elevations in adjacent ones of the panels, and thereby providing the primary support, by the roof panels, for the loads imposed by the skylights. In this fashion, the support structures of the invention adopt various ones of the advantages of a standing seam roof, including the beam strength features of the ribs at the standing seams, as well as the water flow control features of the standing seam.

Most standing seam roofs are seamed using various clip assemblies that allow the roof panels to float/move relative to each other, along the major elevations, namely along the joinders between the respective roof panels, such joinders being defined at, for example, elevated ribs 32. By accommodating such floating of the panels relative to each other, the roof panels are free to expand and contract according to e.g. ambient temperature changes relative to any concurrent expansion or contraction of others of the roof panels.

The design of the skylight systems of the invention takes advantage of such floating features of contemporary roof structures, such that when skylight assemblies of the invention are secured to respective rib elevations as illustrated herein, the skylight assemblies, themselves, are supported/carried by the roof panels at ribs 32. Thus, the skylight assemblies, being carried by the roof panels, move with the expansion and contraction of the respective roof panels to which they are mounted.

FIG. 14 shows panel flat 14, rib 32, and shoulder 16, as well as standing seam 18. Ridge cap 120 is shown at the roof peak. Gap 122 in a rib 32 is shown adjacent upper diverter 146.

As seen in FIGS. 13 and 14, skylight frame 132 is secured to rail and closure structure 140 at side rails 142 and 144 by a series of fasteners 300 spaced along the length of the skylight frame, and rails 142 and 144 are secured to ribs 32 by a series of fasteners 310 spaced along the length of the respective rail.

In the process of installing a skylight system of the invention, a short length of one of the ribs 32, to which the closure support structure is to be mounted, is cut away, forming gap 122 in the respective rib, to accommodate drainage of water around the rail and closure structure, at that end of the rail and closure structure which is relatively closer to ridge cap 120. Such gap 122 is typically used with standing seam, architectural standing seam, and snap seam roofs, and can be used with any other roof system which has elevated elongate joinders and/or ribs.

In the retained portions of rib 32, namely along the full length of the skylight as disposed along the length of the respective roof panel, the standing seams 18 provide structural support characteristics which resemble the structural characteristics of the web of an I-beam. Thus, the standing seams, in combination with the other upstanding portions of ribs 32, support side rails 142 and 144 while maintaining the conventional watertight seal at the joinders between roofing panels, along the length of the assembly. Portions of ribs 32, inside the enclosed space of skylight cavity 274, may be removed to enlarge the roof opening, which in turn allows a further increment of additional light from skylight lens 130 to reach through the respective roof opening.

Figure 16:
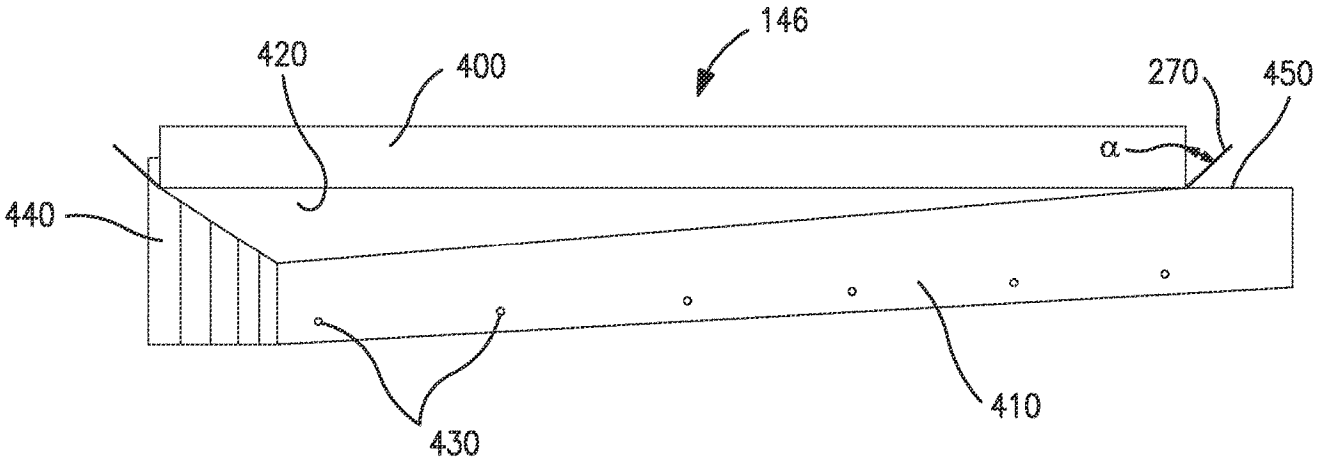
FIG. 16 is a top view of the upper diverter of FIG. 15 wherein trailing closure ears extend from the ends of the upstanding web and define acute angles with upstanding webs of respective side rails, before the trailing closure ears are closed over the upstanding webs of the side rails.
Figure 17:
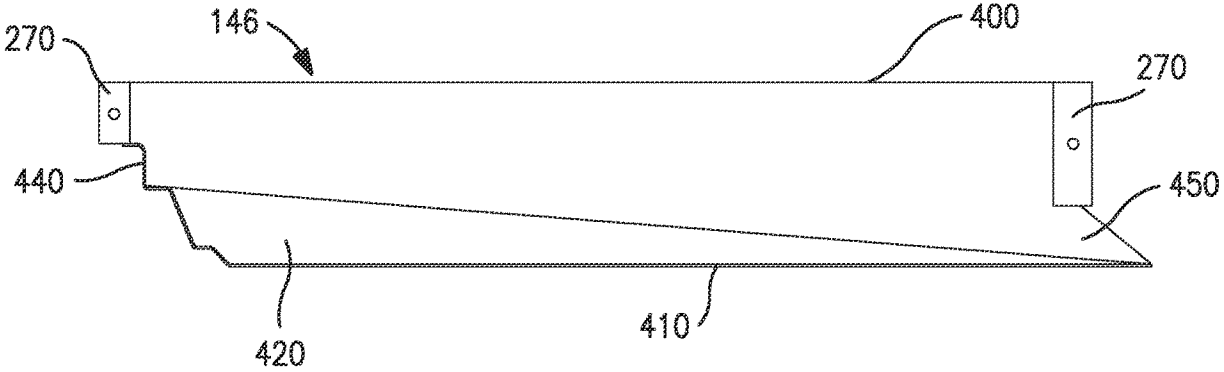
FIG. 17 is a front elevation view of the upper diverter of FIG. 16.

Lower flange 410 of diverter 146 runs along, parallel to, and in general contact with, panel flat 14 of the respective roof panel. Fastener holes 430, illustrated in FIG. 16, are spaced along the length of lower flange 410 and extend through lower flange 410 for securing the lower flange to a panel stiffener structure 148 in the panel flat, with the roof panel trapped between the lower flange and the panel stiffener structure.

Panel stiffener structure 148 is illustrated in FIG. 7 and follows the width dimension contour of the roof panel. Panel stiffener 148 is placed against the bottom surface of the respective roof panel at or adjacent the upper end of the opening in the roof. Self-drilling fasteners, such as screws 432, illustrated in FIG. 8, are driven through lower flange 410, through the metal roof panel and into panel stiffener structure 148, drawing the diverter, the roof panel, and the panel stiffener into facing contact with each other and thus trapping the panel flat of the roof panel between the panel stiffener and the diverter and closing/sealing the interface between the roof panel and the diverter. Thus, panel stiffener structure 148 acts as a nut for tightening fasteners 432. In the alternative, nut/bolt combinations, rivets, or other conventional fasteners, can be used in place of screws 432. Caulk or other sealant can be used to further reinforce the closure/sealing of the diverter/roof panel interface.

Panel stiffener 148 can also be used to provide lateral support, connecting respective ones of ribs 32 to each other. Panel stiffener 148 is typically steel or other material sufficiently rigid to provide a rigid support to the rail and closure structure at diverter 146 and to transfer the I-beam strength characteristics of the standing seam across gap 122 between the respective lengths of the standing seam.

Rail and closure structure 140 is configured such that the skylight subassembly can be fastened directly to the rails with rivets or other fasteners such as screws and the like as illustrated at 310 in FIG. 13.

Looking now to FIGS. 8, and 15 through 17, upper diverter 146 extends between rails 142, 144, and provides end closure, and a weather tight seal, of the rail and closure structure, at the upper end of the roof opening/aperture, and diverts water around the upper end of the opening/aperture, to the flat portion 14 of an adjacent panel. The upstream ends of side rails 142 and 144 abut the downstream side of diverter 146 and the height of diverter 146 closely matches the heights of the side rails. Upper flange 400 of diverter 146 thus acts with upper flanges 240 of side rails 142 and 144, and an upper surface of lower closure 150, to form the upper surface of the rail and closure structure, to which the skylight lens frame 132 is mounted, such upper surface surrounding the space which extends upwardly from the corresponding opening in the roof panel.

As illustrated, end panel 412 has a diversion surface 420. Diversion surface 420 is, without limitation, typically a flat surface, and end panel 412 defines first and second obtuse angles with lower flange 410 and with an upper web 415 of end panel 412. As indicated in FIG. 15, diversion surface 420 has relatively greater width "W1" on the side of the closure structure which is against the rib which is not cut, and a relatively lesser width "W2", approaching a nil dimension, along lateral leg 147 as extending through rib gap 122, thus to divert water toward and through gap 122.

Diversion surface 420 can, in the alternative, be either concave or convex whereby the central portion of the width "W1" and/or "W2" of the diversion surface is recessed or protruding, relative to a plane axis extending across the width of the respective roof panel and along the lengths of the lines which represent the joint between the diversion surface and upper web 415, and the joint between diversion surface and the lower flange, while the top and bottom edges of the diversion surface, namely at the respective joints, are typically, though not necessarily, represented by straight lines.

Figure 15:
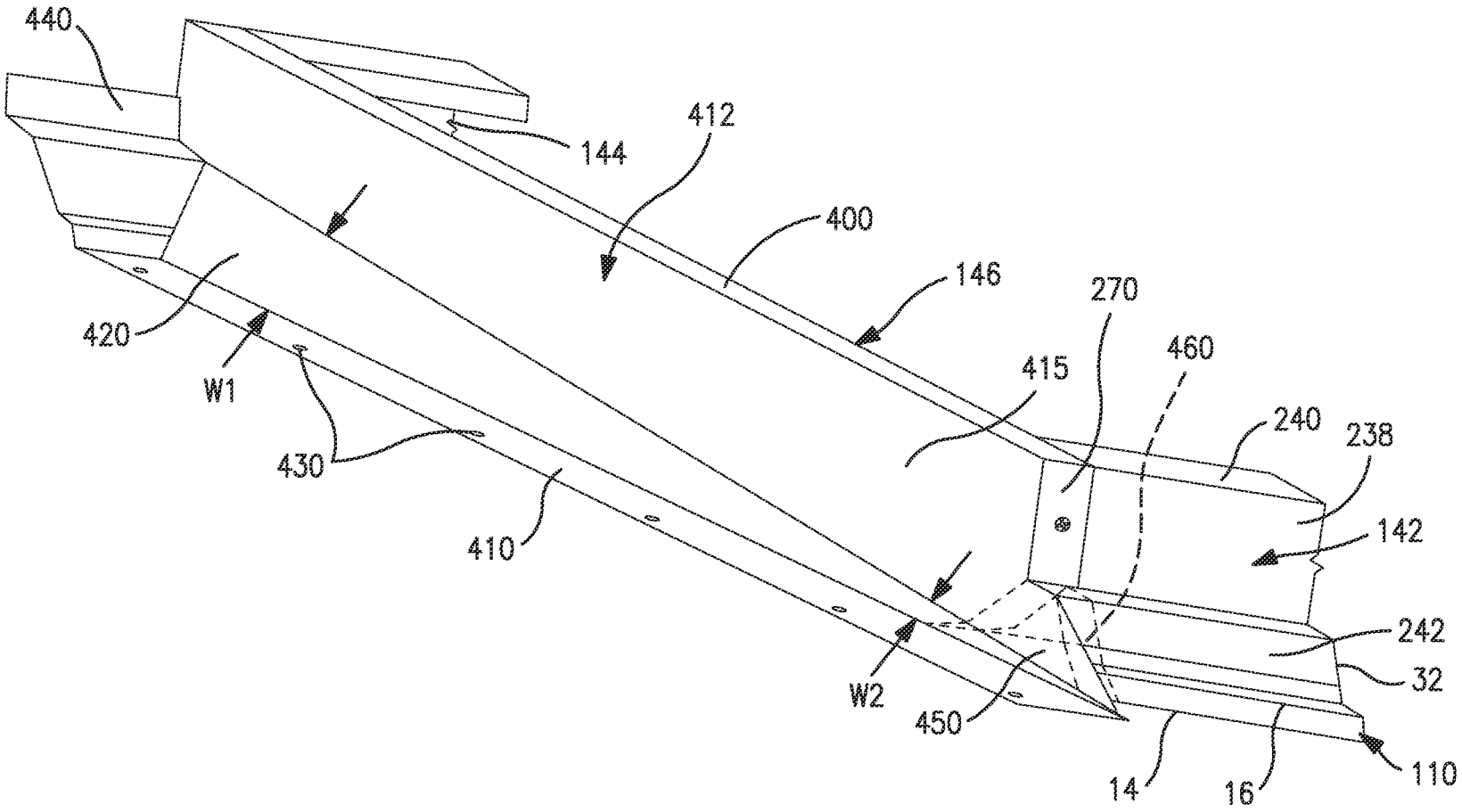
FIG. 15 is a perspective view of an upper diverter showing trailing closure ears extending from the ends of the upstanding web of the upper diverter, the closure ears having been closed and secured over the upstanding webs of the respective side rails.

Referring to FIG. 15, at the end of lower flange 410, which is closer to the closed rib, is a rib mating structure 440. Rib mating structure 440 is defined by a plurality of surfaces which collectively and generally conform the rib mating structure to the profile of the uncut rib 32. Thus, structure 440 has a plurality of surfaces which parallel corresponding surfaces of the respective rib.

At the end of lower flange 410 which is closer to the cut rib is a rib sealing portion 450 of upper web 415, which functions as an end closure of the cut rib 32 on the lower side of gap 122. Rib sealing portion 450 further functions to divert water across gap 122, through the respective rib 32, and onto the flat 14 portion of the adjacent roof panel. Rib sealing portion 450 extends through gap 122 and across the respective otherwise-open end of the rib, thus closing off access to the otherwise-open, down-slope end of the rib. Hard rubber rib plugs 460, along with suitable tape mastic and caulk or other sealants, are inserted into the cut ends of the rib on both the upstream side and the downstream side of gap 122. The upstream-side plug, plus tube sealants, serve as the primary barrier to water entry on the upstream side of gap 122. Sealing panel portion 450 covers the rib plug 460 on the down-slope side of gap 122, and serves as the primary barrier to water entry on the downstream side of gap 122, with plug 460, in combination with the tube sealant, serving as a back-up barrier.

The cross-section profiles of plugs 460 approximate the cross-section profiles of the cavities inside the respective rib 32. Thus plugs 460, when coated with tape mastic and tube caulk, provide a water-tight closure in the upstream side of the cut rib, and a back-up water-tight closure in the downstream side of the cut rib. Accordingly, water which approaches upper diverter 146, from up-slope on the roof, is diverted by diversion surface 420 and flange 410 and secondarily by web 415, toward sealing portion 450, thence through gap 122 in the rib, away from the high end of closure support structure 100 and onto the flat portion of the next laterally adjacent roof panel. Accordingly, so long as the flow channel through gap 122 remains open, water which approaches the skylight assembly from above upper diverter 146 is directed to gap 122, and flows through gap 122, and away from, and around, the respective skylight assembly.

FIGS. 8, 15, and 16 show diverter ears 270 on opposing ends of the upper diverter. An ear 270 is shown in FIG. 16, in top view, at an angle $\alpha$ of about 45 degrees to the end of upper flange 400 of the diverter. FIG. 15 shows an ear 270 after the upper diverter has been assembled to a rail, and the ear has been bent flat against the respective upstanding web 238 of the rail. After the ear has been bent flat against the rail upstanding web, ear 270 is secured to upstanding web 238 by driving a screw through aperture 276 and into the upstanding web.

As illustrated in e.g. FIGS. 8 and 15, lateral leg 147 extends through a gap 122 on the right end of the upper diverter, at the right side of the support structure, as viewed from up-slope of the diverter. Correspondingly rib mating surface 440 engages a rib at the left end of the diverter, at the left side of the support structure.

In some embodiments, not shown, the diverter can be the mirror image of the diverter as illustrated. Thus, lateral leg 147 extends through a gap 122 on the left end of the diverter, at the left side of the support structure, as viewed from up-slope of the diverter. Correspondingly, the right end of the diverter is closed off by rib mating surface 440, which engages a rib at the right end of the diverter, at the right side of the support structure. Thus, a diverter which discharges water on a single side of the support structure, as in FIGS. 8, 14, and 15 can be specified/designed to have either a right-directed discharge or a left-directed discharge.

Selection of the discharge side is generally not important where the respective roof panel is horizontal across a width of the roof panel perpendicular to the sides of the roof panel, thus between the corresponding ribs. However, in some instances, the roof is pitched down, typically gently down, across the width of the roof panel, whereby the upper diverter is selected such that lateral leg 147 is on the down-slope side of the width of the roof panel.

Figure 18:
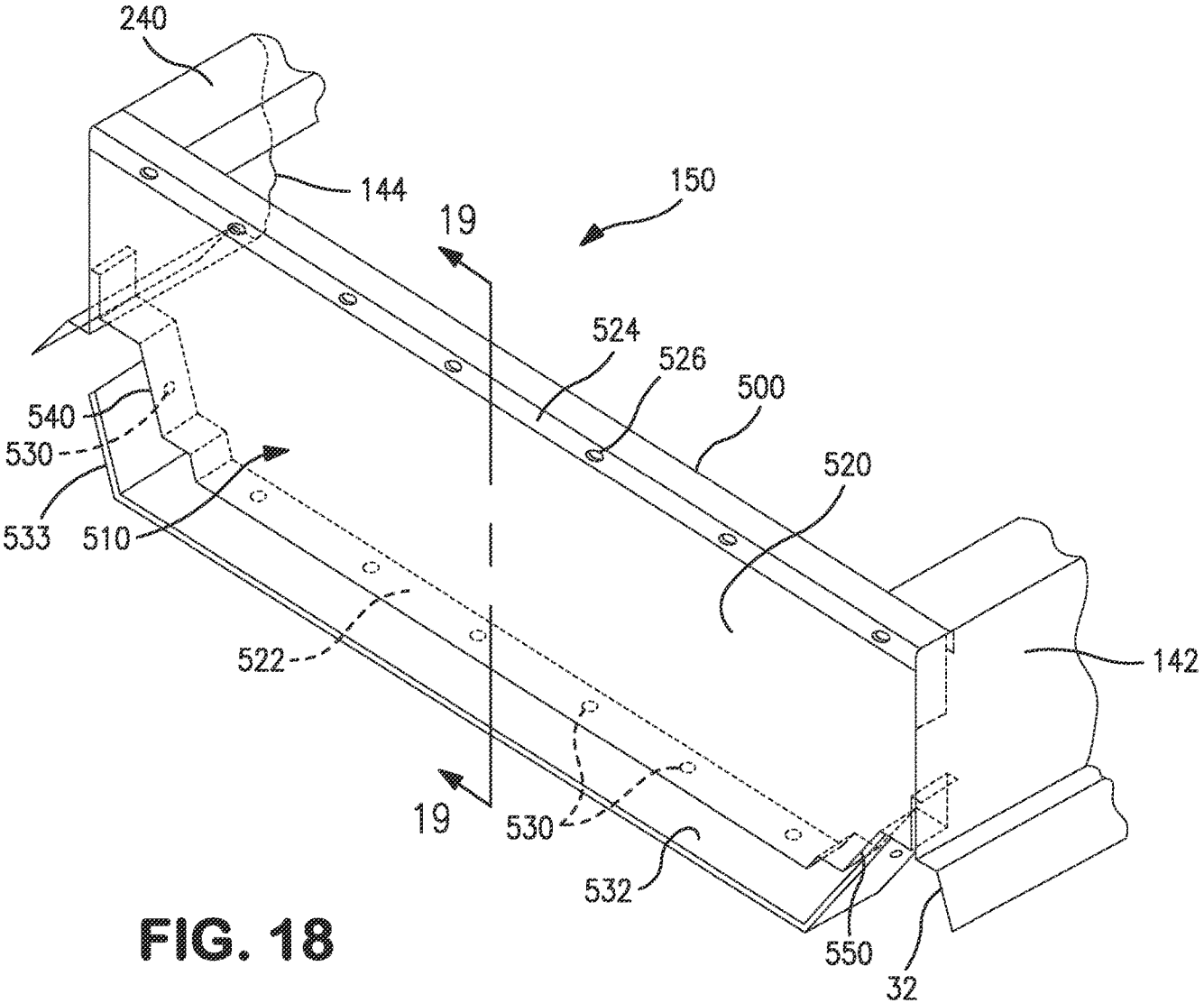
FIG. 18 is a perspective view of a two-piece lower closure and its panel stiffener.
Figure 21:
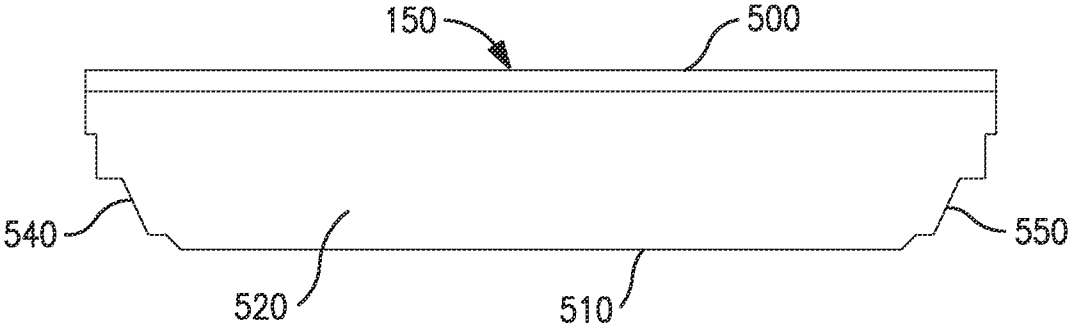
FIG. 21 is an end elevation view of the lower closure.

FIGS. 14, 18, 19, 20, and 21 show lower closure 150. The lower closure is used to establish and maintain a weather tight seal at the lower end of rail and closure structure 140, namely at the lower end of roof opening 249. As illustrated in FIGS. 14, 18, and 21, the bottom of closure 150 is contoured to follow the profiles of ribs 32, thus to extend up a cross-section of a rib in surface-to-surface relationship with the rib, as well as to follow the contour of panel flat 14 across the width of the panel between the respective ribs. Lower closure 150 abuts the lower ends of side rails 142 and 144, and the height of lower closure 150 matches the heights of side rails 142, 144.

Figure 19:
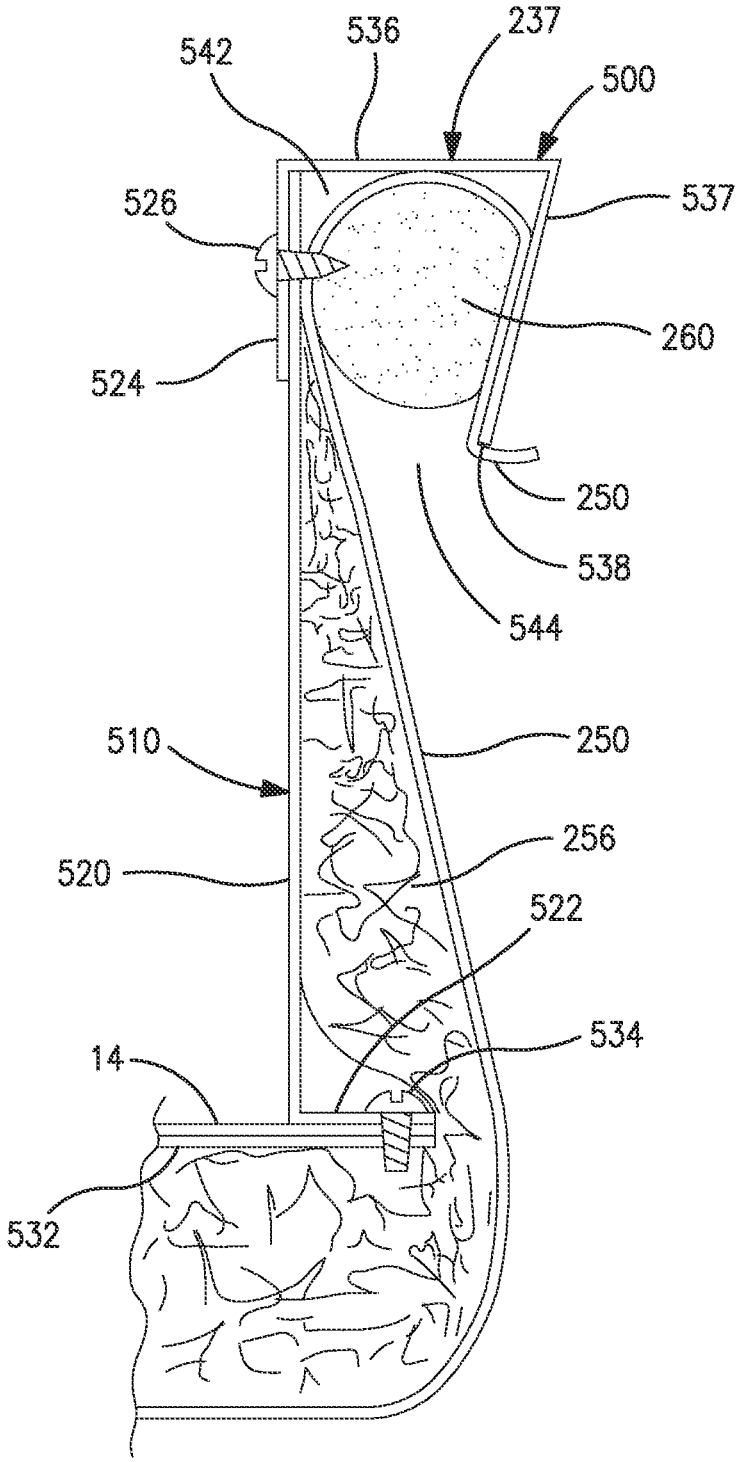
FIG. 19 is a cross-section taken at 19-19 of FIG. 18, showing the relationships between the bottom piece of the lower closure and the upper rail piece, showing the insulation vapor barrier layer being held in a flange cavity by a retainer rod, with ends of the screws which mount the upper rail piece to the bottom piece being embedded in the retainer rod, and the panel stiffener under the flat of the metal roof panel at the lower closure, whereby the joinder between the lower flange of the bottom piece of the lower closure and the flat of the roof panel is supported by the panel stiffener.
Figure 20:
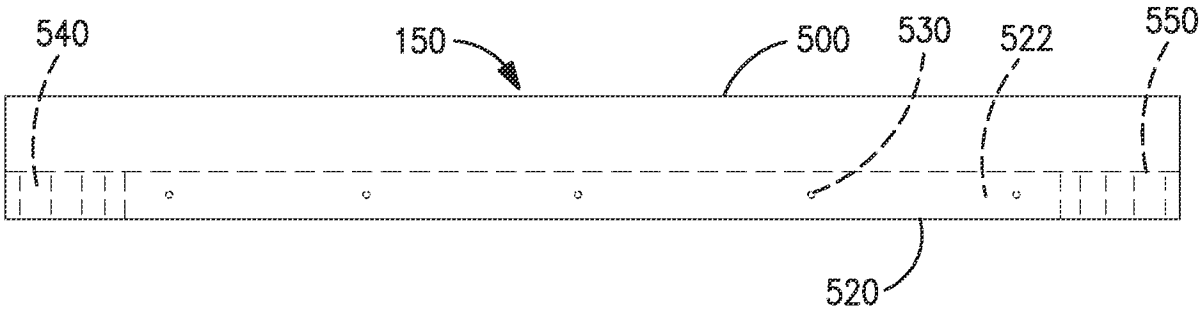
FIG. 20 is a top view of the lower closure.

Referring to FIGS. 18 and 19, lower closure 150 has a bottom portion 510, and an upper cap 500 secured to the bottom portion. Bottom portion 510 has a lower flange 522, as well as a closure web 520. Lower flange 522 is in-turned. Namely flange 522 extends inwardly of closure web 520, toward the roof opening and includes fastener holes 530. A stiff, e.g. steel, panel stiffener 532 extends the width of the panel flat under lower flange 522. Legs 533 extend upwardly at the opposing ends of panel stiffener 532, matching the profile of at least one upwardly-extending panel of the respective rib 32 so as to be in surface-to-surface relationship with the respective upwardly-extending rib panel. Self-drilling screws 534 extend through holes 530, through the respective facing portion of the roof panel, and into the roof panel stiffener. Panel stiffener 532 acts as a nut for the respective screws 534, whereby the screws can firmly secure the lower flange to the roof panel, both in the panel flat and at upstanding portions of the ribs, providing stiffening support to the securement of the lower closure to the roof panel. Tube sealants can be used to enhance such closure.

Upper cap 500 is an elongate inverted, generally U-shaped structure. A first downwardly-extending leg 524 has a series of apertures spaced along the length of the cap. Screws 526 or other fasteners extend through leg 524 and through closure web 520, thus mounting cap 500 to bottom portion 510 of the lower closure.

Cap 500 extends, generally horizontally, from leg 524 inwardly and across the top of closure web 520, along upper flange 536 to inside panel 537. Inside panel 537 extends down from bearing panel 536 at an included angle, between upper flange 536 and inside panel 537, of about 75 degrees, to a lower edge 538 of the inside panel.

Thus, the upper cap of the lower closure, in combination with the upper region of closure web 520, defines a cavity 542 which has a cavity cross-section corresponding with the cross-sections of cavities 264 of rails 142, 144. As with cavities 264 of the side rails, foam retaining rod 260 has been compressed in order to force the rod through slot 544, capturing vapor barrier layer 250 between the retaining rod and the surfaces which define cavity 542. The vapor barrier layer has been lifted into opening 249 in the roof. Vapor barrier layer 250 traverses cavity 542 along a path similar to the path through cavities 264. Thus, vapor barrier layer 250 enters cavity 542 against the inner surface of closure web 520, extends up and over/about rod 260 in the cavity, against flange 536 and panel 537, and back out of cavity 542 to a terminal end of the vapor barrier layer outside cavity 542.

The tension on vapor barrier layer 250 holds edge portion 256 of the batting against bottom portion 510 of the lower closure.

The uncompressed, rest cross-section of rod 260 in cavity 542 is somewhat greater than the cross-section of slot-shaped opening 544 between inside panel 537 and closure web 520, whereby rod 260 is compressed while being inserted through slot-shaped opening 544 and into cavity 542. After passing through opening 544, rod 260 expands against panels 520 and 537, and optionally flange 536, of the cavity while remaining sufficiently compressed to urge facing sheet 250 against panels 520 and 537 optionally against flange 536, whereby facing sheet 250 is assuredly retained in cavity 542.

In the alternative, and as with the cavities in rails 142, 144, rod 260 can comprise a less compressible material, whereupon the cavity structure such as, without limitation, inside panel 537 is specified to be relatively more resiliently deflectable. Panel 537 and/or panel 536, or panel 524, is e.g. sufficiently resiliently deflectable that slot 544 can be expanded enough to receive rod 260 with substantially no reduction in the cross-sectional area of rod 260. The properties of such panel or panels are such that such panel or panels can be temporarily deflected far enough that rod 260 can be pushed into cavity 542 by an installer, and sufficiently resilient that a so-deflected panel returns, or attempts to return, to its unstressed state with enough force and/or movement to securely hold rod 260 in place in the cavity.

Such less-compressible rod can be any material which can effectively engage and hold the vapor barrier sheet when force is applied to the surface of the rod. Non-limiting examples of such materials are various non-foamed, or slightly-foamed, relatively higher density rubber-like materials, such as EPDM rubbers, styrene butadiene rubbers, and the like. Various plastics such as PVC and various ones of the polyolefins, such as polyethylene, polypropylene, or the like, can also be used, either unfoamed or modestly foamed having densities greater than about 10 pounds per cubic foot, optionally greater than 12 pounds per cubic foot, optionally greater than 20 pounds per cubic foot, up to the unfoamed densities of the respective materials. In some instances, a wood rod/dowel is acceptable for rod 260.

In any embodiment, the installer deflects panel 537 progressively along the length of the slot-shaped opening 544 while correspondingly inserting respective progressive portions of the length of rod 260 into the cavity, or compresses the rod while correspondingly inserting progressive portions of the length of the rod into the cavity, or both compresses the rod and deflects panel 537 while inserting progressive portions of the rod into the cavity. As the installer releases a respective portion of inside panel 537 or rod 260, in the process of inserting a respective portion of the rod 260 into the cavity, the respective cavity structure or rod resiliently returns toward its rest position, which brings inside panel 537 into a holding engagement with the rod, whereby the force being exerted between rod 260 and panel 537 in attempting to return to respective former configurations applies an effective frictional holding force against vapor barrier 250.

In each instance, the compressible rod, or the resiliently deflectable inside panel 537, or both, the diameter/cross-section of the rod must be sufficiently small that the rod can be inserted through slot 544 into cavity 542, while being sufficiently large that a latent force exists between the rod and inside panel 537 after installation of the rod is complete/finished.

Thus, in the first instance, the resilient rod applies a constant outwardly-directed force against the vapor barrier layer, which is transmitted through the vapor barrier layer, to inside panel 537 and is resisted by inside panel 537. And in the second instance, the resiliency of inside panel 537, once released, applies a constant inwardly-directed force against the vapor barrier layer, which is transmitted through the vapor barrier layer, to rod 260. Or a combination of outwardly-directed forces and inwardly-directed forces cooperate with each other as the rod holds the vapor barrier layer against the inner surface of the cavity.

As with screws 300 which mount the skylight assembly to side rails 142, 144, upper diverter 146, and lower closure 150, screws 526 extend through cap 500, through closure web 520, and terminate in rod 260, whereby rod 260 insulates the inside of the roof opening from temperature differentials transmitted by screws 526, thereby to avoid the fasteners being a source of condensation inside space 274 below the skylight lens.

Upper cap 500 of the lower closure extends inwardly, toward opening 249, of closure web 520 at a common elevation with upper flanges 240 of the side rails. Collectively, the upper flanges of side rails 142, 144, lower closure 150, and upper diverter 146 form a consistent-height top surface of the rail and closure structure, which receives the skylight lens subassembly.

Closure 150 includes rib mating flanges 540 and 550, as extensions of lower flange 522, to provide tight fits along ribs 32.

A salient feature of support structures 100, relative to conventional curb-mounted skylights, is the reduction in the number of roof penetrations, namely roof openings, required to provide daylight lighting to the interior of a building, as multiple skylight assemblies can be mounted along the length of a single elongate opening in the roof, whereby fewer, though longer, openings can be made in the roof. Namely, a single opening in the roof can extend along substantially the full length of a roof panel, if desired, rather than cutting multiple smaller openings along that same length, and wherein the single opening can provide for an equal or greater quantity of ambient light being brought into the building through a smaller number of roof openings.

Another salient feature of support structures 100, relative to conventional curb-mounted skylights, is the fact that the full lengths of the entireties of the sides, namely the side rails, are above the panel flats, namely above the typical high water elevations of the respective metal roof panels.

Yet another salient feature of support structures 100, relative to conventional curb-mounted skylights, is the provision of lateral leg 147 of the upper diverter, which diverts water laterally away from the upper end of the support structure while maintaining the integrity of the rib at full height at the upper diverter, on the opposing side of the support structure.

Figure 22:
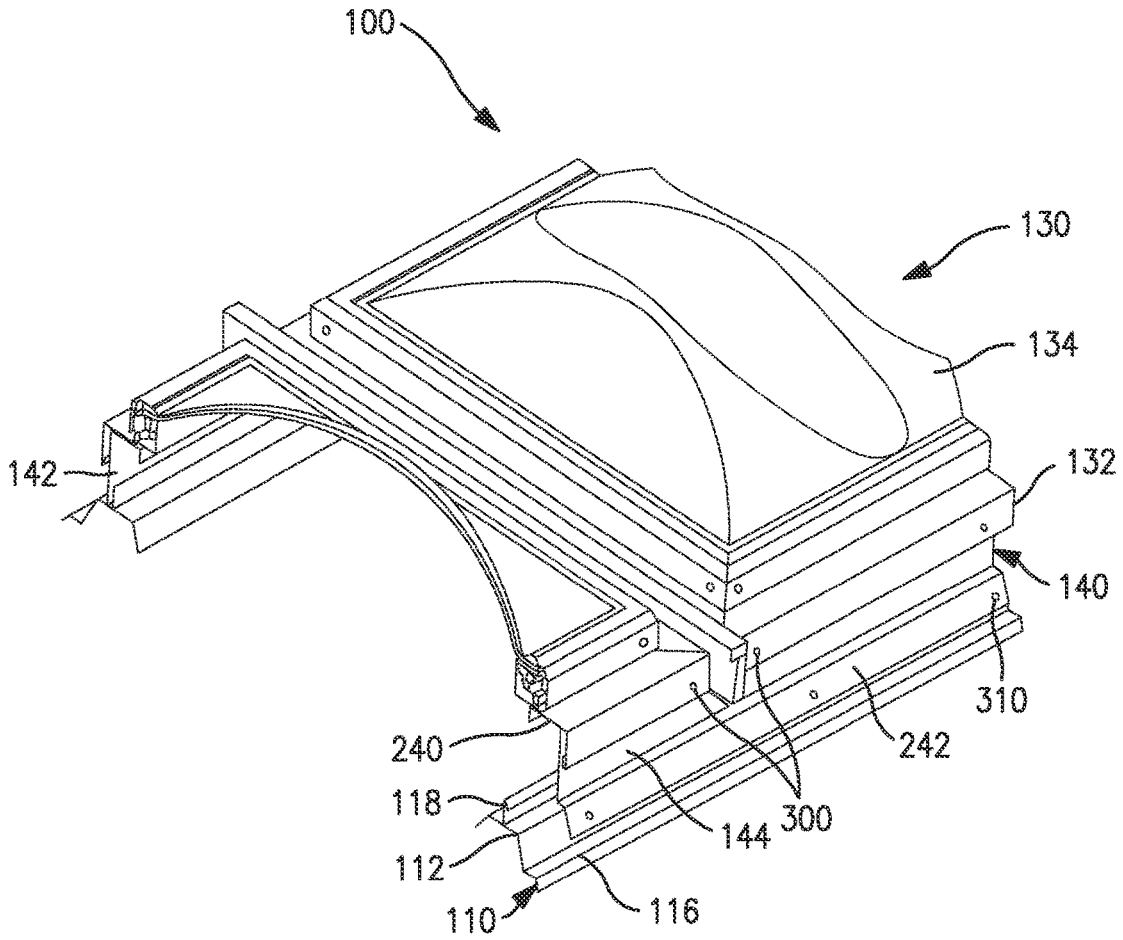
FIG. 22 is a perspective view, partially cut away, showing an end joinder between facing ends of adjacent skylight assemblies of the system.
Figure 23:
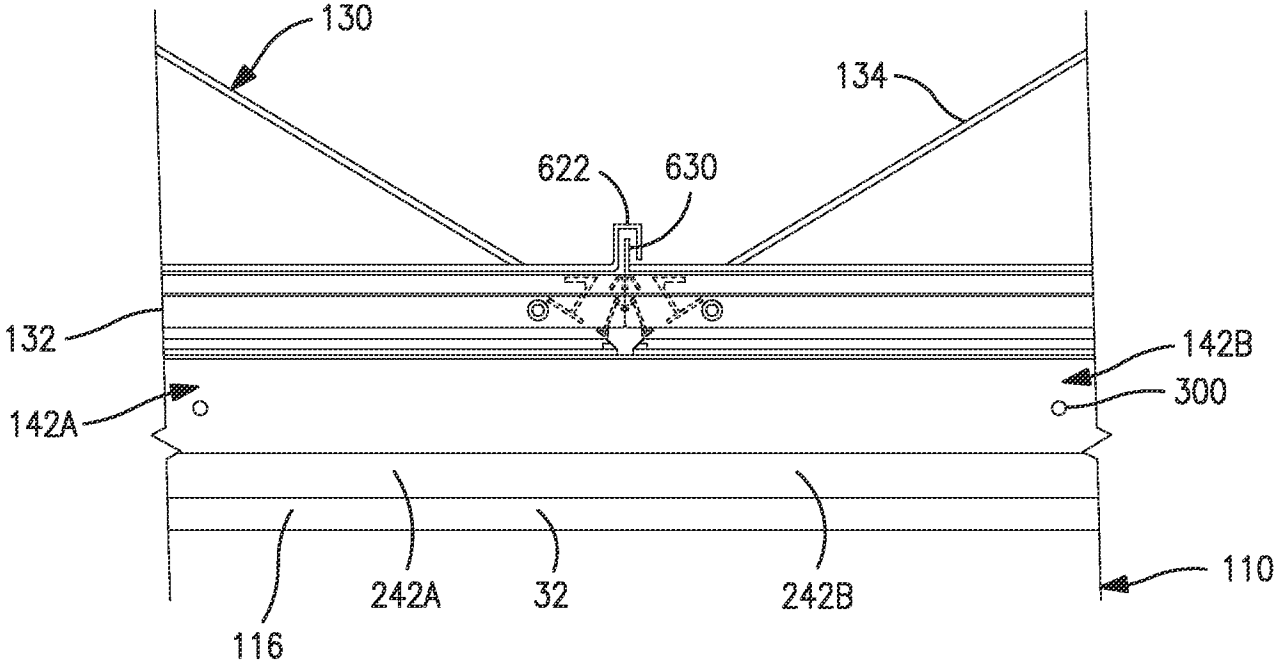
FIG. 23 shows additional detail of the joinder shown in FIG. 22.
Figure 24:
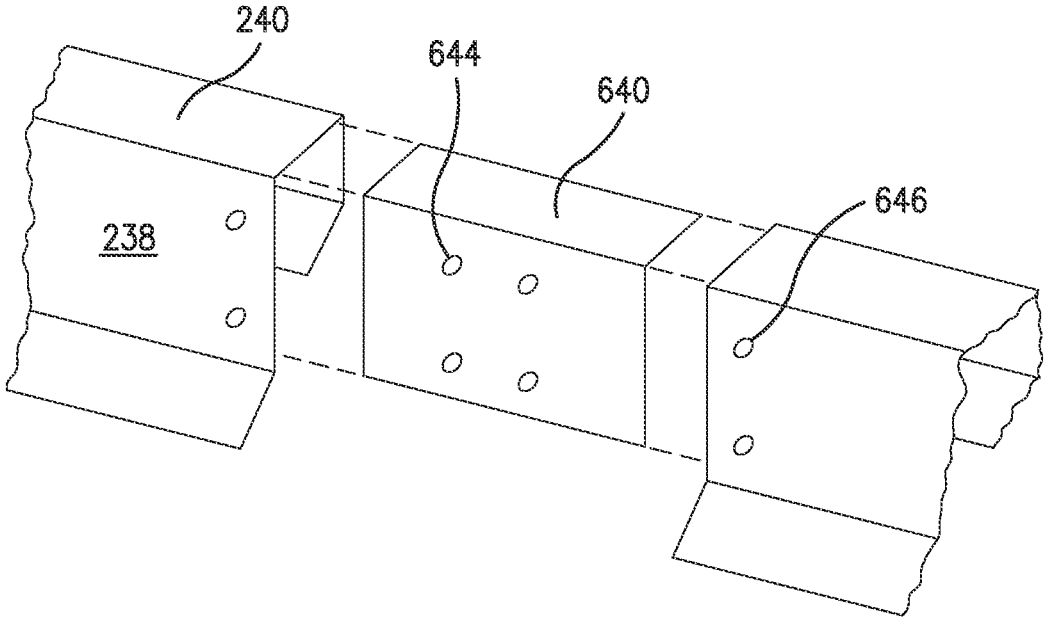
FIG. 24 shows an exploded pictorial view of a rail connector aligned with abutting rail ends and wherein the connector bridges the butt joint between rails which adjoin each other end-to-end, providing both reinforcement of the joint and enhanced sealing of the joint against intrusion of water.

Support structures of the invention are particularly useful for continuous runs of e.g. skylights, where individual skylights are arranged end to end between the ridge and the eave of a roof. FIGS. 22, 23, and 24 show how the ends of two rails can be joined to each other end to end, in a strip of such skylight assemblies and how two adjacent skylights can be mounted to a standing seam panel roof 110 using a skylight and the rail mounting system in accordance with the invention. Instead of using upper end diverters and lower end closures at each end of each skylight assembly, in the skylight strip embodiments illustrated in FIGS. 22 and 23, each skylight frame 132 has a female end having an upstanding, downwardly opening, female member 622, typically extending across the full width of the respective end of the skylight frame, and a male end having an upstanding male member 630 extending, optionally intermittently, across the respective end of the skylight frame. End-to-end width of the male member across the width of the skylight frame is less than the width of female member 622 such that the female member of a next adjacent, typically relatively up-slope disposed skylight frame, in a strip of such skylights, can fit over, and completely enclose except for a bottom opening, the male member 630 of the next adjacent skylight frame in the strip as the skylight frames otherwise generally abut each other end to end.

As only one non-limiting example, skylights can be produced in units about 10 feet long, and so connected end to end for as long a strip assembly as is desired or necessary to achieve the desired level of light transmission into the building, with each skylight unit being supported by the primary rib elevations of the panel roof. The lengths of the rib elevations extend along the entire lengths of the side rails of the rail and closure structure, whether one skylight assembly is used, or a number of skylight assemblies are used end to end. No water can enter over the tops of the side rails of the rail mounting system. No water can enter the top end or bottom end of such strip of skylights.

The standing rib elevations are shown underlying and in continuous supporting contact with the side rails, providing continuous underlying support to the rails along the entireties of the lengths of the rails, and respectively along the entireties of the lengths of the skylight assemblies.

In the process of installing the closure support structure, the upper diverter is installed first, after cutting a small portion of opening 249 near the diverter location. Then, after the upper diverter is installed, the remainder of the roof opening is cut in the respective roof panel and the rails are installed. The lower closure is then installed, which completes the process of defining the perimeter bearing surfaces for the support structure, which are to support the perimeter of the collective set of skylight assemblies which overlie opening 249. Insulation 248, as appropriate, is then drawn up through the opening and secured in the cavities in the rails, in the diverter, and in the lower closure. The skylight assemblies are then mounted on the respective bearing surfaces and the ends of the respective skylight assemblies are joined to each other; and the skylight assemblies are secured to the rails. Tube sealant and tape mastic are applied, as appropriate, at the respective stages of the process to achieve leak-free joinders between the respective elements of the closure assembly.

FIG. 24 shows an exploded pictorial view of the ends of first and second rails in abutting relationship at a joinder of such rails, which abutting joinder relationship is also illustrated in part in FIG. 23, the abutting joinder optionally being co-located with first and second skylights being arranged in end-to-end relationship over a single roof opening. Connector 640 is configured to fit closely inside the cavity cross-sections defined by the respective rails, against the upstanding webs 238 and against the rail upper flanges 240. Connector 640 is shown aligned with the abutting rail ends. The connector is inserted into the cavities in the rails, bridging the butt joint between the rails. Apertures 644 in the connector align with apertures 646 in the rails when the ends of the rails are in abutting relationship. Screws or other known aperture-to-aperture fasteners are used to securely fasten connector 640 to both of the rails. Tape mastic and tube caulk are used, as known in the art for water seal closures, to fill the interface between the rail panels and reinforcing connector 640. Connector 640 thus provides both reinforcement of the joint and enhanced seal of the joint against intrusion of water.

Skylight assemblies of the invention can be connected end to end for as long a distance as necessary to completely cover/overlie a roof opening, as each skylight assembly unit is supported by the ribs 32 of the respective roof panel through respective rails 142, 144. The full collective lengths of the respective rails, regardless of the number of skylight assemblies which are used to close off a given opening in the roof, can extend longitudinally along the standing rib elevations. And except for the skylight assemblies on either end of a run of skylights, the entirety of the weight of the skylight assembly passes through the respective rib and thence to the underlying building support structure. Minor portions of the weight of the skylight assembly may pass through the panel flat at the upper and lower ends of the rail and closure structure.

Water cannot enter over the tops of the rails because of the sealant at 330 at the rails, at diverter 146, and at closure 150. Water cannot enter at the upper diverter at the uppermost skylight assembly because of the seal properties provided by the upper diverter, by panel stiffener structure 148, and by the respective sealants, as well as because the diversion of water away from the upper end of the strip of skylights through gap 122 prevents any substantial quantity of water from standing on a panel 10 against upper diverter 146 for any extended period of time. Water cannot enter at the lower end of the strip of skylights because of the seal properties provided by the lower closure and by the sealants between the lower closure and the respective roof panel. Water cannot enter between the ends of the skylight subassemblies because of the tortuous path through the interface between ends 622 and 630 in combination with the sealants applied at such end-to-end interface.

FIGS. 25-36 illustrate additional embodiments of the invention.

Figure 25:
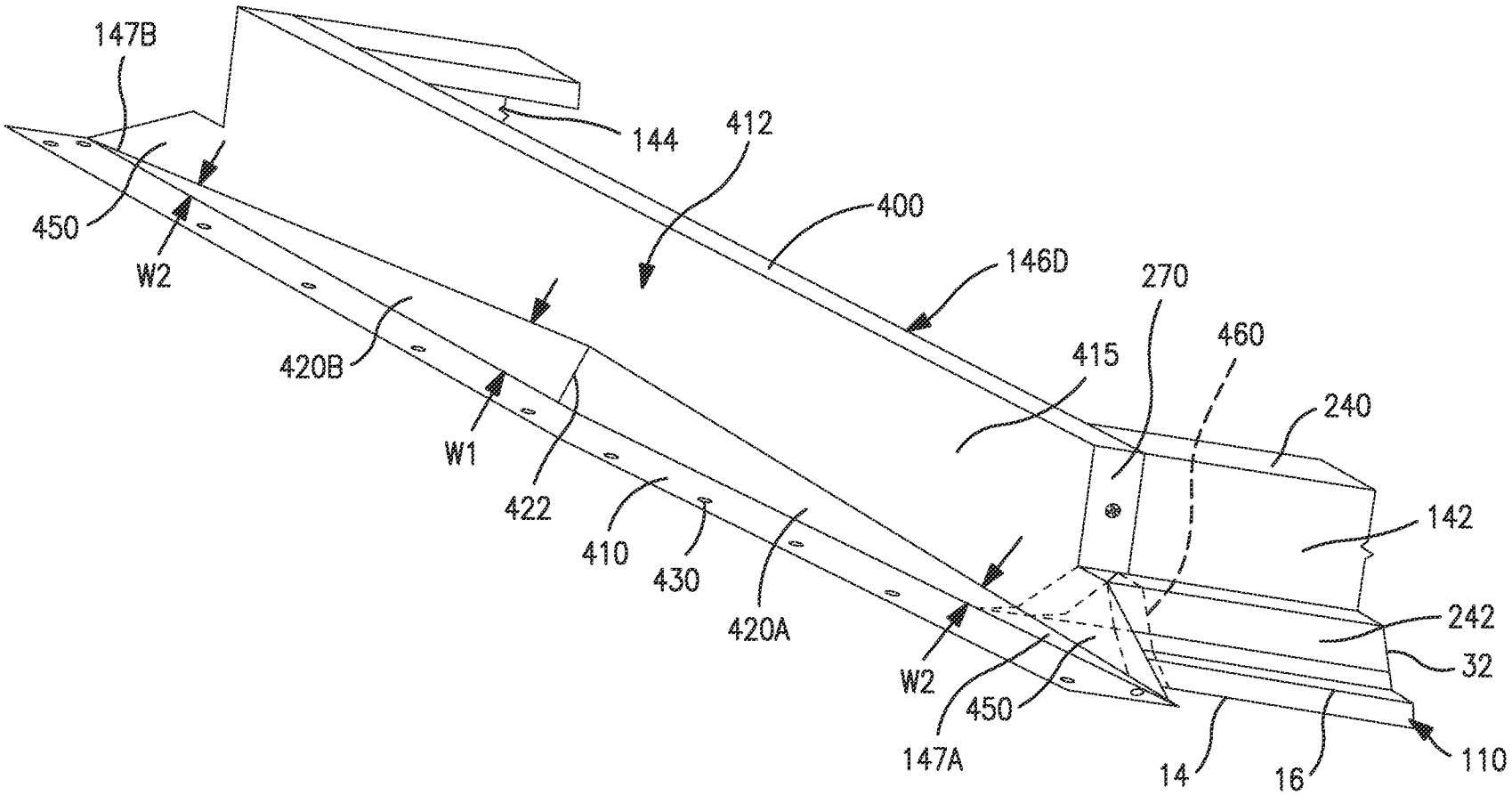
FIG. 25 is a perspective view of a second embodiment of the upper diverter, namely a 2-way diverter which diverts water in first and second opposing directions around the respective load support structure.
Figure 26:
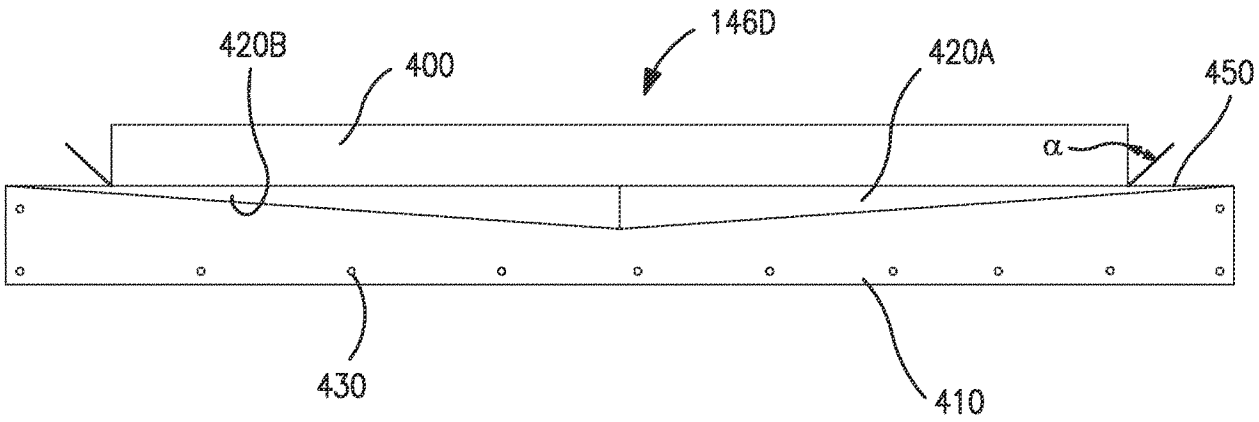
FIG. 26 is a top view of the 2-way diverter illustrated in FIG. 25.
Figure 27:
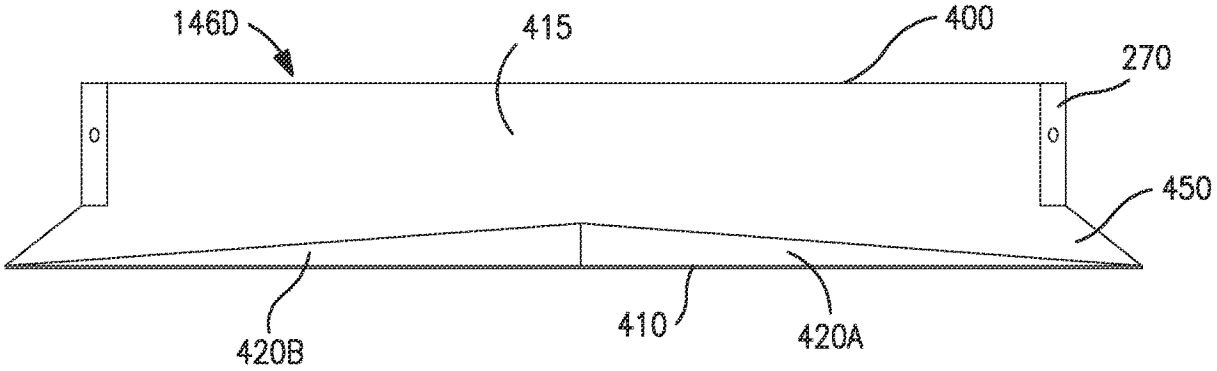
FIG. 27 is a front/elevation view of the 2-way diverter illustrated in FIGS. 25 and 26.

FIGS. 25-29 illustrate an embodiment wherein a 2-way upper diverter 1468D diverts water in opposing lateral directions through first and second rib gaps 122A, 122B, through both of the next adjacent ribs to which support structure 100 is mounted, and onto the roof panels on both sides of the support structure. Referring to FIGS. 25-27, diverter 146D has an upper flange 400, a lower flange 410, and an end panel 412. End panel 412 includes an upstanding upper web 415, and first and second diversion panels 420A and 420B.

Figure 28:
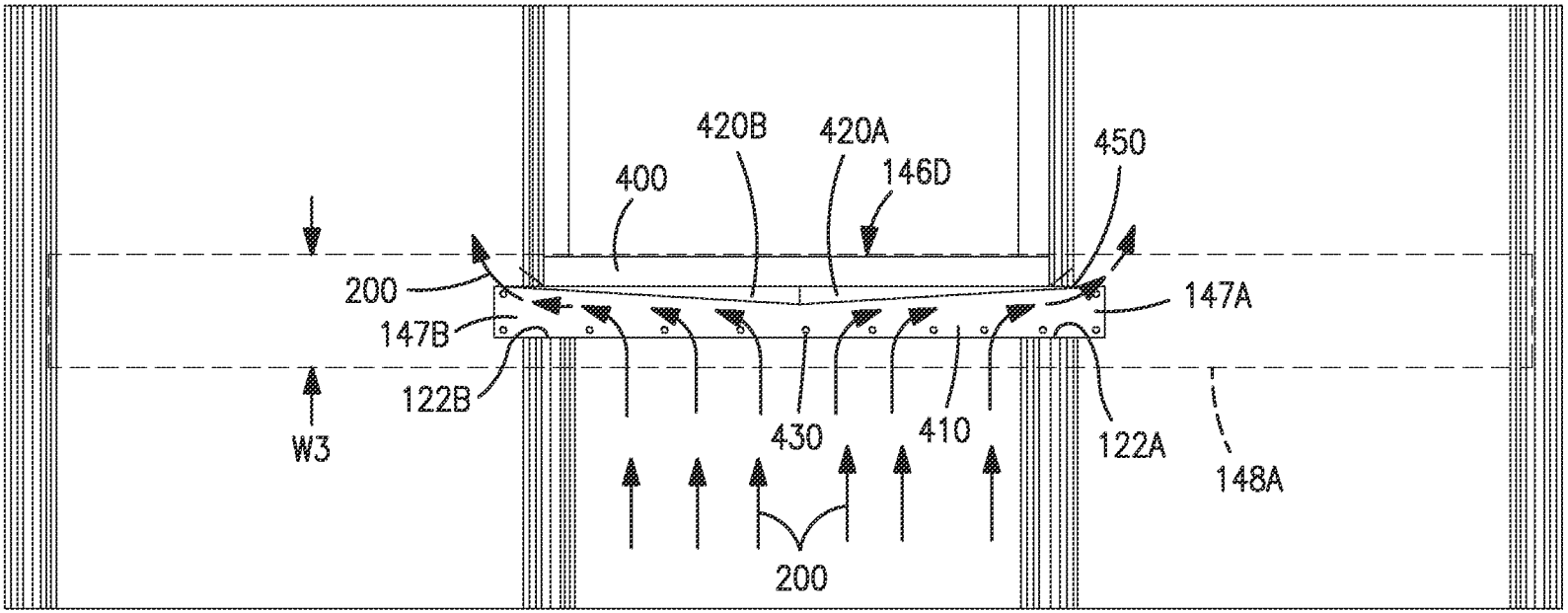
FIG. 28 is a top view of the 2-way diverter illustrated in FIGS. 25-27, shown installed on a roof, with a panel stiffener underlying the diverter, extending from a first rib next adjacent one of the ribs through which the diverter extends, extending underneath the respective roof panels and under the diverter, to the next adjacent one of the ribs on the opposing side of the diverter.

Each diversion panel stands generally upright while, without limitation, defining a first obtuse angle with lower flange 410 and a second obtuse angle with upper web 415, whereby an imaginary extension of upper web 415 defines a generally perpendicular angle with lower flange 410. As illustrated, diversion panels 420A, 420B meet at an upright dividing line 422 in end panel 412, midway between rails 142, 144. Each diversion panel 420A, 420B thus has a relatively greater width illustrated as width "W1", and thus generally a greater height, at a generally central location midway between rails 142, 144; and a generally decreasing width, illustrated by width "W2", and generally lesser height, both width and height approaching nil dimensions, as the respective diversion panels approach rib gaps 122A, 122B (FIG. 28). Lateral legs 147A, 147B of the respective diversion panels extend through the rib gaps, extending onto, and over, the panel flats of the next adjacent roof panels, while upper portions of end panel 412 extend to, but not across, the respective ribs; and wherein lateral legs 147 extend beyond certain elements of upper portions of end panel 412. Diversion panels 420A, 420B thus divert water toward and through gaps 122A, 122B and onto the next adjacent roof panels while upper portions of upper web 415 are generally confined to the width of a panel from standing seam to standing seam between next adjacent ones of the ribs, across a single panel flat.

Figure 29:
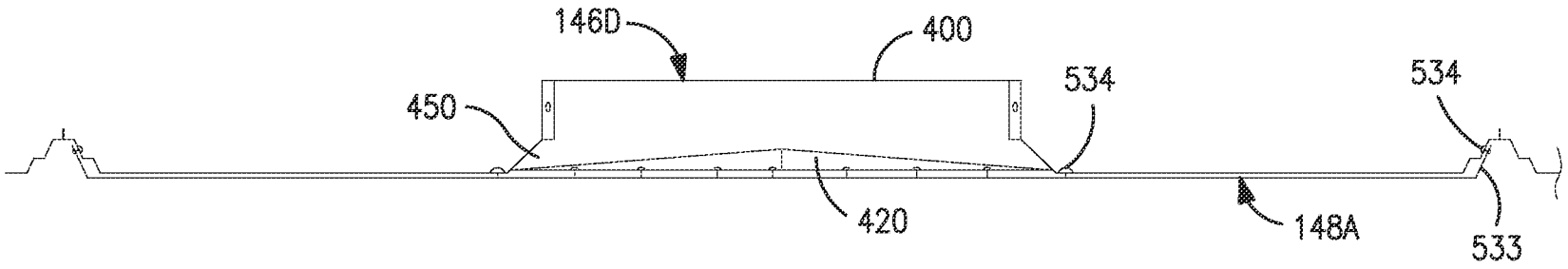
FIG. 29 is a front elevation view of the diverter installation of FIG. 28.

FIGS. 28 and 29 illustrate use of diverter 146D on a sloping metal panel roof. Panel stiffener 148A underlies diverter 146D. The width "W3" of panel stiffener 148A extends both up-slope and down-slope of the roof, relative to lower flange 410. The combination of the up-slope and down-slope extensions can at least equal the width dimension of lower flange 410 where such lower flange width is defined at the locus where lateral legs 147 extend through gaps 122A, 122B. Panel stiffener 148A thus underlies and provides vertical support to portions of the ribs 32 which support both sides of support structure 100 at rails 142, 144. Such support underlies both ribs which support rails 142, 144, in each case both up-slope and down-slope from the respective gap 122.

In addition, panel stiffener 148A extends entirely across the widths of the panel flats of the next adjacent roof panels, extending to the uncut ribs at the opposing sides of such next adjacent panel flats. Respective portions of the lengths of the panel flats of the next adjacent roof panels thus overlie the respective lengths of panel stiffener 148A such that the panel stiffener generally interfaces with the panel flats of the next adjacent roof panels.

Legs 533 on panel stiffener 148A extend upwardly at the uncut next adjacent ribs on the next adjacent roof panels, matching the upstanding direction of at least one upwardly-extending panel of the respective rib 32. Self-drilling screws, or rivets, or other fasteners 534 extend through holes 430, through the respective facing portion of the roof panel, and into panel stiffener 148A. Panel stiffener 148A acts as a nut for the respective screws 534, whereby the screws/fasteners can firmly secure the lower flange to the roof panel. Additional screws/fasteners 534 also secure panel stiffener 148A to the next adjacent ribs 32 at upstanding legs 533. Panel stiffener 148A thus provides vertical support to upper diverter 146D adjacent opening 249, and also provides lateral support to lower flange 410 through the attachments of legs 533 to the next adjacent, uncut ribs across the panel flats from upper diverter 146D. Still further, panel stiffener 148A provides a foundation for bringing together lower flange 410, panel flat 14, and the panel stiffener in face-to-face relationships where the lower flange, the panel flat 14, and the panel stiffener are sufficiently tightly drawn to each other that a waterproof seal is provided, preventing water leakage into the enclosed space at the opening, or directly into the building, at the lower flange.

Figure 30:
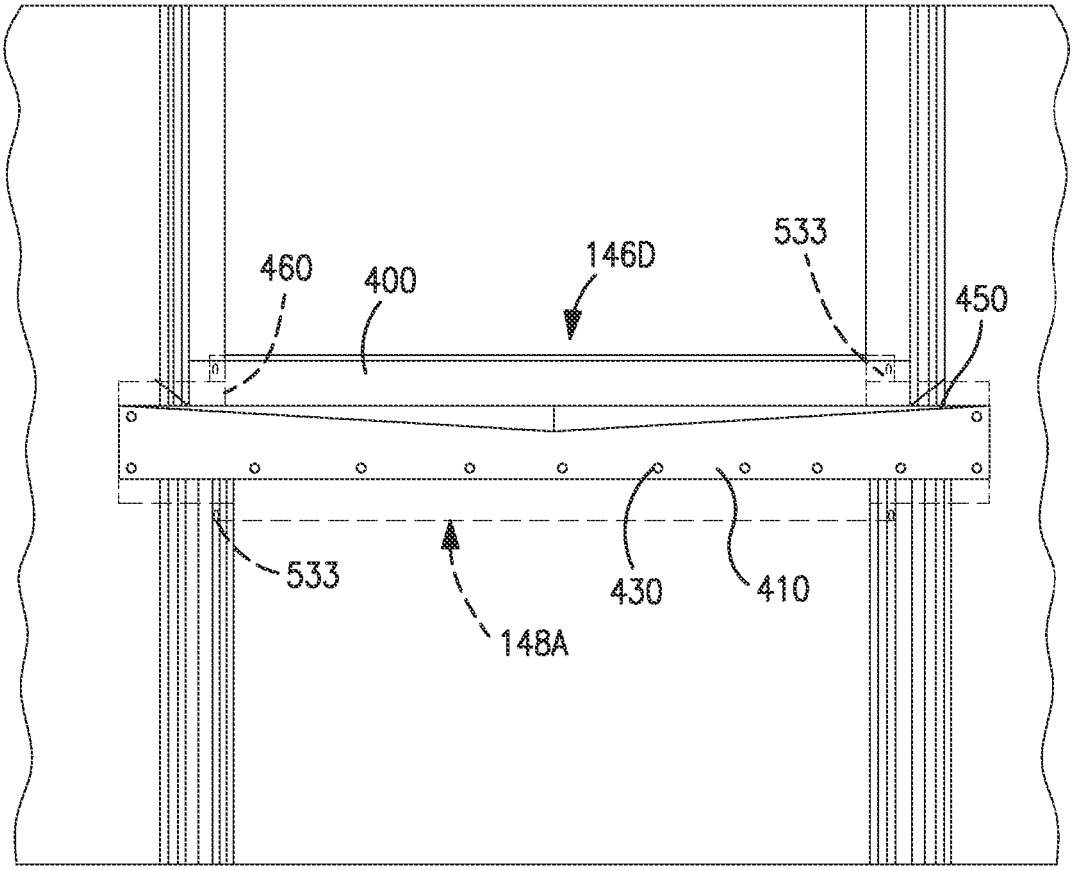
FIG. 30 is a top view of the 2-way diverter illustrated in FIGS. 25-29, shown installed on a roof, with a panel stiffener underlying the diverter and having a length confined generally to and between the two ribs through which the diverter extends.

FIG. 30 illustrates use of the same diverter 1460 as in FIGS. 28-29, but with a shortened panel stiffener 148A. In the embodiment of FIG. 30, at portions of the width of panel stiffener 148A which underlie the uncut portions of ribs 32, both up-slope and down-slope of gaps 122A, 122B, legs 533 extend up, matching the profile direction of at least one upwardly-extending panel of the respective rib 32, and screws or other mechanical fasteners 534 secure the upstanding legs 533 to such upstanding portions of the ribs. Accordingly, in the embodiments represented by FIG. 30, the stiffness and rigidity of panel stiffener 148A is sufficient to provide the vertical and lateral support needed to stabilize the upper diverter 146D relative to the roof panels and to the rails, as well as to replace strength lost by cutting away portions of the ribs in making gaps 122A, 122B. Those skilled in the art will recognize the thickness and/or width differences in panel stiffener 148A as used in FIG. 30 to attach to the cut ribs, versus the relatively longer panel stiffener 148A which can be used in FIGS. 28-29 and which attach to the next-adjacent, outlying uncut ribs.

Figure 30A:
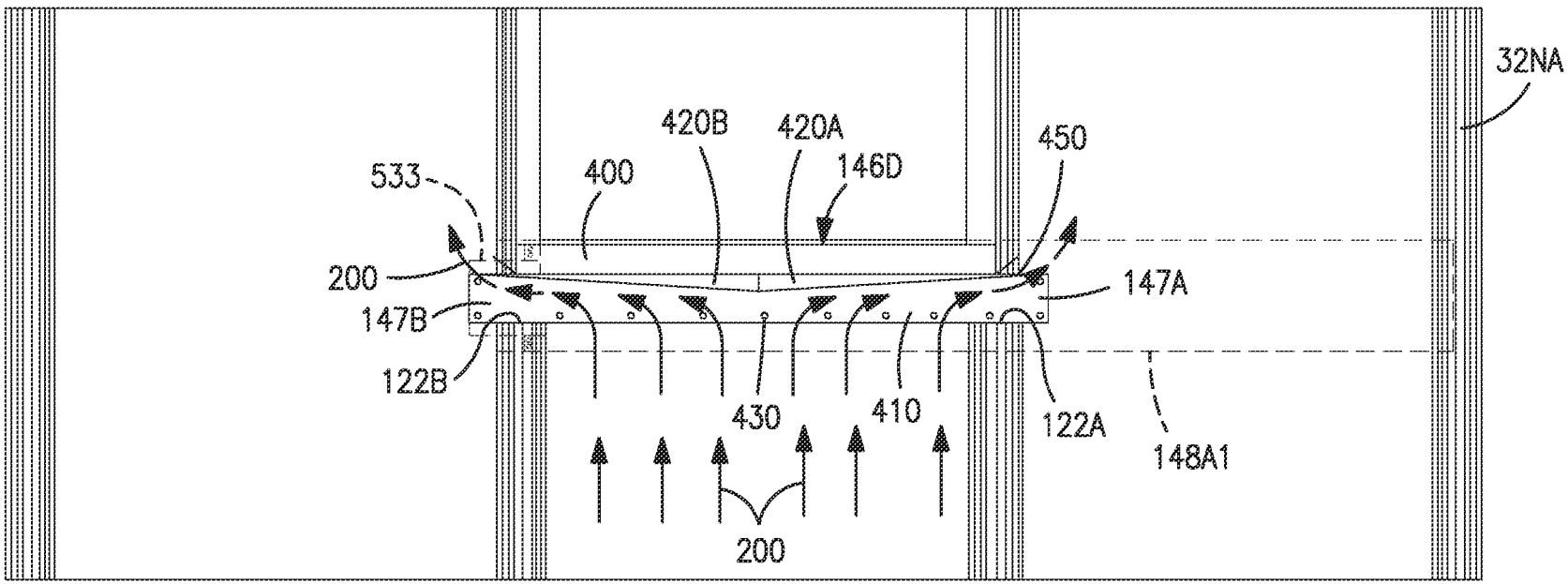
FIG. 30A shows a top view of a 2-way diverter as in FIG. 30 except that the panel stiffener ends on one side at the end of the lower flange and, on the other side, extends to the next-adjacent rib beyond the diversion gap.

FIG. 30A illustrates use of the same diverter 146D as in FIGS. 28-30, but with a panel stiffener 148A1 of intermediate length. In the embodiment of FIG. 30A, at a portion of the width of the panel stiffener which underlies the uncut portion of the rib on the left side of the diverter, both up-slope and down-slope of gap 1228, legs 533 extend up, matching the profile direction of at least one upwardly-extending panel of the respective rib 32, and screws or other mechanical fasteners 534 secure the upstanding legs 533 to such upstanding portions of the rib. On the opposing, right side, of the diverter, panel stiffener 148A1 extends beyond the end of the lower flange, to the next adjacent rib 32NA across the panel flat from the diverter. Those skilled in the art will recognize the thickness and/or width differences in panel stiffener 148A1 as used in FIG. 30A to attach to the respective ribs, versus the relatively longer panel stiffener 148A which is used in FIGS. 28-29.

Referring now to FIGS. 15 and 30, the panel stiffener can be designed such that, at the gap end of the stiffener, the stiffener is wide enough to accommodate upstanding legs 533 on the panel stiffener at the end of panel stiffener 148 or 148A which underlies rib plugs 460. Such legs 533 are disposed up-slope of the relatively up-slope rib plug and down-slope of the relatively down-slope rib plug.

Rails 142, 144, upper diverter 146, 146D, and lower closure 150 are typically made of metal. Given the thermal conductivity of metals commonly used in building structures, such metal elements of support structures 100 have the potential capability to conduct cold and/or heat through the support structure elements, to the inner surfaces of the support structure. Such conduction affects the thermal space heating and/or space cooling needs of the interior of the respective building. In addition, the conduction of cold, from the outside environment to the interior of the building potentially lowers the temperature of the inside surfaces of support structure 100. Such conduction of cold may lower the temperatures of such inside surfaces enough to cause moisture from the air inside the building to condense onto such cooled inside surfaces, which can result in dripping of such condensed moisture onto building contents below. Such condensation can thus be deleterious to the building structure and/or to the contents of the building.

While the thermal insulation illustrated, such as in FIG. 13, protects lower portions of the support structure from thermal conduction, such as at webs 238, end panel 412, and closure web 520, a cold-conducting path remains potentially available in the embodiment of e.g. FIG. 13, at upper flanges 240, 400 and 536, optionally at the inside panels downwardly depending from such upper flanges.

FIGS. 31-35 illustrate a variety of thermal break structures 650 which can be employed with rails 142, 144, upper diverter 146, 146D, and lower closure 150. Such thermal break structures all represent elongate linings which extend the full lengths of the respective rail, diverter, or lower closure, and function in addition to any thermal break properties of any other structure such as rod 268 or other thermal insulation which is disposed in cavity 264. Such linings are contemplated to be polymeric extrusions which, by virtue of the extrusion processes by which such linings are made, have constant, or substantially constant, profiles for the full lengths of such linings. A given such lining extends the full lengths of each of the rails 142, 144, diverter, 146, and lower closure 150.

Figure 31:
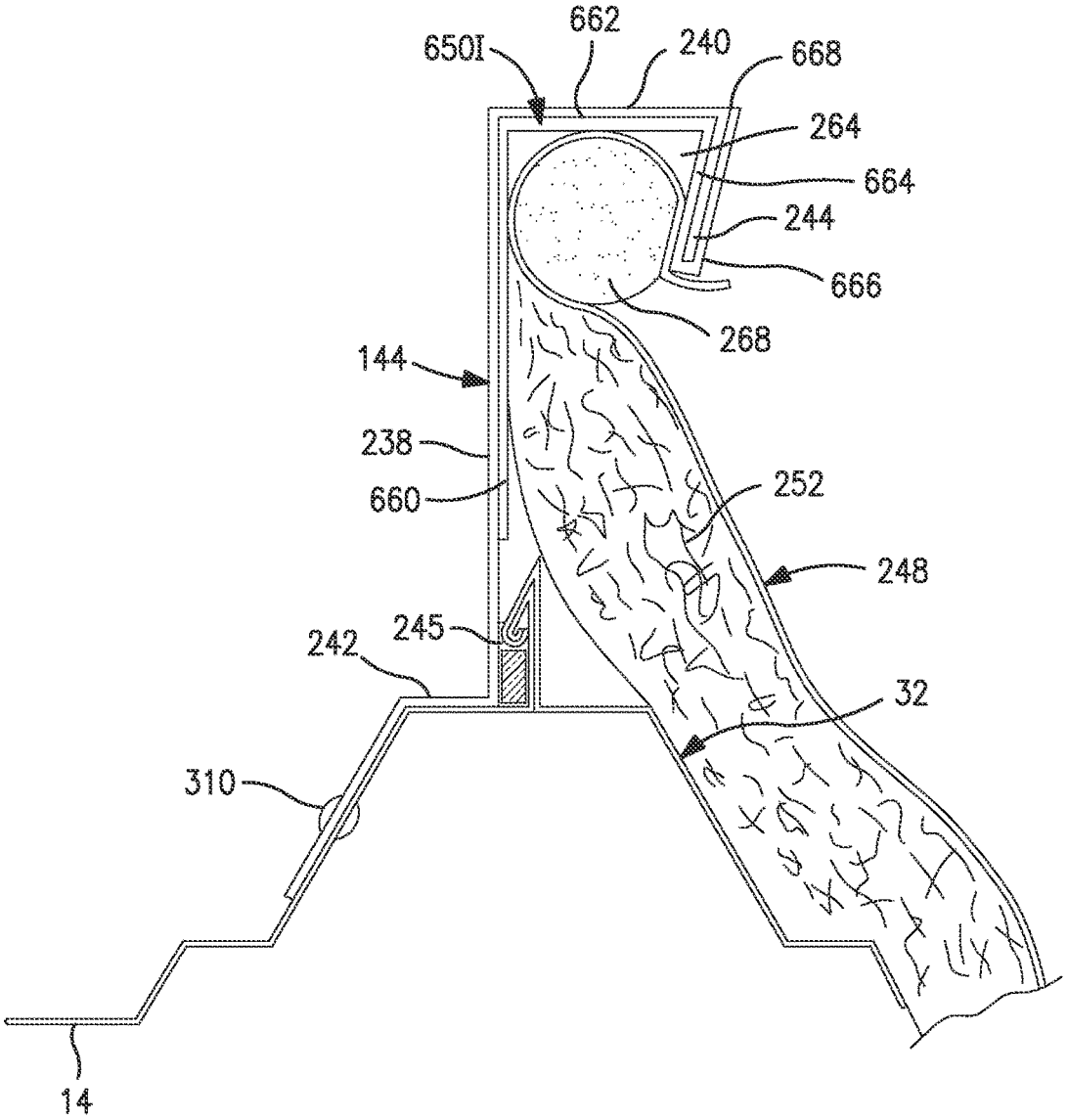
FIG. 31 shows an enlarged end view of a rail mounted on a rib, where the insulation has been lifted into the opening and its vapor barrier layer is being held in the cavity by a retainer rod, and where a thermal break has been installed on the inside surface of the upper portion of the rail.

FIG. 31 illustrates the profile of a first thermal break structure 650I, lining the inner surface of rail 144. Thermal break structure 650I has a first web leg 660 in surface-to-surface contact with the inner surface of upstanding web 238, over about 75% of the upper portion of the web. Break structure 650I extends from web leg 660 across the lower surface of upper flange 240 as flange leg 662, thence down along the inside surface of inside panel 244 as panel leg 664, about the distal edge of inside panel 244 and up the outside surface of inside panel 244 as outside panel leg 666, and terminates at the upper surface of upper flange 240, the end of the break structure 650I optionally terminating as an extension of the upper surface of flange 240.

Cold which passes through web 238 by conduction is stopped either by insulation batt material 252 or by leg 660 of the thermal break. Cold conducted through upper flange 240, optionally through inside panel 244, is stopped by the respective legs 662, 664, and/or 666. Cold which reaches the joinder between upper flange 240 and inside panel 244 is stopped by the upper edge of leg 666.

While thermal space heating efficiency is a consideration, the primary issue being addressed by thermal break structure 650 is to maintain the temperature of all surfaces of the controlled-temperature space at the opening sufficiently warm as to prevent condensation of moisture on the exposed surfaces of the support structure. Thus even though unfoamed plastic extrusions, as used for thermal break structures 650, are not generally considered to be effective thermal insulators, compared to fiberglass batt material or foamed plastics, the thermal properties of many polymer compositions are sufficient to block enough of the thermal conduction that condensation can be avoided.

Addressing space heating loss relative to the embodiment of FIG. 31, insulation layer 248 protects against major heat loss up through opening 249 and upwardly to rod 260. Rod 260 protects against major heat loss through cavity 264. The upper end of thermal break leg 666 serves as an extension of the corner 668 defined by the joinder of upper flange 240 and inside panel 244, thus providing at least nominal protection from heat loss through upper flange 240.

Addressing condensation prevention, the thermal protection provided by insulation 248 and rod 260 is in excess of that needed to prevent condensation while being effective to control thermal temperature-control requirements. Given the inventors' recognition that condensation is a potential issue at corner 668, by conduction of cold through upper flange 240, thermal protection against such condensation is provided by configuring thermal break 650 to cover the inside surface of inside panel 244, facing opening 249, at corner 668, and by engineering the thermal properties of thermal break 650 so as to prevent condensation at the temperature differential and humidities expected to exist in the particular skylight or other application of the invention.

Figure 32:
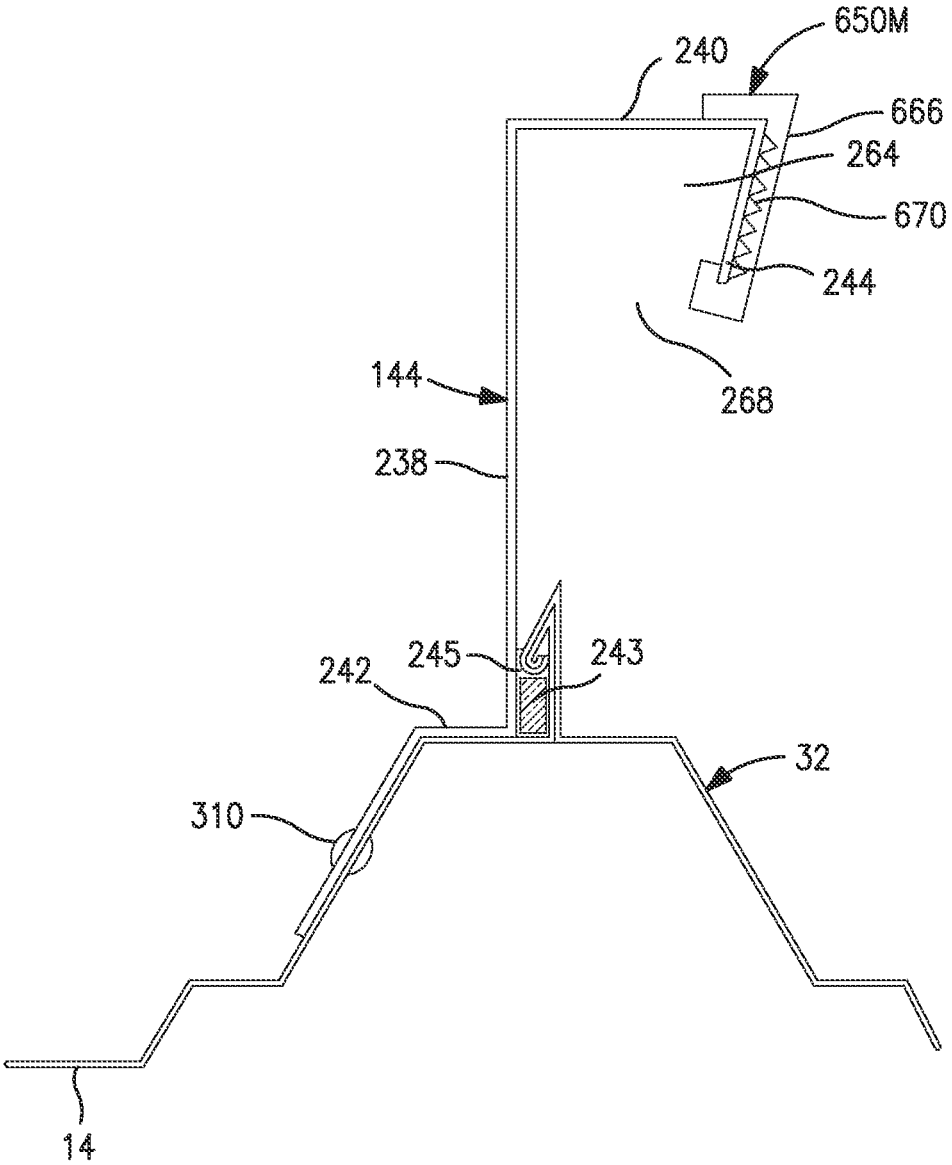
FIG. 32 shows an enlarged end view of a rail mounted on a rib as in FIG. 31, but not showing the underlying insulation, and where a serrated thermal break is installed on the outside surface of the inside panel of the rail.

FIG. 32 illustrates the structure of a minimalistic thermal break profile 650M. Profile 650M has a leg 666 which covers the outer surface of inside panel 244. Profile 650M extends about the distal edge of panel 244 and extends a short distance up the inside surface of inside panel 244. Profile 650M also extends a short distance across upper flange 240. The inventors herein contemplate that the area of the support structure most susceptible to formation of condensation is inside panel 244. Thus, profile 650M is limited to providing a thermal break at panel 244. The end portions of profile 650M, which extend up the inside surface of inside panel 244 and a short distance across upper flange 240 are used to provide mechanical securement of the thermal break to the rail, upper diverter, or lower closure, as applies, while the upper end portion is thin enough to readily accommodate mounting of the skylight assembly at flange 240.

FIG. 32 illustrates elongate serrations 670 on leg 666, which may be formed during the process of extruding leg 686, or may be subsequently formed, e.g. stamped, into the respective surface in any desired surface patter. A given serration 670 extends the length of the thermal break. Multiple serrations are disposed across the width of the thermal break, and thus the multiple serrations collectively extend across the height of the outer surface of inside panel 244 and can extend onto that portion of profile 650M which overlies panel 240. Serrations 670 are greater in irregularity than common surface imperfections in extruded thermoforming polymers. Thus, serrations 670 space those respective surfaces of the serrations which are farthest from the cavity structure surfaces by distances of at least 0.002 inch, optionally at 0.005 inch, further optionally at least 0.010 inch, at least 0.020 inch, up to about 0.040 inch.

The inventors contemplate that the dead air space in the serrations adds to the thermal efficiency of the thermal break. In some embodiments, the serrations are spaced from the top and bottom of inside panel 244 in recognition of stresses which may be concentrated at such locations, combined with respective strength requirements at such locations.

Figure 33:
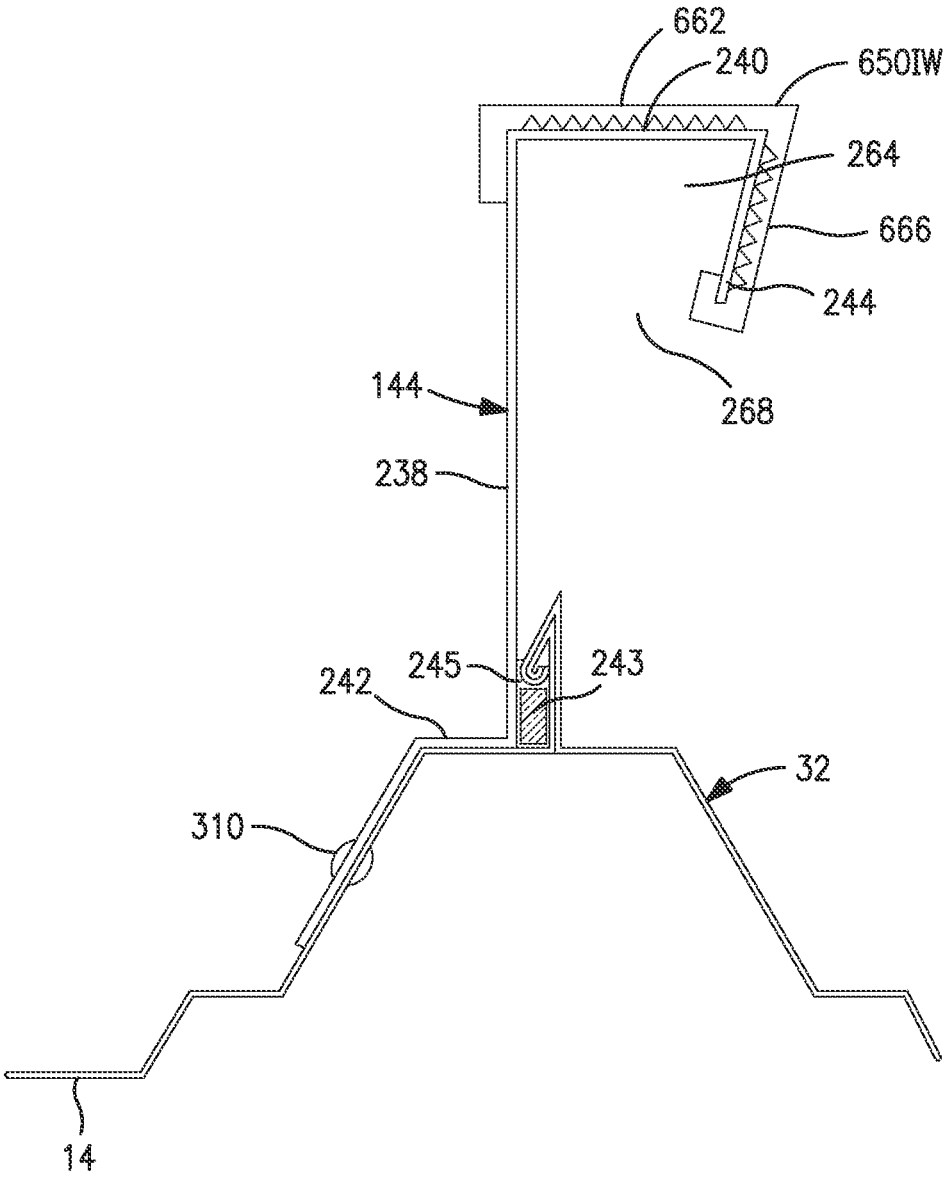
FIG. 33 shows an enlarged end view of a rail mounted on a rib as in FIG. 32, but where the serrated thermal break extends across the outside surface of both the inside panel and the upper flange.

FIG. 33 illustrates the structure of an intermediate-width thermal break profile 650IW. Profile 650IW has a leg 666 which covers the outer surface of inside panel 244. Profile 650IW extends about the distal edge of panel 244 and extends a short distance up the inside surface of inside panel 244. Profile 650IW also extends across upper flange 240, as leg 662 and a short distance down web 238. This intermediate-width thermal break provides additional thermal break protection against conduction through upper flange 240. As with the embodiment of FIG. 32, the areas of the support structure away from the corners are serrated. The end portions of profile 650IW, which extend up the inside surface of inside panel 244 and a short distance down web 238 are used to provide mechanical securement of the thermal break to the rail, diverter, or closure.

FIG. 33 also illustrates elongate serrations 670 on legs 662 and 666, spaced from the profile ends of inside panel 244 and upper flange 240.

Figure 34:
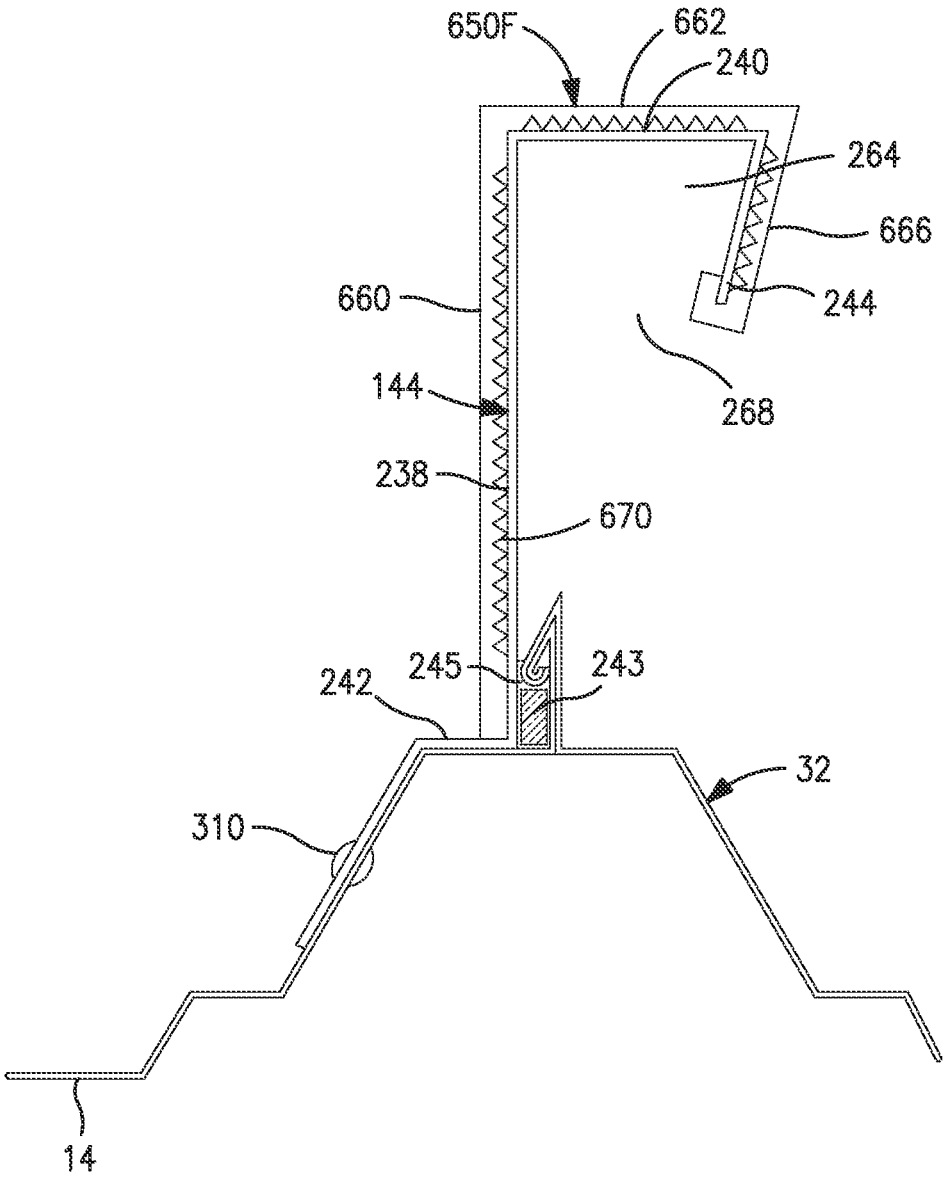
FIG. 34 shows an enlarged end view of a rail mounted on a rib as in FIGS. 32-33, but where the serrated thermal break extends across the outside surface of the inside panel, across the outside surface of the upper flange, and across the outside surface of the upstanding web of the rail, to the bottom of the upstanding web.

FIG. 34 illustrates the structure of a full coverage thermal break profile 650F, which extends over the entirety of the outer surface of rail 144. Profile 650F has a leg 666 which covers the outer surface of inside panel 244, a leg 662 which covers the outer surface of upper flange 240, and a leg 660 which covers the outer surface of web 238. Leg 666 extends about the lower edge of inside panel 244 and a short distance up the inside surface of the inside panel. This full-coverage thermal break provides thermal break protection against conduction through the entirety of the rail profile. Thus, thermal protection from condensation is provided irrespective of whether or not insulation 248 is used, whether or not a rod 260 is used. As with the embodiments of FIGS. 32 and 33, the areas of the support structure away from the corners are serrated. The end portion of profile 650F which extends up the inside surface of inside panel 244 is used to provide mechanical securement of the respective edge of the thermal break to the rail, diverter, or lower closure.

FIG. 34 also illustrates the use of the elongate serrations on legs 666, 662 and 660, spaced from the profile ends of inside panel 244 and upper flange 240, as well as the lower end of leg 660.

Figure 34A:
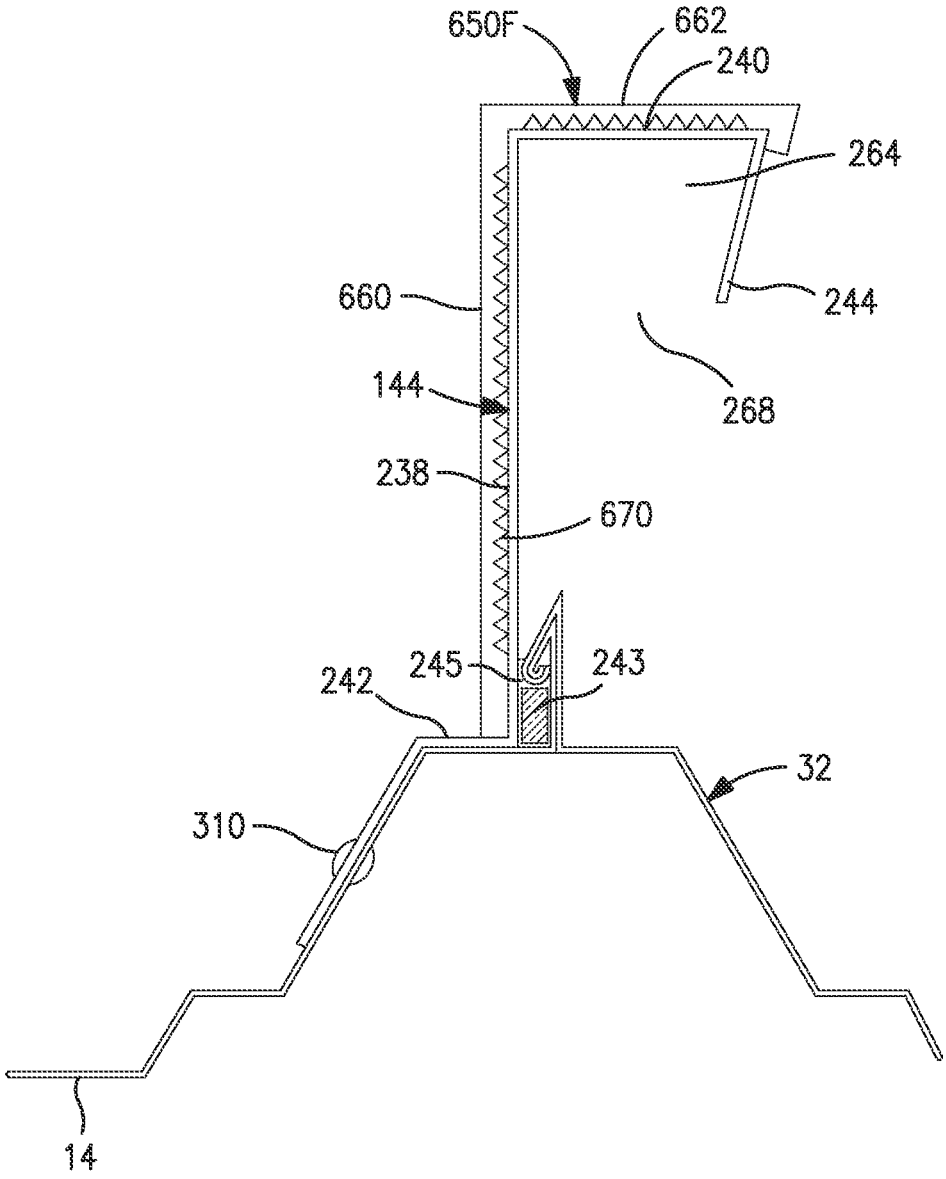
FIG. 34A shows an enlarged end view of a rail mounted on a rib as in FIG. 34 but without full top-to-bottom coverage of the inside panel.

FIG. 34A illustrates the structure of a thermal break profile which extends over the outer surface of rail 144. The profile of thermal break 650F of FIG. 34A has a leg 660 which covers the outer surface of web 238. Leg 662 covers the outer surface of upper flange 240, and extends a short distance down inside panel 244. Given the full outside coverage of web 238 and flange 240, thermal break 650 effectively breaks the thermal impact at inside panel 244 without overlying the entire top-to-bottom height of panel 244.

Figure 35:
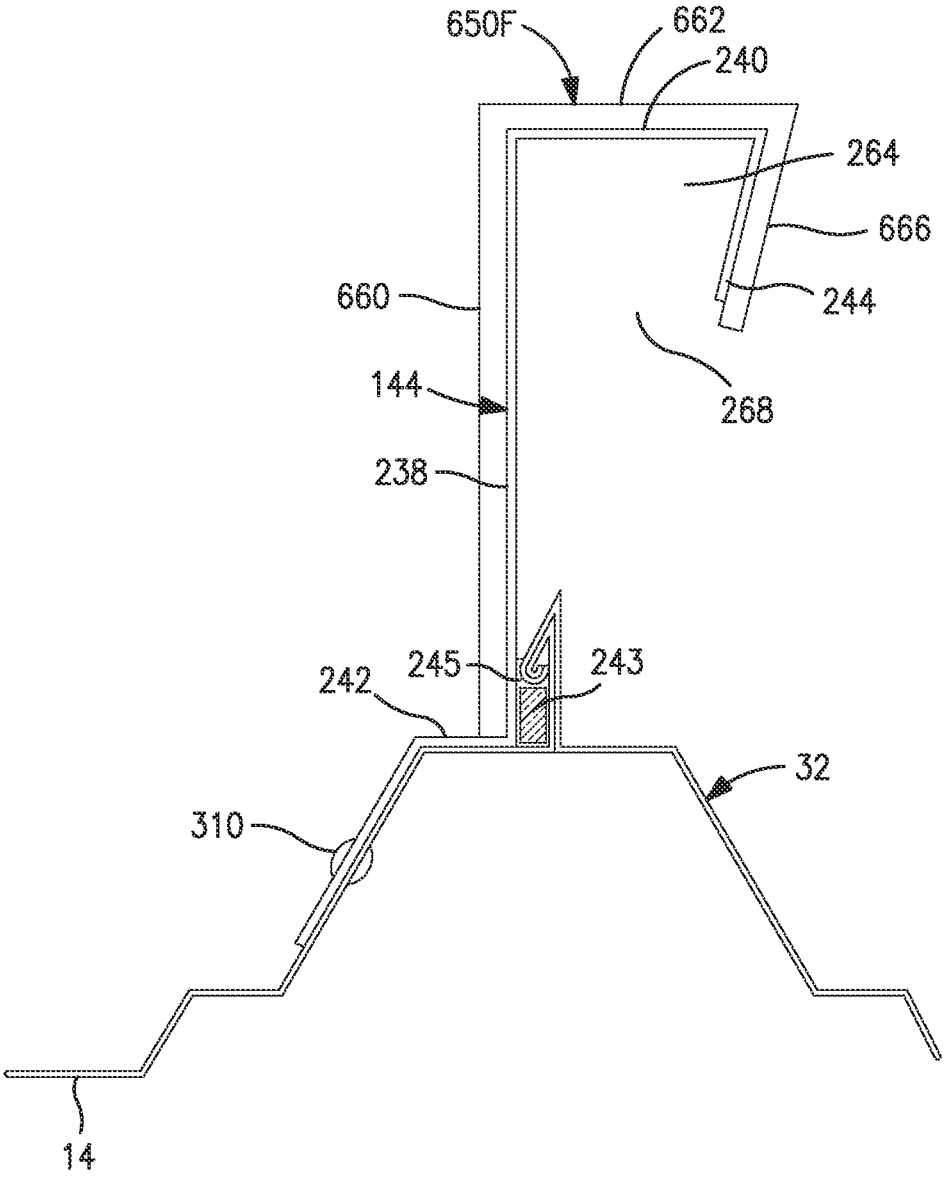
FIG. 35 shows an enlarged end view of a rail mounted on a rib, and a thermal break mounted to the outside surface of the rail as in FIG. 34, but with full top-to-bottom coverage of the inside panel, and where the thermal break is not serrated.

FIG. 35 illustrates the structure of a full coverage thermal break profile 650F as in FIG. 34, which extends over the outer surface of rail 144, but which does not employ serrations, and which does not wrap around the distal end of panel 244.

Considering the embodiments illustrated in FIGS. 31-39, thermal break structure can be deployed on some or all of both the inner surface and the outer surface of rails 142, 144, as well as the upper diverter and the lower closure. Thus, a single break structure can be used to cover some or all of the respective inner and outer surfaces of the rail. In the alternative, a combination of multiple thermal break structures can be used to cover some or all of the respective inner and outer surfaces of the rail. FIG. 31 is instructive regarding use of thermal break structure on the inner surface of the rail, where web leg 660 can optionally be extended to the corresponding upper surface of standing seam 18. FIG. 35 is illustrative of use of thermal break structure on the outer surface of the rail, showing use of the thermal break structure to cover effectively all of the outer surface of the rail, along the full length of the rail which will be exposed to the ambient environment, Where different/multiple thermal break structures cover different portions of the rail profile, edges of the respective thermal break structures can interface with each other so as to avoid thermal leakage at the respective edges or ends. Conventional caulk or tape mastic can be used to fill any voids or gaps in the coverage, as needed for achieving an effective thermal break. Surface irregularities such as serrations can be used on any or all areas of any or all of such thermal break structures which face surfaces of the rails, diverter, or lower closure, whether the thermal break structure is applied to the inner surface of the rail, to the outer surface of the rail, or both.

FIGS. 36-40 illustrate additional embodiments of how rails can be used in support structure 100, along with alternate structures holding thermal break insulation 248 in the opening 249 and alternate methods of insulating e.g. cavity 264, with various thermally insulating/thermal break materials inside the cavity.

Figure 36:
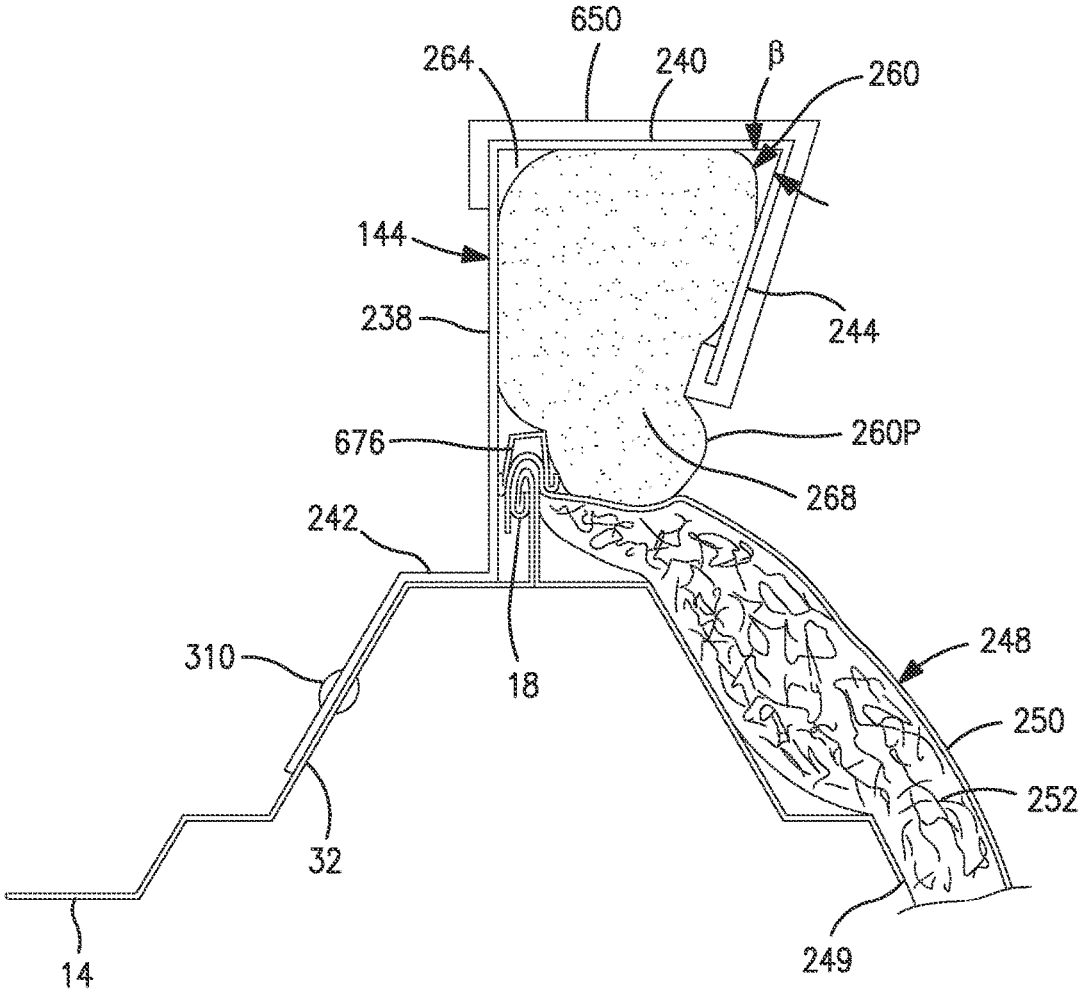
FIG. 36 shows an enlarged end view of a relatively shortened-height rail having an outside thermal break, where the vapor barrier of the lifted insulation is secured to the standing seam with a clip, and the space inside the rail cavity, down to the thermal insulation, is occupied by a thermally-insulating rod.

Referring to FIG. 36, rail 144 has an upstanding web 238, upper flange 240, inside panel 244, and lower shoulder 242. Inside panel 244 extends from upper flange 240 at an acute angle β of about 75 degrees. Rivets 310 are spaced along the length of the rail, mounting the rail to underlying rib 32 above panel flat 14. External thermal break 650 covers inside panel 244 and upper flange 240. Short extensions of the thermal break extend down web 238 and around the distal end of inside panel 244, functioning as retainers holding the thermal break mounted on the rail.

Insulation 248 extends up through opening 249 in the roof and lies against rib 32 up to the top of the rib at standing seam 18. Vapor barrier layer 250 of the insulation extends over the top of the standing seam and down between the standing seam and upstanding web 238 of the rail. The vapor barrier layer is held in place over the standing seam by a plurality of resilient spring clips 676 mounted over the vapor barrier and onto the standing seam, respective such clips being spaced along the length of the rail. A variety of clips and/or clamps, or similar devices can be used in place of the clip illustrated.

The vapor barrier can be installed using at least two different methods. In the first method, shown in FIG. 36, as a given length of the edge of the vapor barrier is inserted about the standing seam, the clips are installed over the vapor barrier layer, thus securing the respective length of the vapor barrier to the standing seam. In the second method, the vapor barrier layer is wrapped about a spring clip and then the spring clip is mounted over the standing seam, with an edge portion of the vapor barrier layer between the spring clip and the standing seam. With either method, a portion of the vapor barrier layer is disposed between the spring clip and the standing seam, and resilient restoration forces on the spring clips continuously apply forces urging the vapor barrier against the standing seam, holding both the vapor barrier and the spring clip securely mounted to the standing seam. The plurality of spring clips spaced along the length of the rail thus stabilize the insulation in position against the rib, about the perimeter of opening 249.

Figure 37:
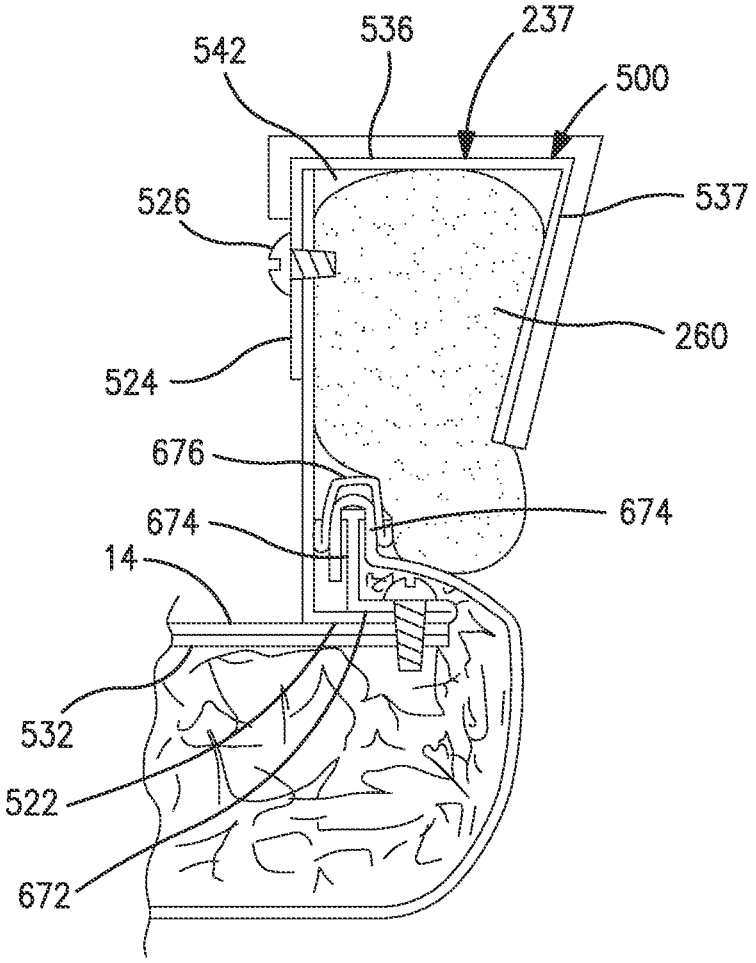
FIG. 37 shows an end view of a relatively shortened-height lower closure where the vapor barrier layer of the lifted insulation is secured to an extension of the lower flange by a spring clip.

At the lower closure, a lower leg of angle bracket 672 overlies the upper surface of the lower flange as illustrated in FIG. 37, and an upper leg 674 extends upwardly, terminating in a "T"-shaped top. Fastener holes 530 extend through both the lower flange and the angle bracket. As with the standing seam, the vapor barrier layer is extended up over the distal upper lip of the lower flange, and spring clips 676 are placed over the vapor barrier layer and dipped to the e.g. "T"-shaped top of the lower flange, thus securing the insulation at the top of the angle bracket.

Figure 38:
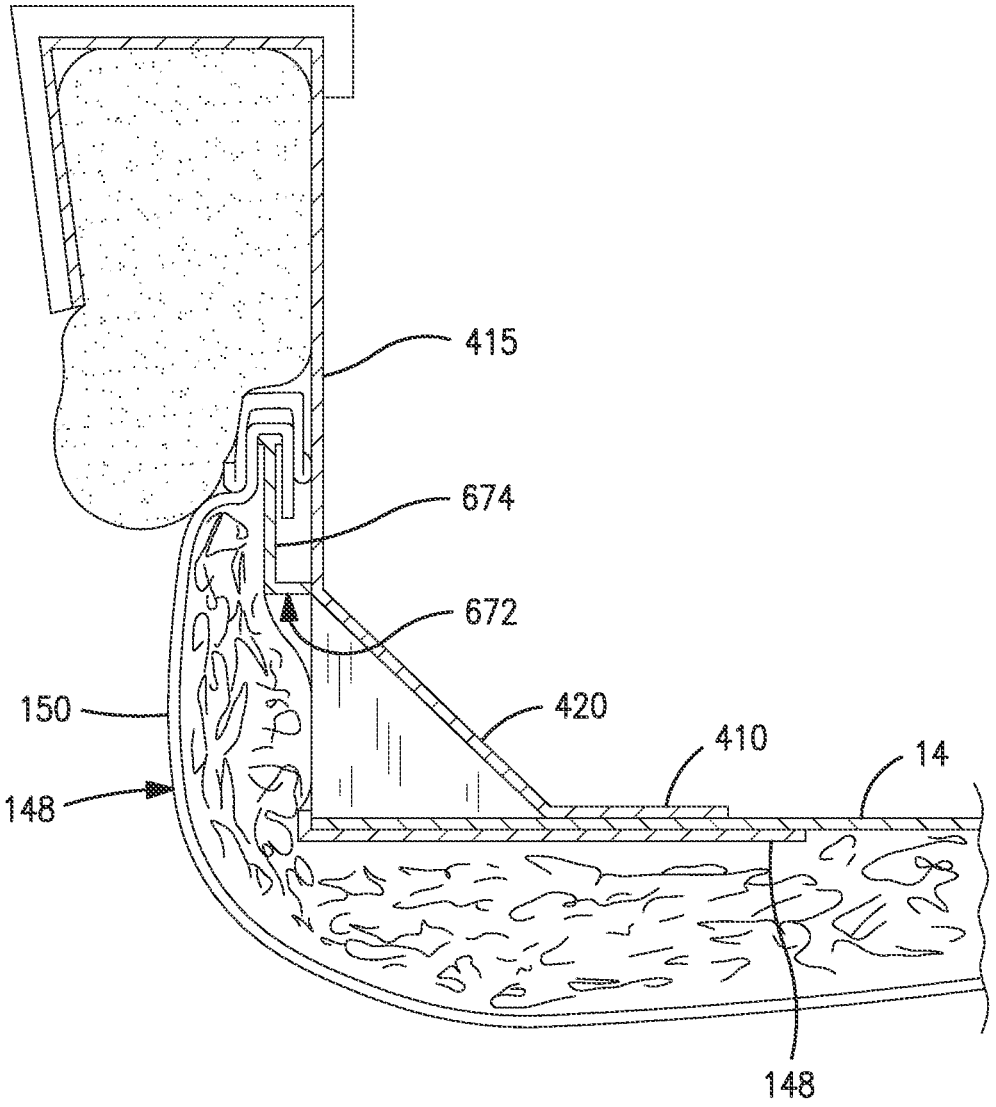
FIG. 38 shows a cross-section of a relatively shortened-height upper diverter where the vapor barrier layer of the lifted insulation is secured to a flange which extends from an extension of the upstanding web.

As illustrated in FIG. 38, at the upper diverter, a similar upstanding angle bracket 672 extends inwardly toward the opening, of upstanding web 415, and upwardly as an upper leg 674 to an e.g. "T"-shaped top portion. Vapor barrier layer 250 is extended up over the "T"-shaped top portion. Spring dips 676 are placed over the vapor barrier layer and clipped to the "T"-shaped top portion 674 of the angle bracket, securing the insulation to the angle bracket at the "T"-shaped top portion, and thus to the upper diverter.

Returning to FIG. 36, with the insulation thus stabilized, an e.g. deformable, compressible rod 260 is inserted into cavity 264 as a second thermal break material influencing the temperatures of the cavity walls. Rod 260, which is resiliently compressible, is compressed as the rod is being inserted through opening 268 into cavity 264. Rod 260 is inserted into cavity 264 far enough that, once the compressed rod is released in the cavity, and the rod expands against the cavity walls, the expanded rod reaches, and interfaces with, at least web 238 and inside panel 244, optionally with upper flange 240. With the rod cross-section thus extending across the full width of the cavity between web 238 and inside panel 244, the frictional engagement of the rod against the inner surfaces of web 238 and inside panel 244, along the tapering, narrowing cross-section of cavity 264, top to bottom, optionally in combination with engagement of the rod with the up-turned end of thermal break 650 at the inside surface of inside panel 244, retains rod 260 in cavity 264, even though a portion 260P of the cross-section of the rod extends outwardly through cavity opening 268.

The outwardly extending portion 260P of the rod extends to, and interfaces with, an upper portion of insulation 248. Thus, the combination of insulation 248 and rod 260 provides thermal break properties extending upwardly between opening 249 and the inner surface of upper flange 240.

Thermal break structure 650 provides at least a portion of the thermal break properties between the inner and outer surfaces of the upper flange.

Figure 39:
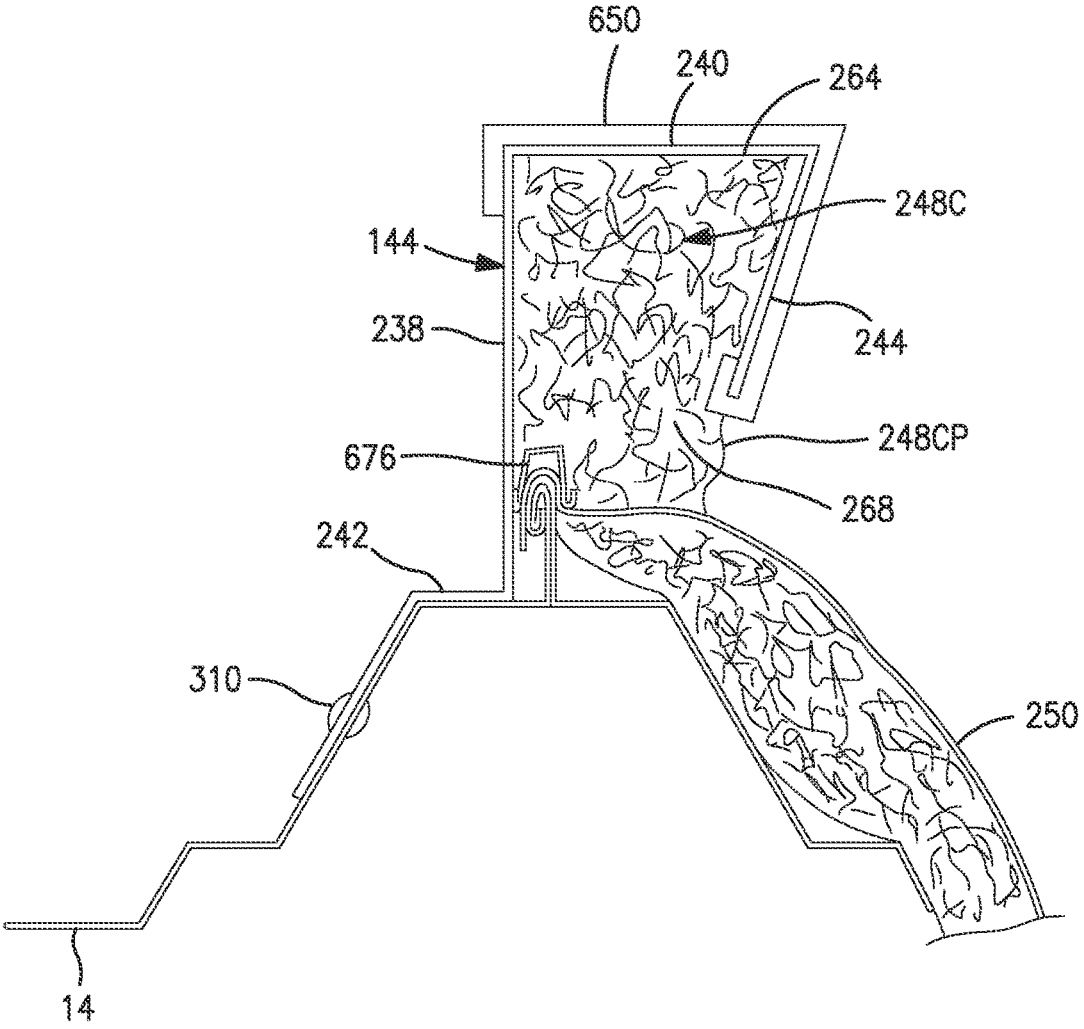
FIG. 39 shows an enlarged end view of a relatively shortened-height rail as in FIG. 36, but where the space inside the rail cavity, down to the insulation, is filled with an elongate strip of thermally-insulating batting material.

FIG. 39 illustrates a further embodiment, similar to that of FIG. 36, except that a length of e.g. fiberglass batt material is inserted into cavity 264 instead of a length of rod 260.

Thus, rail 144 has an upstanding web 238, upper flange 240, inside panel 244, and lower shoulder 242. Inside panel 244 extends from upper flange 240 at an optional acute angle β of about 75 degrees; although in this embodiment up to a perpendicular angle β is acceptable. Rivets 310 are spaced along the length of the rail, mounting the rail to underlying rib 32 above panel flat 14. External thermal break 650 covers inside panel 244 and upper flange 240. Short extensions of the thermal break extend down web 238 and around the distal end of inside panel 244.

Insulation 248 extends up through opening 249 in the roof and lies against rib 32 up to the top of the rib at standing seam 18. Vapor barrier layer 250 of the insulation extends over the top of the standing seam and down between the standing seam and upstanding web 238 of the rail. The vapor barrier layer is held in place over the standing seam by a plurality of resilient spring clips 676 mounted over the vapor barrier and onto the standing seam, respective such clips being spaced along the length of the rail.

A length of deformable, compressible fiberglass batt material 248C, typically having no vapor barrier layer, is inserted into cavity 264. Batt material 248C is resiliently compressible, and is compressed as the batt material is being inserted through opening 268 into cavity 264. Batt material 248C, is inserted into cavity 264 far enough that, once the compressed batt material is released in the cavity, and the batt material expands against the cavity walls, the expanded batt material reaches, and interfaces with, at least web 238 and inside panel 244, optionally with upper flange 240. With the cross-section of the batt material thus extending across the full width of the cavity between web 238 and inside panel 244, the frictional engagement of the batt material against the inner surfaces of web 238 and inside panel 244, along the tapering, narrowing cross-section of cavity 264, top to bottom, optionally in combination with engagement of the batt material with the up-turned end of thermal break 650 at the inside surface of inside panel 244, and the relatively narrow width of opening 268 between panel 244 and vapor barrier 250, retains batt material 248C in cavity 264, even though a portion 248CP of the batt material extends outwardly through cavity opening 268.

The outwardly extending portion of the batt material extends to, and interfaces with, an upper portion of insulation 248 at vapor barrier 250. Thus, the combination of insulation 248 and batt material 248C provides thermal break properties extending upwardly between opening 249 and the inner surface of upper flange 240. Thermal break structure 650 provides the thermal break properties between the inner and outer surfaces of the upper flange and inside panel 244.

The rail assembly embodiment of FIG. 39 is assembled generally as follows. After the aperture/opening 249 has been cut, the insulation is prepared for extension up through the aperture. The insulation batt is stripped away from enough of the vapor barrier to accommodate passing the vapor barrier over the top of standing seam 18 and attaching spring clips 676 over the vapor barrier and thus mounting the vapor barrier to the standing seam. In the process of extending the insulation up through aperture 249, batt material is lifted up and about shoulder 16 so as to provide thermal insulation properties to the exposed, inwardly-facing surface of the shoulder, as shown in FIG. 39.

With the insulation thus held in place, and typically after the upper diverter has been assembled to the respective roof panels, rail 144 is mounted to the shoulder of the respective rib, using rivets 310 as illustrated. Thermal break 650 can be installed either before or after the rail has been mounted to the rib. With the rail so mounted to the rib, and with thermal break 650 mounted to the rail, insulation batt material 248C is inserted into cavity 264 such that the batt material extends down from opening 268 to the top of vapor barrier layer 250, again as shown in FIG. 39. Thus the combination of batt material 252 of layer 248 and batt material 248C in cavity 264 collectively provide an upwardly-extending thermal barrier from the inner surface of flange 240 to the bottom of the rib cut at aperture 249, interrupted only by vapor barrier layer 250.

Figure 40:
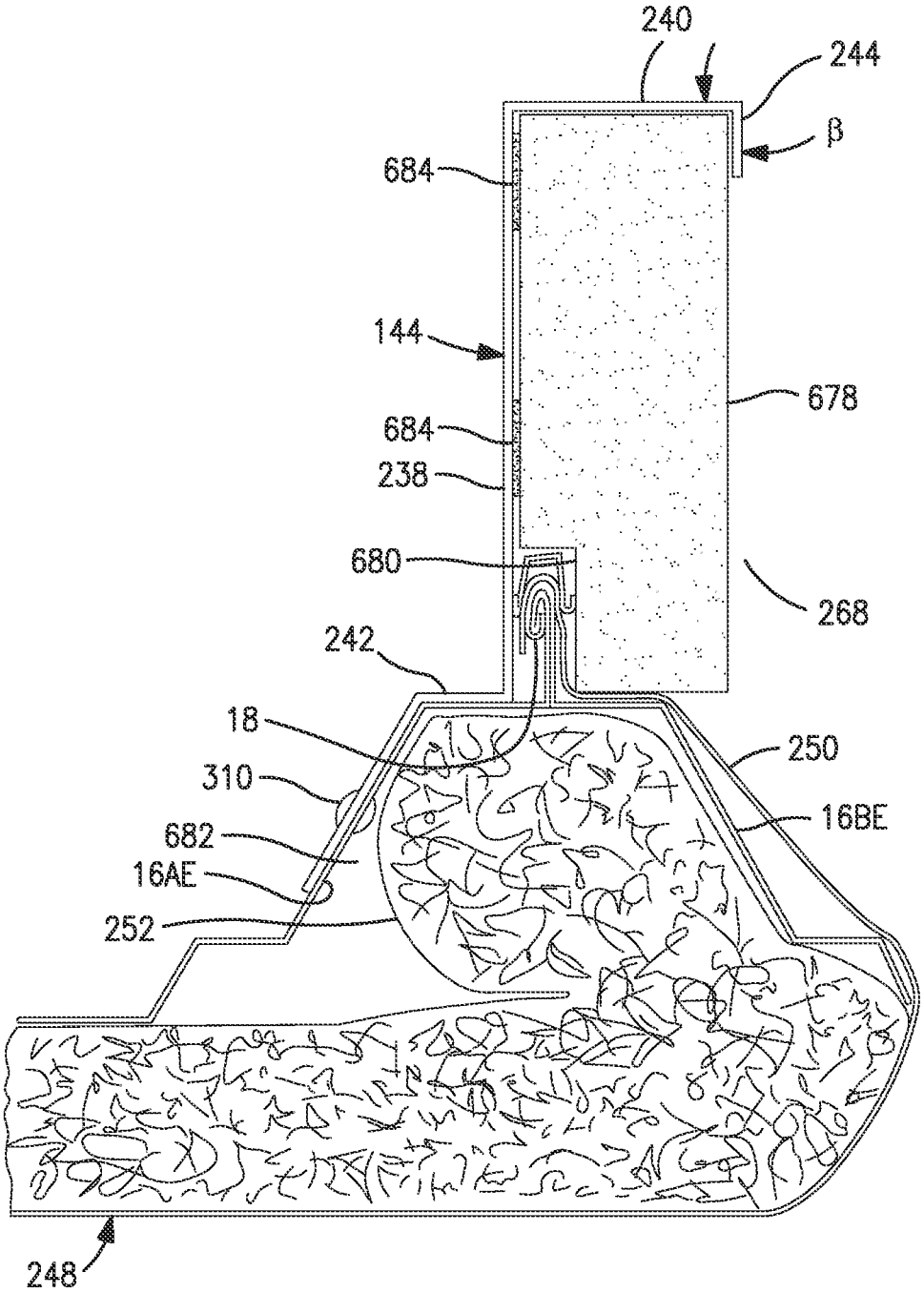
FIG. 40 shows an enlarged end view of a rail mounted on a rib where the vapor barrier of the underlying insulation is secured to the standing seam with a clip, the thermal batting of the underlying insulation is stuffed into the rib cavity under the rib, and the space inside the rail cavity, down to the top of the rib, is occupied by a relatively shape-retaining, but also resiliently-compressible, thermal insulation board.

FIG. 40 illustrates yet another embodiment, similar to that of FIG. 39, In the embodiments illustrated in FIG. 40, rail 144 has an upstanding web 238, upper flange 240, inside panel 244, and lower shoulder 242. Inside panel 244 is relatively shorter than the inside panel illustrated in FIGS. 36-39, and extends down from upper flange 240 at an angle 3 which is generally perpendicular to the upper flange, Inside panel 244 in this embodiment is, for example and without limitation, about 0.25 inch to about 0.38 inch in height. As in others of the illustrated embodiments, rivets 310 are spaced along the length of the rail, mounting the rail to underlying rib 32 above panel flat 14. The embodiment of FIG. 40 does not show an external, non-foamed extruded polymeric thermal break: however an external, non-foamed extruded polymeric thermal break, or an internal, non-foamed extruded polymeric thermal break, is contemplated, especially thermally moderating/protecting the inward end of flange 240 where panel 240 meets inner panel 244.

Vapor barrier 250 extends up through opening 249 in the roof and lies against rib 32 up to the top of the rib at standing seam 18. As in the embodiment of FIG. 39, vapor barrier layer 250 extends over the top of the standing seam and down between the standing seam and upstanding web 238 of the rail. Also as in FIG. 39, the vapor barrier layer is held in place over the standing seam by a plurality of resilient spring clips 676 mounted over the vapor barrier and onto the standing seam, respective such clips being spaced along the length of the rail.

A length of generally rigid, optionally deformable, foam board 678 is shown having been inserted into cavity 264 as a foamed polymeric thermal break. A typical foam board is expanded bead polystyrene foam having a density of about 2 pounds per cubic foot (pcf) to about 20 pcf, optionally about 4 pcf to about 8 pcf. Such foam is modestly resiliently compressible and generally returns to its uncompressed configuration so long as its elastic limit has not been exceeded, and so long as the foam has not been permanently damaged such as by tearing or cutting.

Foam board 678 has a notch 680 which extends along the full length of the board, where foam material has been removed in order that the board can mount over, and correspondingly receive, the combination of standing seam 18, vapor barrier 250, and resilient spring dips 676.

In the embodiment illustrated, foam board 678 generally fills cavity 264, typically being in face-to-face contact with web 238, flange 240, inner panel 244, the top and a side of spring dip 676, and vapor barrier layer 250 at the top of shoulder 16. When the foam board is inserted into cavity 264, the foam may be slightly compressed at one or more of the contact interface with the lower surface of upper flange 240, the contact interface with the upper surfaces of clips 676, the contact interface with the cavity-facing surface of inner layer 244, and the contact interface with vapor barrier layer 250 at the top of shoulder 16.

The recited minor levels of compression experienced by foam board 678 at such interfaces when the foam board is inserted into cavity 264 can create enough friction between the foam board and the other facing members to retain the foam board in cavity 264.

The compressibility, deformability of the foam board is such that the board can be deformed enough to allow the board to be manually inserted through opening 268, into cavity 264. Where the foam board has limited resilient compressibility, such as with expanded bead polystyrene foam, opening 268 is expansive as shown, extending almost the full height of web 238, whereby only a small downward length of inner panel 244 is available to retain the top of board against displacement from cavity 264. In such instance, the amount of deformation as the board is inserted into cavity 264 is relatively minimal.

Where the board is more compressible, deformable, such as tolerating a resilient compressive reduction of e.g. at least about 25 percent in any given dimension, and readily recovering from such compressive reduction in dimension, then the dimension of opening 268, between the end of flange 244 and the top of rib 32, is reduced accordingly, and is more like the opening illustrated in FIG. 39, or some size between the relative opening dimensions illustrated in FIGS. 39 and 40.

Whatever the resilient compressibility of the foam board, opening 268 is sized accordingly, in order to both enable the user to insert the board as desired into cavity 264, and to retain the board in the cavity after the board has been so inserted.

Turning attention now to insulation layer 248 in FIG. 40, vapor barrier layer 250 extends up through aperture/opening 249, up alongside rib 32, under foam board 678, over standing seam 18, and is captured on, and held to, the standing seam by spring dips 676. Batt material 252 of insulation layer 248 has been stripped from that portion of the vapor barrier layer which extends up through aperture/opening 249, and has been folded back on itself under rib 32, and has been pushed up into the cavity 682 at the underside of rib 32, thus providing a thermal barrier inside cavity 682 between the shoulder 16AE which faces the ambient environment and the shoulder 16BE which faces vapor barrier 250 and the interior building environment.

The rail assembly embodiment of FIG. 40 is assembled generally as follows. After the aperture/opening 249 has been cut, the vapor barrier layer is prepared for extension up through the aperture. The insulation batt is thus stripped away from enough of the vapor barrier to accommodate passing only the vapor barrier up through the aperture, over the top and down along the far side of standing seam 18, and attaching spring clips 676 over the vapor barrier and thus mounting the vapor barrier to the standing seam as illustrated. Before the vapor barrier is so extended up through the aperture, the stripped-away edge portion of the e.g. fiberglass batt material is stuffed upwardly, as shown in FIG. 40, into cavity 682 which is defined by the rib elevations which define the respective rib 32.

After the edge portion of the insulation batt material has thus been stuffed up into cavity 682, the vapor barrier layer is extended up through the aperture/opening, over and about the standing seam, and secured in place by clips 676. With the vapor barrier thus held in place, and typically after the upper diverter has been assembled to the respective roof panels, rail 144 is mounted to the shoulder of the respective rib, using rivets 310 as illustrated. A thermal break 650 can be installed on the rail as in e.g. FIG. 39, if desired, either before or after the rail has been mounted to the rib.

With the rail so mounted to the rib, and with thermal break 650, if any, mounted to the rail, foam insulation board 678 is inserted into cavity 264 such that the foam board extends down from opening 268 to the top of the respective shoulder 16 of the rib elevation. Thus, the combination of batt material 252 of layer 248 and foam board 678 in cavity 264 collectively provide an upwardly-extending thermal barrier from the inner surface of flange 240 to and through the bottom of the rib cut at aperture 249, interrupted only by vapor barrier layer 250 and the horizontally-extending portion of rib shoulder 16.

Inserting foam board 678 into cavity 264 may involve a modest amount of manual compression of board 678 such that the board material expands against the cavity walls whereby the expanded foam material reaches, and interfaces with enough of the surface elements of cavity 264, optionally including upper flange 240, inner flange 244, the tops of clips 676, and/or the vapor barrier layer at the top of shoulder 16, whereby certain ones of such interfaces provide frictional engagement with board 678, thereby to retain foam board 678 in the cavity, even though a portion of the foam board extends downwardly through cavity opening 268.

The downwardly extending portion of the foam board extends to, and interfaces with, the upwardly-facing surface of vapor barrier 250.

As an alternative, or supplemental, method of installing foam board 678, two-sided adhesive tape 684 can be mounted to the surface or surfaces of web 238 and/or flange 240 which face into cavity 264. After the tape has been so mounted to such cavity wall surfaces, the foamed board thermal break is inserted into the cavity and urged against the exposed surfaces of the tape, thereby fixedly attaching the foamed thermal break to the cavity wall. In some instances, especially where the foam board thermal break fits closely and with some compression against the wall surfaces of cavity 264, the tape supplements the frictional engagement of the board with the wall surfaces, whereby the board is held in cavity 284 by a combination of friction, and tape adhesion as a fixed attachment.

In other instances, foam board 678 is cut to more loosely fit into cavity 264 whereby, while inner panel 244 and the top of shoulder 16 assist in positioning the board in the cavity, the two-sided tape is the primary structure which assures that the board will be retained inside cavity 264.

Now addressing all of the embodiments illustrated, the weight of a load received on rails 142, 144 is transferred directly from the rails, to ribs 32 of the respective underlying roof panels, optionally along the full lengths of the support structure; and only a minor portion, such as less than 10%, if any, of that weight is borne by the panel flat, and only at the upper and lower ends of the support structure. Thus, the weight conveyed by the rails, or conveyed by the rail and closure structure, is borne by those elements of the roof panels which are most capable of bearing weight without substantial deflection of the roof panels under load, namely most, if not all, of the weight is carried by the ribs.

A wide variety of roof-mounted loads, in addition to skylights and smoke vents, is contemplated to be mounted on rails 142, 144, so long as the weight of such roof-mounted loads does not exceed the allowable load on the ribs. Where the load does not overlie an opening of substantial size in the roof, such as where a roof-mounted load is e.g. an air conditioner or electrical panel, the upper diverter and the lower closure can be omitted. Where the upper diverter and lower closure are omitted, nominally 100% of the load passes through rails 142, 144 to ribs 32, thence through the ribs defined by the roof panels, and thence to the building structural members. While the rails can extend onto an intervening panel flat, such is not the typical case. Rather, the rails are typically confined to the ribs, with the load spanning the panel flat above the ribs whereby rain water freely flows down the panel flat between the rails, optionally under the load.

The primary reason why the disclosed rail and closure structures can surround an opening without water leakage is that a great portion of the perimeter of the support structure, namely that which is defined by side rails 142, 144, is above the panel flat, namely above the normal high water line on the roof panel; and all associated roof penetrations, such as screws 310 which mount the rails to the ribs, are above the water line. With little or no standing water at the joinders between the rails and the roof panels, or at any fasteners, even if the sealant fails at a joinder, no substantial quantity of water routinely enters such failed joinder because of the heights of such joinders above the water line.

Rail and closure structures of the invention close off a roof opening from unplanned leakage of e.g. air or water through such roof opening. The rail and closure structure 140 extends about the perimeter/sides of the roof opening and extends from the roofing panel upwardly to the top opening in the rail and closure structure. A closure member, e.g. skylight subassembly, overlies the top opening in the rail and closure structure and thus closes off the top opening to complete the closure of the roof opening.

Support structure 100 thus is defined at least in part by rail and closure structure 140 about the perimeter of the roof opening, and the closure member, such as skylight assembly 130, or the like, overlies the top of the rail closure structure and thus closes off the top of the closure support structure over the roof opening.

Rail and closure structure 140 has been illustrated in detail with respect to one or more variations of the standing seam roofs illustrated in FIGS. 1, 3, and 5. In light of such illustrations, those of skill in the art can now adapt the illustrated rail and closure structures, by modifying, shaping of the structure elements, to support loads from any roof system which has a profile which includes elevations, above the panel flat, using standing joinders or other raised elevations, such as, without limitation, those illustrated in FIGS. 2 and 4, as the locus of attachment to the roof.

While the figures depict a skylight, the rail structure, with or without end closures, can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on rail structures of the invention, and the rails passing the load to and through ribs 32 of the metal panel roof, thence directly or indirectly to underlying building framing members inside the controlled-environment space inside the building.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. In combination, (a) a support structure mounted about a space above an opening in a metal panel roof of a building, the space above the opening communicating with a climate-controlled space inside the building, said support structure, in combination with an overlying load, isolating air in the space above the opening and inwardly of the support structure from ambient air outside the building, said support structure comprising a plurality of closure members, including first and second rails, an upper diverter, and a lower closure, each of said first and second rails, said upper diverter, and said lower closure comprising (i) an upstanding web, (ii) an upper flange extending laterally from an upper portion of the upstanding web and inwardly toward the opening, and (iii) an inner panel extending, from said upper flange, down to a lower reach of said inner panel, said inner panel having an inner surface facing toward said upstanding web and an outer surface facing inwardly into the opening;

(b) thermal insulation extending upwardly from underneath the roof, up through the opening and alongside a said closure member, up to an elevation at least as high as the lower reach of the respective said inner panel, said thermal insulation being disposed between said upstanding web and the air in the space above the opening, and (c) as a separate element, a thermal break, at least a portion of said thermal break being disposed on at least a portion of the outer surface of the respective said inner panel, said thermal insulation, in combination with said thermal break, providing effective thermal break properties from below such roof, up through the opening, and up to a top of said support structure, sufficient to prevent moisture from condensing on the respective said closure member.

2. A combination as in claim 1 wherein more than half of a surface area of said thermal break, which surface area faces toward said rail, is between said inner panel and such opening.

3. A combination as in claim 1, a majority of said thermal break being disposed outwardly of the outer surface of said inner panel.

4. A combination as in claim 1, said thermal break comprising an elongate thermoplastic extrusion.

5. A combination as in claim 1, the outer surface of said inner panel comprising a first outer surface, said upper flange having a second outer surface facing away from the building roof and extending from the first outer surface of said inner flange, said thermal break extending onto the outer surface of said upper flange.

6. A combination as in claim 5, said upstanding web having a third outer surface facing away from the space above the opening and extending down from the second outer surface of said upper flange, said thermal break extending onto the third outer surface of said upstanding web.

7. A combination as in claim 1, said thermal break having an inner surface facing said inner panel, including serrations on such inner surface of said thermal break, so as to create dead air spaced between said rail and said thermal break.

8. A combination as in claim 7 wherein at least 50 percent of the inner surface of said thermal break is spaced from the respective surface of said rail by said serrations.

9. A combination as in claim 1, said thermal break extending, from the inner surface of said inner panel about a bottom distal edge of said inner panel and upwardly overlying the outer surface of said inner panel to the top of said inner panel.

10. In combination, (a) a support structure mounted about a space above an opening in a metal panel roof of a building, the space above the opening communicating with a climate-controlled space inside the building, said support structure, in combination with an overlying load, isolating air in the space above the opening and inwardly of the support structure from ambient air outside the building, said support structure comprising a plurality of closure members, including first and second rails, an upper diverter, and a lower closure, each of said first and second rails, said upper diverter, and said lower closure comprising (i) an upstanding web, (ii) an upper flange extending laterally from an upper portion of the upstanding web and inwardly toward the opening, and (iii) an inner panel extending, from said upper flange, down to a lower reach of said inner panel, said inner panel having an inner surface facing toward said upstanding web and an outer surface facing inwardly into the opening;

(b) thermal insulation extending upwardly from underneath the roof, up through the opening and alongside a said closure member, up to an elevation at least as high as the lower reach of the respective said inner panel, said thermal insulation being disposed between said upstanding web and the air in the space above the opening, and (c) as an additional element, a thermal break extending alongside said inner panel, from the inner surface of said inner panel, about a bottom distal edge of said inner panel at the lower reach of said inner panel.

11. A combination as in claim 10, the outer surface of said inner panel comprising a first outer surface, said upper flange having a second outer surface facing away from the building roof and extending from the first outer surface of said inner flange, said upstanding web having a third outer surface facing away from the space above the opening and extending down from the second outer surface of said upper flange, said thermal break being disposed primarily on the first, second, and third outer surfaces.

12. A combination as in claim 10, the outer surface of said inner panel comprising a first outer surface, said upper flange having a second outer surface facing away from the building roof and extending from the first outer surface of said inner flange, said thermal break being disposed against the first and second outer surfaces.

13. A combination as in claim 10 wherein said thermal break extends upwardly, overlying the outer surface of said inner panel and extending to the top of said inner panel.

14. In combination, (a) a support structure mounted about a space above an opening in a metal panel roof of a building, the space above the opening communicating with a climate-controlled space inside the building, the support structure, in combination with an overlying load, isolating the air in the space above the opening and inwardly of the support structure from ambient air outside the building, said support structure comprising a plurality of closure members, including first and second rails, an upper diverter, and a lower closure, each of said first and second rails, said upper diverter, and said lower closure comprising (i) an upstanding web having an upper portion and a respective upper end, and a lower portion and a respective lower end, (ii) an upper flange extending laterally from the upper portion of the upstanding web and inwardly toward the opening, and (iii) an inner panel extending, from a upper flange, down to a lower reach of said inner panel, said inner panel having an inner surface facing toward said upstanding web and an outer surface facing inwardly into the opening;

(b) thermal insulation extending upwardly from underneath the roof, up through the opening and alongside a said closure member, up to an elevation at least as high as the lower reach of the respective said inner panel, said thermal insulation being disposed between said upstanding web and the air in the space above the opening, and (c) as an additional element, a thermal break extending alongside the outer surface of said upstanding web, from the lower end of said upstanding web to the upper end of said upstanding web.

15. A combination as in claim 14 wherein a substantial portion of said upstanding web is between said thermal break and the opening.

16. A combination as in claim 10, the outer surface of said inner panel comprising a first outer surface, said upper flange having a second outer surface facing away from the building roof and extending from the first outer surface of said inner flange, said upstanding web having a third outer surface facing away from the space above the opening and extending down from the second outer surface of said upper flange, a majority of said thermal break being disposed outwardly of the first, second, and third outer surfaces.

17. In combination, (a) a support structure mounted about a space above an opening in a metal panel roof of a building, the space above the opening communicating with a climate-controlled space inside the building, said support structure, in combination with an overlying load, isolating the air in the space above the opening and inwardly of the support structure from ambient air outside the building, said support structure comprising a plurality of closure members, including first and second rails, an upper diverter, and a lower closure, each of said first and second rails, said upper diverter, and said lower closure comprising (i) an upstanding web having an upper portion and a respective upper end, and a lower portion and a respective lower end, (ii) an upper flange extending laterally from the upper portion of the upstanding web and inwardly toward the opening, said upper flange having a second inner surface facing toward the roof and a second outer surface facing away from the roof, and (iii) an inner panel extending, from said upper flange, down to a lower reach of said inner panel, said inner panel having a third inner surface facing toward said upstanding web and a third outer surface facing inwardly into toward the controlled-temperature air above the opening;

(b) thermal insulation extending upwardly from underneath the roof, up through the opening and alongside a said closure member, up to an elevation at least as high as the lower reach of the respective said inner panel, said thermal insulation being disposed between said upstanding web and the air in the space above the opening, and (c) as an additional element, a thermal break having an inner surface extending alongside facing a said rail, including serrations on such inner surface of said thermal break which faces said rail, so as to create dead air spaces between said rail and said thermal break.

18. A combination as in claim 17, a respective one of said rails having a length, said thermal break being fixedly attached to the respective said rail and extending along the entirety of the length of the respective said rail.

19. A combination as in claim 17, said thermal break being disposed primarily on the first, second, and third outer surfaces.

20. A combination as in claim 19, said thermal break being disposed on the outer surfaces of said inner panel and said upper flange.

* * * * *